US008893586B2

(12) United States Patent
Nagel, III

(10) Patent No.: US 8,893,586 B2
(45) Date of Patent: Nov. 25, 2014

(54) FASTENER EXTRACTION DEVICE

(76) Inventor: Walter Heinrich Nagel, III, Seville, OH (US)

( * ) Notice: Subject to any disclaimer, the term of this patent is extended or adjusted under 35 U.S.C. 154(b) by 279 days.

(21) Appl. No.: 13/490,616

(22) Filed: Jun. 7, 2012

(65) Prior Publication Data

US 2012/0240372 A1 Sep. 27, 2012

Related U.S. Application Data

(63) Continuation-in-part of application No. 13/401,442, filed on Feb. 21, 2012, which is a continuation-in-part of application No. 12/830,819, filed on Jul. 6, 2010, now abandoned.

(51) Int. Cl.

| | |
|---|---|
| ***B25B 21/00*** | (2006.01) |
| ***B25B 23/10*** | (2006.01) |
| ***B25B 23/00*** | (2006.01) |
| ***B25B 9/00*** | (2006.01) |

(52) U.S. Cl.

CPC . *B25B 9/00* (2013.01); *B25B 23/00* (2013.01); *B25B 23/101* (2013.01); *B25B 23/10* (2013.01)

USPC ..... 81/54; 81/451

(58) Field of Classification Search

USPC ..... 81/451–458, 53.2, 54–56, 180.1

See application file for complete search history.

(56) References Cited

U.S. PATENT DOCUMENTS

| | | | | |
|---|---|---|---|---|
| 3,965,950 | A * | 6/1976 | MacDonald | 81/455 |
| 5,207,127 | A * | 5/1993 | Nick | 81/54 |
| 6,314,845 | B1 * | 11/2001 | Wu | 81/455 |
| 7,234,376 | B2 * | 6/2007 | Bader | 81/55 |

* cited by examiner

*Primary Examiner* — Hadi Shakeri

(74) *Attorney, Agent, or Firm* — Thompson Hine L.L.P.

(57) ABSTRACT

A fastener extraction device includes a body configured for attachment to a power driver tool, and allows a rotating chuck provided thereby to extend therethrough. The extraction device includes a plurality of spring-biased grasping arms that are pivotably attached to the body and are moved between opened and closed positions by an automated actuation collar that is in operative engagement with the grasping arms. The automated actuation collar includes collar magnets that are in operative communication with electromagnets that are controlled by a push button provided by the driver tool. Thus, the automated actuation collar allows the grasping arms to be selectively opened and closed in a convenient manner, allowing fasteners to be extracted without the operator having to change or release his or her grip of the driver tool.

5 Claims, 44 Drawing Sheets

FASTENER EXTRACTION DEVICE

CROSS-REFERENCE TO RELATED APPLICATIONS

This application is a continuation-in-part of U.S. application Ser. No. 13/401,442, filed Feb. 21, 2012, which is a continuation-in-part of U.S. application Ser. No. 12/830,819, filed Jul. 6, 2010, now abandoned the contents of which are incorporated herein by reference.

TECHNICAL FIELD

Generally, the present invention relates to extraction devices used to remove installed fasteners. Particularly, the present invention relates to an extraction device to remove screws installed in a surface, such as drywall. More particularly, the present invention relates to an extraction device having an automated actuation collar that is configured to open and close grasping arms to remove a fastener upon the actuation of a push button.

BACKGROUND ART

During the installation of various surface materials, fasteners are utilized to retain them in place. For example, surface materials, such as drywall, are typically installed using screws that are driven by an electrically-powered driver tool, such as a drill, impact driver, or the like. The drywall screws are inserted through the drywall sheet and into wood or metal studs that serve as a support structure, allowing the drywall sheets to be attached thereto. Furthermore, because drywall is the primary material that is used for the construction of walls in buildings and homes, a substantial number of fasteners are needed to secure the drywall sheet to the anchoring studs. In addition, a large number of screws are needed in order to comply with local building codes and regulations as well. Furthermore, because drywall sheets are required to be attached to wood or metal studs, such as two-by-fours, only a small region common to the drywall and stud is provided whereby the screw can be received through both the drywall and the stud.

However, due to the large number of screws that are installed during a typical drywall installation, an installer may insert a number of screws into the drywall that fail to reach or otherwise be anchored in the stud. That is, instances arise where a drywall installer fails to install the screw in the appropriate location, such that the screw is received only within the drywall without being thereby received and retained within the stud. Unfortunately, due to the consistency of the drywall, screws that are driven only into the drywall cause a hole to be bored therein without sufficient threads being formed, thus preventing the threads of the screw from grabbing the drywall so that the screw can be backed out by reversing the rotation of the driver tool.

Unfortunately, leaving improperly installed screws in the drywall does not yield a satisfactory result, as the finishing compound applied over the head of the screws prevent the surface of the drywall from being smooth when installed. As such, drywall installers often use a pry tool, screwdriver, or their fingers to extract the screw from the drywall. In addition, when using their hands, they may get cut, bruised, or otherwise injured after the completion of several screw extractions. This process is often tedious, time-consuming, and can cause damage to the drywall. Moreover, the use of such tools requires the installer to set the driver tool down and find the pry tool, which decreases the installer's productivity, while making the installer's job difficult and unpleasant.

In addition, because the operator must physically support the driver tool used to install fasteners, it would be beneficial to allow the user to operate a fastener extraction device with minimal effort without necessitating a change in his or her grip of the driver tool. That is, current fastener extraction devices require the operator to release his or her operative grip on the driver tool in order to actuate the extraction device. Unfortunately, this is inconvenient and slows down the operator's work flow and production, as he or she has to reposition his or her hands to operate the extraction device. Furthermore, in some circumstances, such repositioning of the operator's hands may result in the accidental dropping of the driver tool, which may cause injury to the operator and/or damage to the drive tool.

Therefore, there is a need in the art for a fastener extraction device for removing fasteners, such as screws, from drywall. In addition, there is a need in the art for a fastener extraction device that can be mounted or otherwise attached to a power driver or other fastener driving power tool, such as a drill, impact driver, or the like. Moreover, there is a need in the art for an automated fastener extraction device that is low cost. In addition, there is a need for an automated fastener extraction device that includes an automated extraction system that allows a user to control the operation of the grasping arms without requiring the user to release his or her operative grip of the driver tool.

SUMMARY OF INVENTION

In light of the foregoing, it is an aspect of the present invention to provide a fastener extraction device for attachment to a driver tool having a rotating shank to drive a fastener into a surface, the fastener extraction device comprising an elongated main body adapted to be attached to the driver, the main body including a plurality of electromagnets; a carriage carried within the body; a plurality of grasping arms each having an extraction guide extending therefrom, the plurality of grasping arms pivotably attached to the carriage with each grasping arm biased by a bias spring; an actuation collar rotatably attached to the elongated main body and in operative contact with the grasping arms, the actuation collar including a plurality of collar magnets in operative communication with the electromagnets; a switch; and a controller coupled to the switch and the electromagnets, the controller supplying a train of electrical pulses to the electromagnets to control the magnetic orientation of the electromagnets relative to the magnetic orientation of the collar magnets to rotate the actuation collar, wherein the elongated main body, the carriage, and the actuation collar are configured to receive the rotating shank therethrough, such that when the switch is placed in a first state, the controller generates a first pulse train to rotate the actuation collar to a first position, whereby the grasping arms are pivoted to form an extraction aperture about the fastener, and when the switch is placed in a second state, the controller generates a second pulse train to rotate the actuation collar to a second position, whereby the grasping arms are pivoted away from the fastener.

BRIEF DESCRIPTION OF THE DRAWINGS

One or more objects and advantages of the present invention will become apparent from the subsequent detailed description of the preferred embodiment and the appended claims taken in conjunction with the accompanying drawings where:

DETAILED DESCRIPTION OF THE INVENTION

Figure 1:
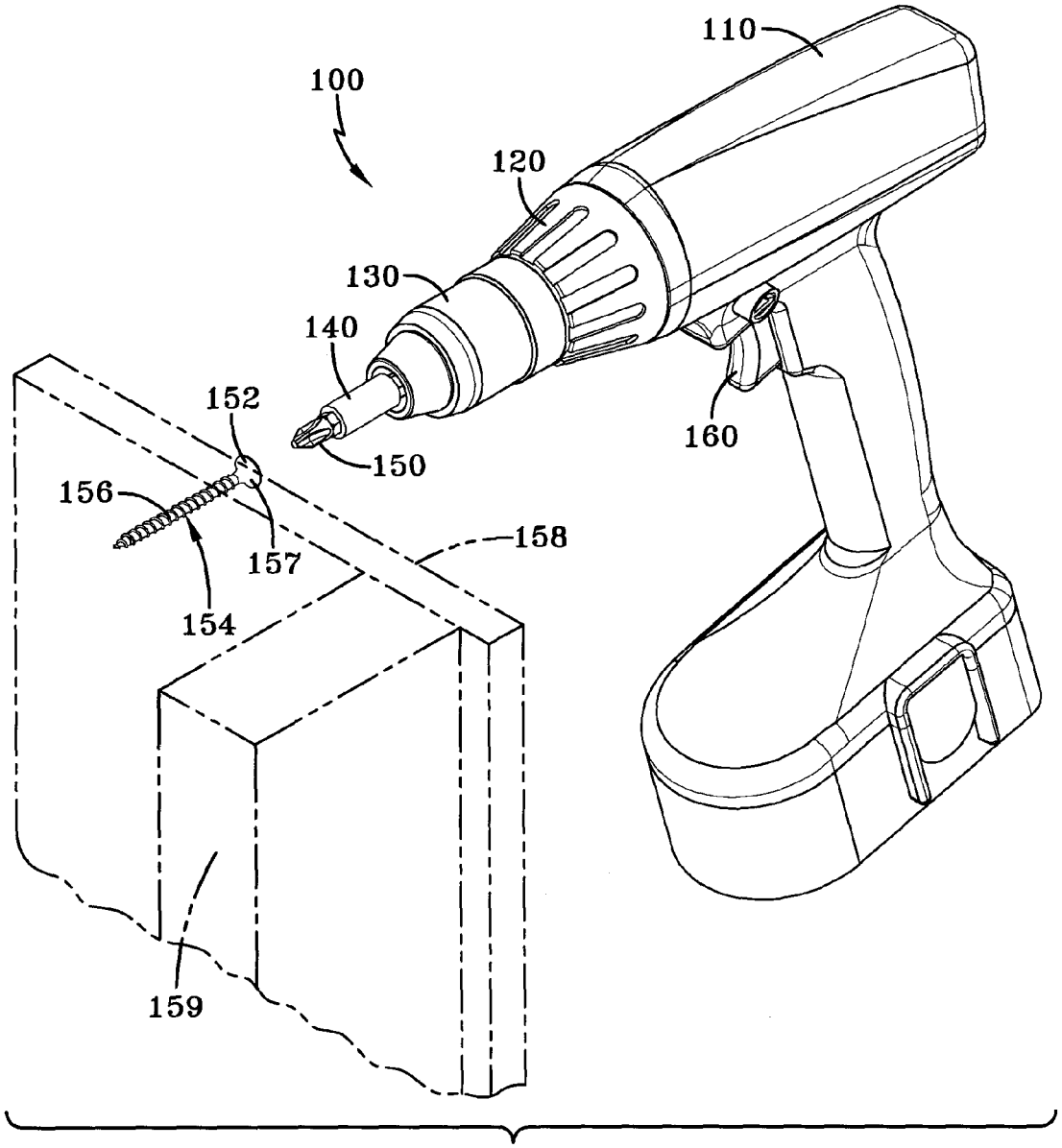
FIG-1 PRIOR ART
FIG. 1 is a perspective view of a prior-art power driver tool.

A fastener extraction device generally referred to by the numeral 10 is configured for use with an electrically-powered driver tool 100, as shown in FIG. 1 of the drawings. The driver tool 100 includes a body 110 that houses the electromechanical components of the driver tool 100. A tapered collar 120 separates the body 110 from a rotating chuck 130 that extends therefrom. The chuck 130 is adapted to selectively retain an attachment shank 140 that holds a removable bit 150, such as a Phillips-head bit, a flat-head bit, a star-head bit, or any other design. The bit 150 engages a head 152 of a fastener, such as a screw 154, which is joined with an elongated threaded shank 156 by a curved neck 157. Thus, the shank 156 allows the screw 154 to be threadably driven into a surface 158 and anchored in a mounting stud 159 provided there behind by the rotation of the chuck 130. In one aspect, the fastener 154 may comprise a drywall screw, wood screw, machine screw or any other screw, while the mounting stud 159 may comprise a wood or metal beam, as well as any other suitable supporting member. As such, the bit 150 may be removed and replaced at the attachment shank 140 if it breaks, becomes worn, or if a bit with a different head-type is needed. The driver 100 also includes a trigger 160 that when selectively engaged by the user, adjusts the rotational speed of the chuck 130 and bit 150, so as to modulate the speed at which the screw 154 is driven into the surface 158 and mounting stud 159. It should be appreciated that the driver tool 100 may comprise a drill, impact driver, or any other suitable tool configured to install screws 154.

The fastener extraction device 10, as shown in FIGS. 2-8 of the drawings, comprises an elongated body 200 having an opposed inner surface 202 and outer surface 204. The body 200 comprises a substantially cylindrical section 206 having opposed ends 208 and 210 from which extend respective front and rear conical sections 230,232. Specifically, the front conical section 230 is oriented so that its apex 240 is distal to the cylindrical section 206, while the rear conical section 232 is oriented so that its apex 242 is proximate to the cylindrical section 206. As such, the cylindrical and conical sections 206,230,232 form a mounting cavity 244 that is bounded by opposed ends 246 and 248. It should be appreciated that the body 200 may be formed of any suitable material, such as plastic, aluminum, or the like.

Figure 3:
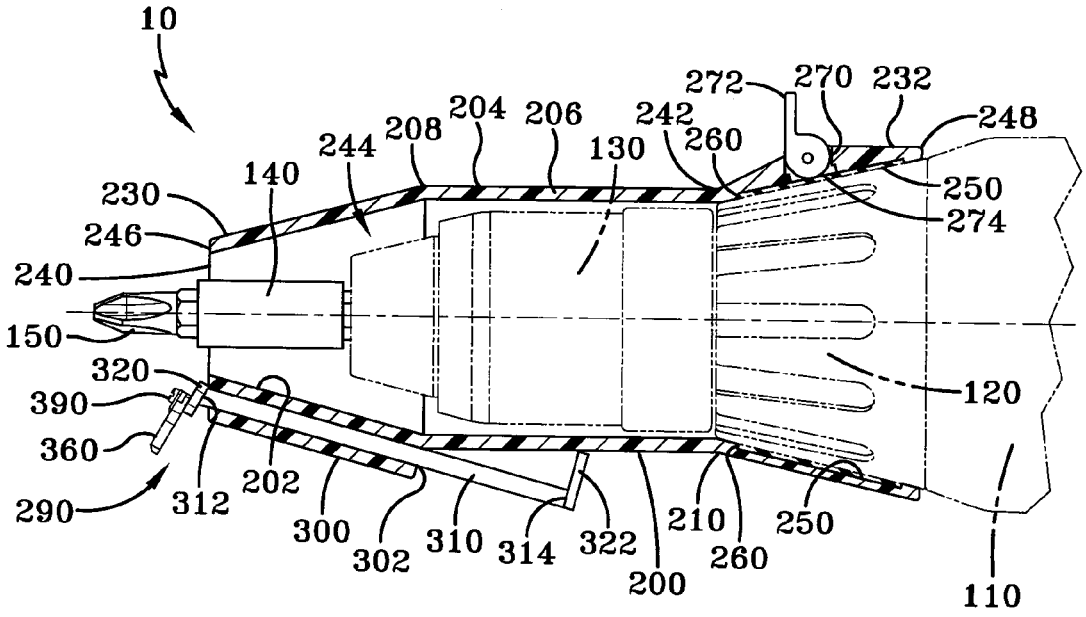
FIG. 3 is a cross-sectional view of the fastener extraction device showing a pair of lock arms in a retracted position in accordance with the concepts of the present invention.
Figure 4:
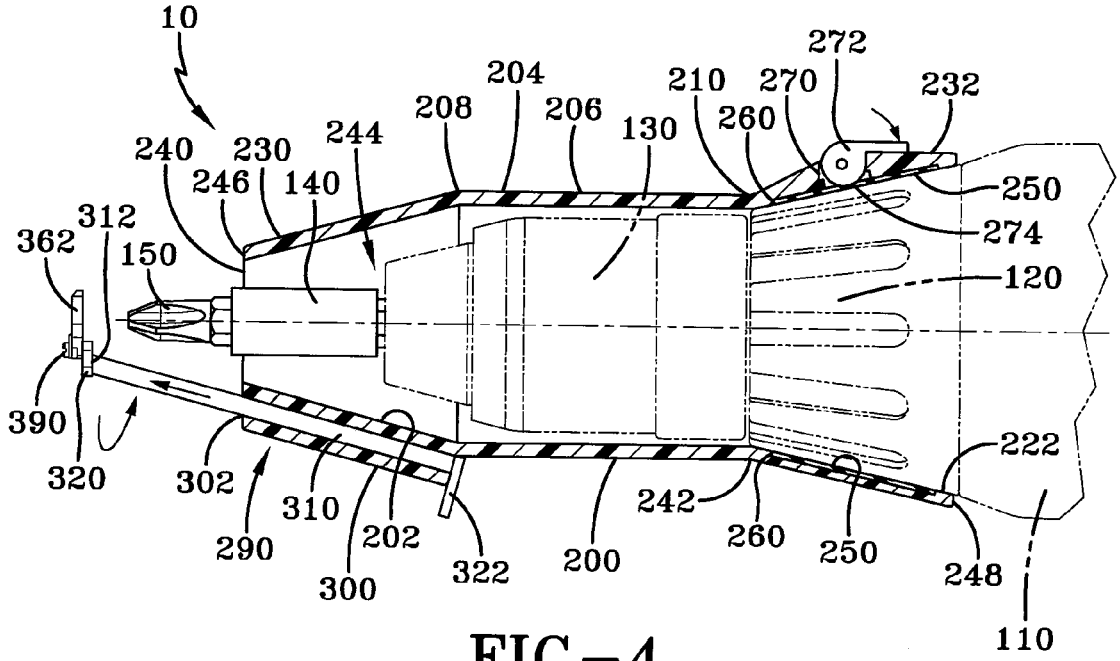
FIG. 4 is a cross-sectional view of the fastener extraction device showing the pair of lock arms in an extended position in accordance with the concepts of the present invention.

Disposed on the inner surface 202 of the rear conical section 232 is a conical compression ring 250, shown clearly in FIGS. 3 and 4, which may be formed of any suitable compressible material, such as foam or rubber for example. It should be appreciated that the conical compression ring 250 may be dimensioned to rest within a channel 260 disposed on the inner surface of the rear conical section 232. Disposed through the rear conical section 232 are one or more apertures 270 in which an attachment tab 272 is rotatably mounted. The attachment tab 272 includes a cam surface 274, which engages and applies force to the compression ring 250 when the attachment tab 272 is rotated to its locked position, as shown in FIG. 4, so as to attach the device 10 to the driver tool 100. Alternatively, when the attachment tab 272 is rotated to its unlocked position, as shown in FIG. 3, the force applied by the cam surface 274 to the compression ring 250 is released, thus allowing the device 10 to be removed from the tool 100. In another aspect, the extraction device 10 may be configured without the use of the compression ring 250, whereby the compression material, such as foam or rubber, is disposed only upon the cam surface 274.

Extending from the front conical section 230 is a retaining guide assembly 290, which comprises a housing 300 having an elongated slide bore 302. The slide bore 302 is dimensioned to slideably receive and maintain a shaft 310 having opposed ends 312 and 314, to which a mounting section 320 and an engagement section 322 are respectively attached.

Figure 2:
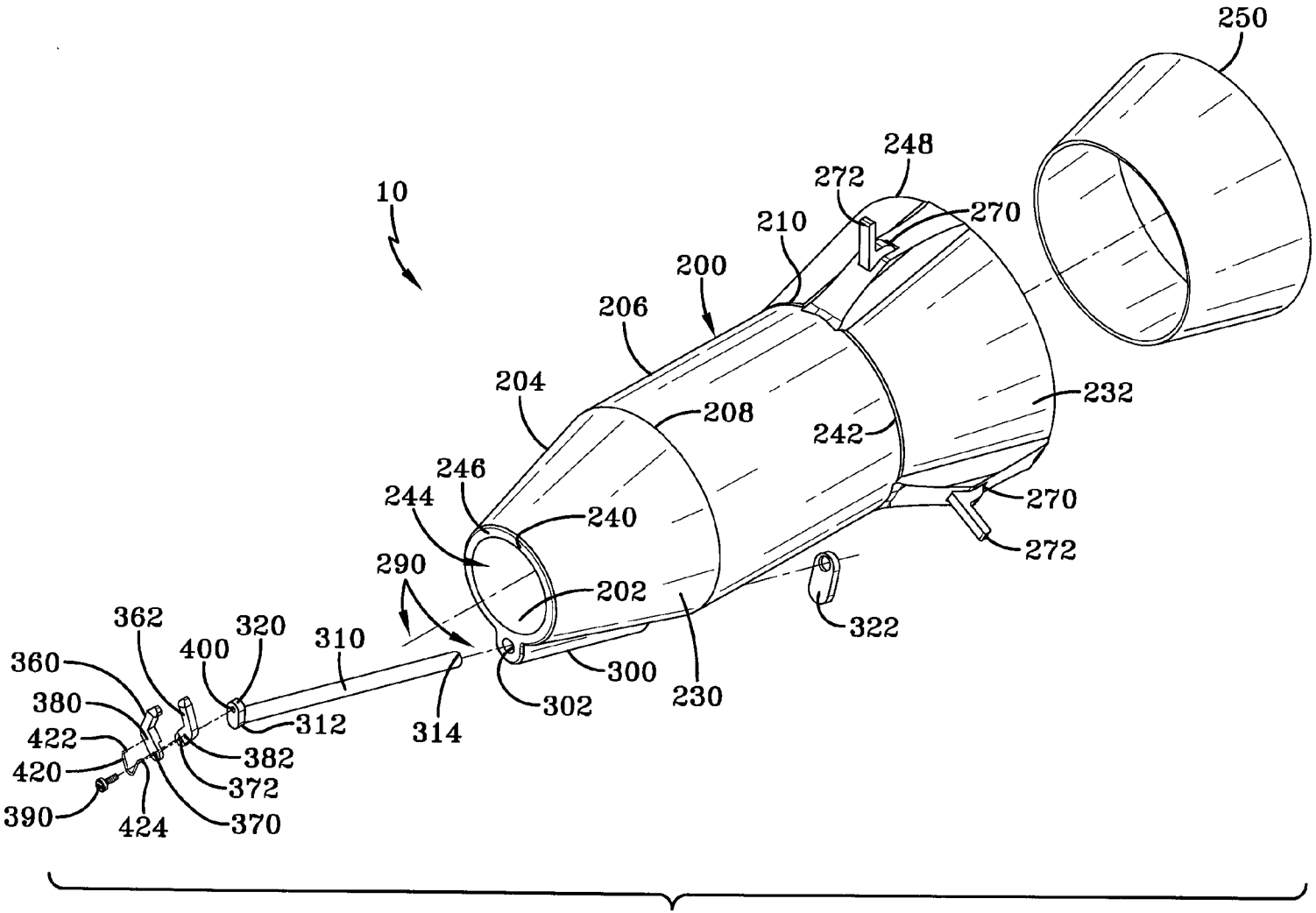
FIG. 2 is an exploded view of a fastener extraction device for use with the prior-art power driver tool of FIG. 1 in accordance with the concepts of the present invention.
Figure 5B:
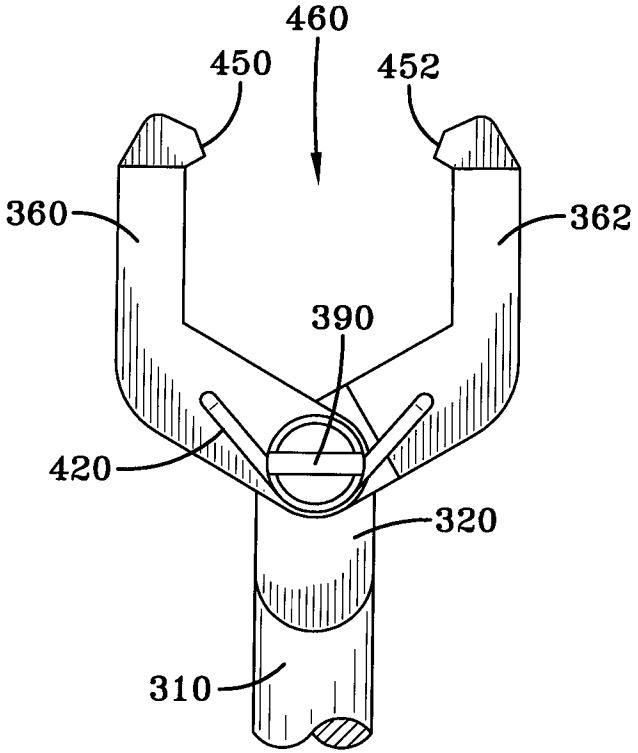
FIG. 5B is an elevational view of the lock arms in an open position in accordance with the concepts of the present invention.
Figure 5A:
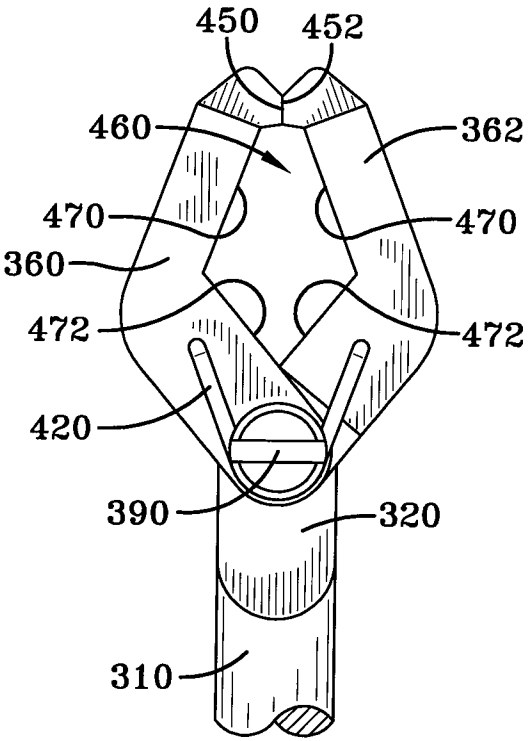
FIG. 5A is an elevational view of the lock arms in a closed position in accordance with the concepts of the present invention.
Figure 6:
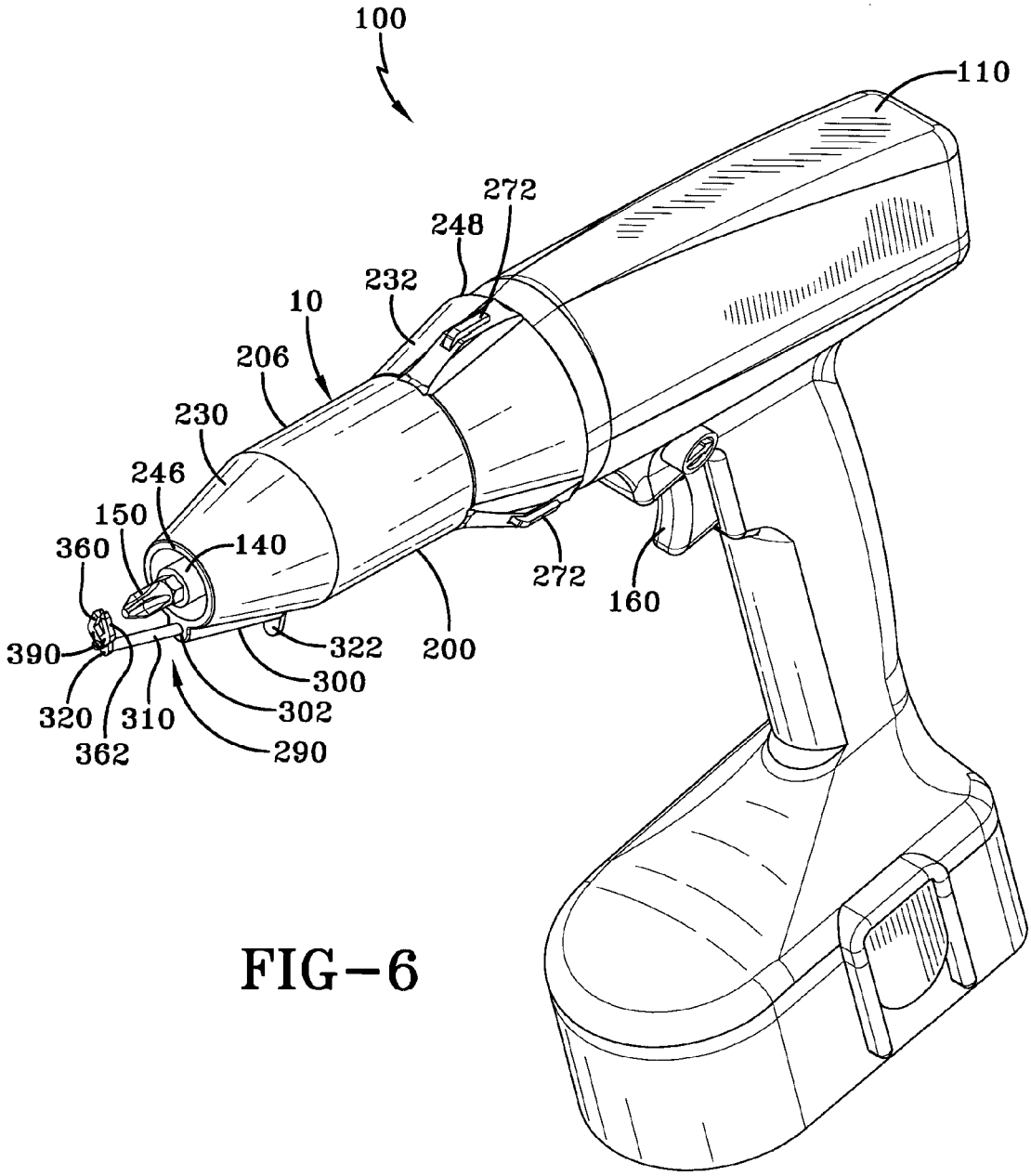
FIG. 6 is a perspective view of the fastener extraction device attached to the power driver tool in accordance with the concepts of the present invention.

Attached to the mounting section 320 is a pair of angled and pivoting extraction arms 360,362, shown clearly in FIGS. 2 and 5A-B, which includes respective pivot apertures 370 and 372 and anchor apertures 380 and 382. To pivotably retain the extraction arms 360,362, a retention screw 390 is received through the pivot apertures 370,372 of each extraction arm 360,362, where it is threadably secured to a mounting aperture 400 provided by the mounting section 320. A wire spring 420 having ends 422 and 424 is attached to the extraction arms 360,362 so that each end 422,424 is received within the anchor apertures 380,382 of the extraction arms 360,362. The wire spring 420 is configured to bias or otherwise place the extraction arms 360,362 in a normally closed position, as shown in FIG. 5A, such that opposed contact surfaces 450, 452 of the respective arms 360,362 are urged together in contact with one another, so as to form a guide aperture 460 that is dimensioned to receive the shank 156 of the screw 154. Specifically, the guide aperture 460 is configured so as to be in substantial axial alignment with the bit 150 when the shaft 310 is in its extended position, which will be discussed in detail below. In one aspect, the lock arms 360,362 may comprise arm sections 470 and 472 that extend from each other at an obtuse angle.

The engagement section 322 is attached to the shaft 310 opposite the extraction arms 360,362 to selectively extend and retract the extraction arms 360,362. It should be appreciated that the engagement section 322 may be coupled to the shaft 310 using any suitable means of fixation, including adhesive or a retention clip for example. Specifically, the engagement section 322 is dimensioned to allow a user of the extraction device 10 to use his finger or thumb to urge or otherwise extend the shaft 310 out of the slide bore 302 so that the lock arms 360,362 are at a position distal to the body 200 of the device 10. Similarly, the engagement section 322 also provides a suitable surface to allow a user to retract the shaft 310 back into the slide bore 302 so that the extraction arms 360,362 are proximate to the body 200 of the device 10. In one embodiment, the surface of the slide bore 302 may be treated with a rubberized material so that it imparts a degree of friction to the shaft 310 to hold it in position, so as to prevent it from freely sliding back and forth when not in use.

Figure 7A:
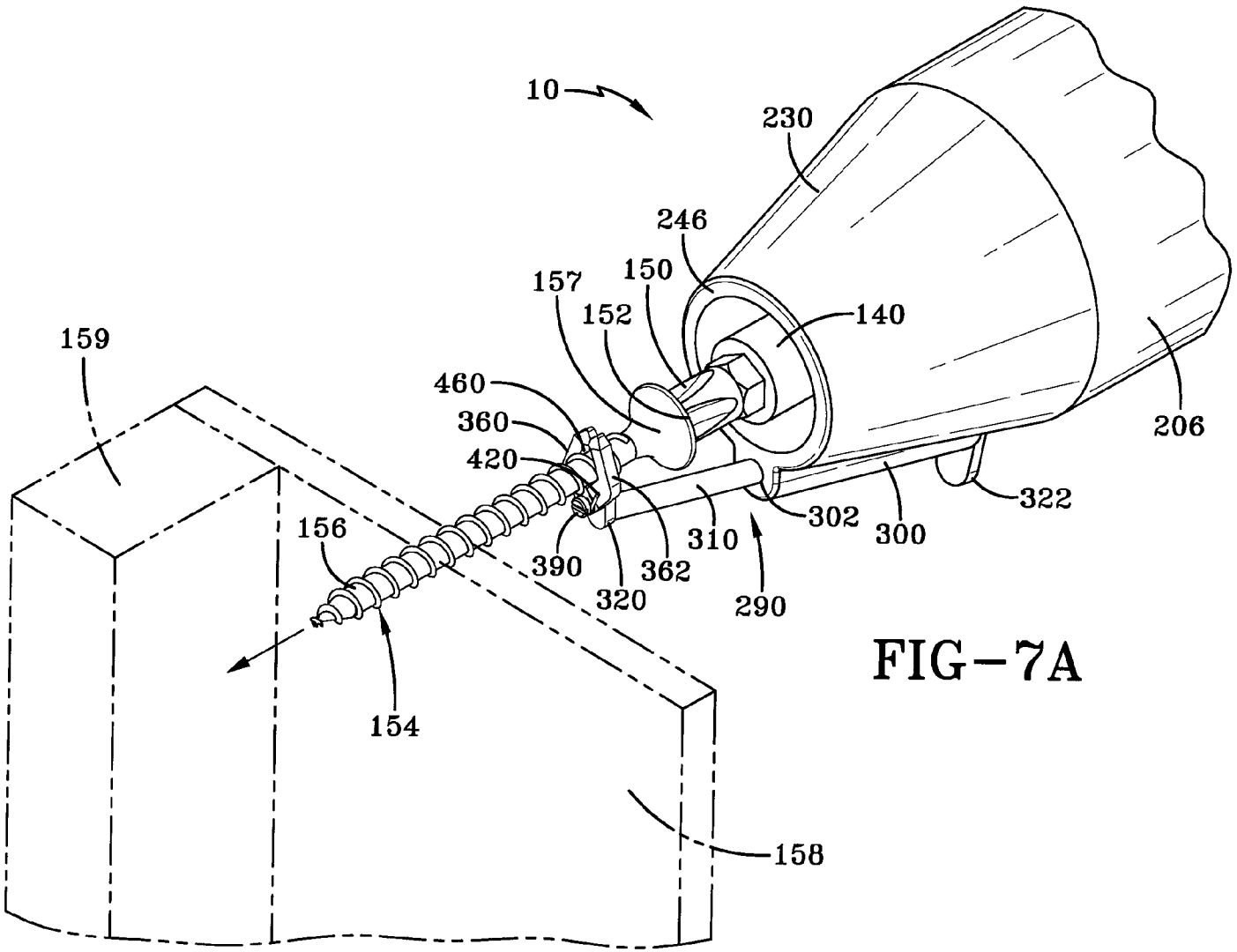
FIG. 7A is a perspective view of the fastener extraction device when a screw is received within a guide aperture defined by the closed lock arms as the screw is being driven into the surface in accordance with the concepts of the present invention.
Figure 7B:
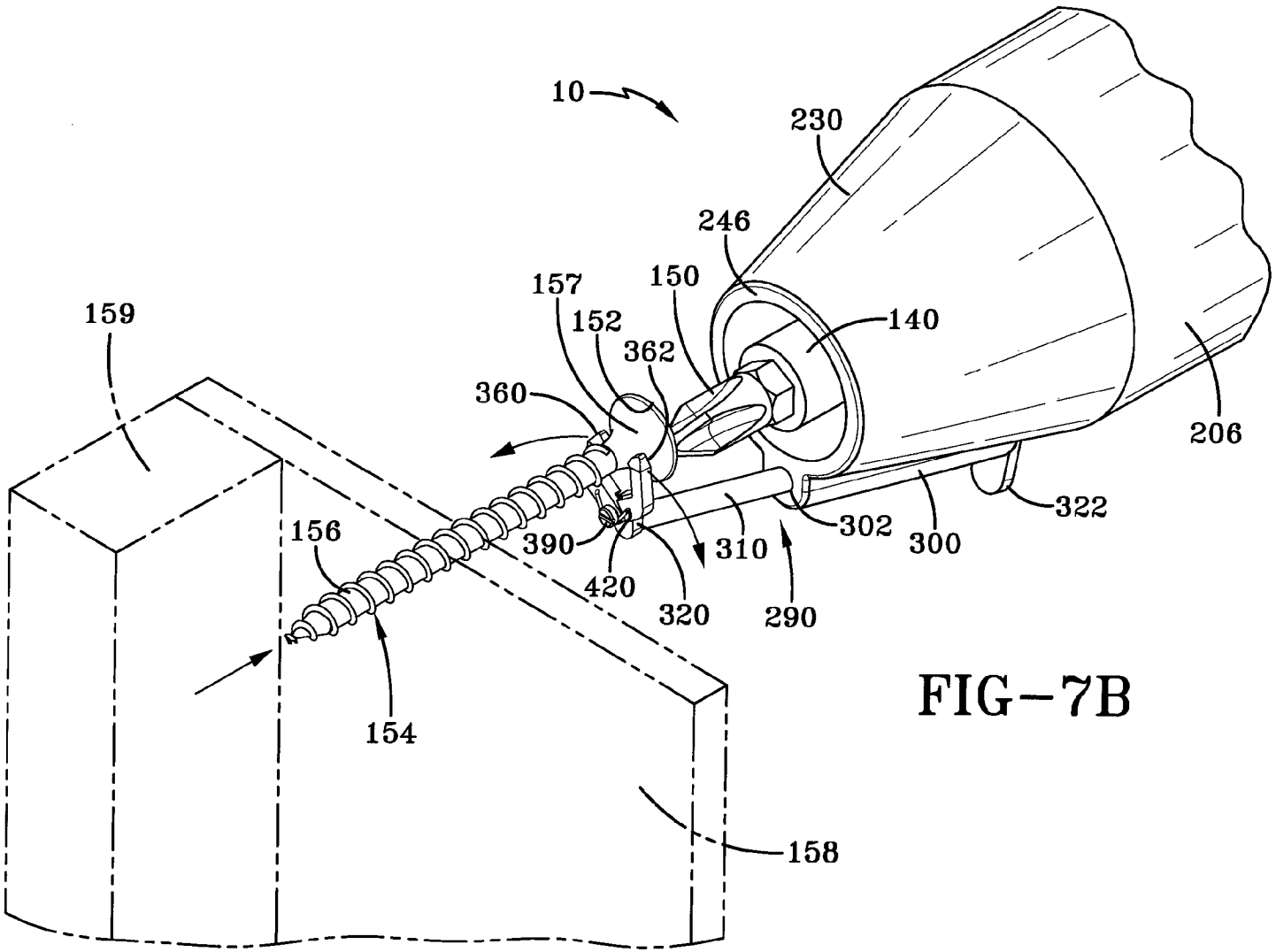
FIG. 7B is a perspective view of the fastener extraction device showing the expansion of the lock arms as the head of the screw is urged through the guide aperture when the screw is being fully installed into a surface in accordance with the concepts of the present invention.

Thus, during operation of the device 10 to install a screw 154, the retaining guide assembly 290 that includes the extraction arms 360,362 is extended to be distal to the body 200 by pushing the engagement section 322. Once extended, the shank 156 of the screw 154 is inserted through the guide aperture 460, so that the closed extraction arms 360,362 are behind the screw head 152, while the bit 150 is inserted into the head 152 of the screw 154, as shown in FIG. 7A. Next, the user of the power driver 10 actuates the trigger 160 so that the chuck 130 and the bit 150 begin to rotate, so as to drive the screw 154 into the surface 158 and the mounting stud 159. As the threaded shank 156 of the screw 154 passes through the surface 158 and into the mounting stud 159, the head 152 of the screw 154 is urged against the normally-closed extraction arms 360,362. Thus, as force is applied to the extraction arms 360,362, due to their being compressed between the surface 158/mounting stud 159 and the screw head 152, the closing force of the wire spring 420 is overcome to thereby open the extraction arms 360,362, as shown in FIG. 7B. This allows the head 152 of the screw 154 to pass through the guide aperture 460 defined by the lock arms 360,362, so that the screw 154 can be driven into the surface 158 and threadably anchored into the stud 159, such that the head 152 of the screw 154 is countersunk in the surface 158. That is, only when the screw 154 is properly installed, whereby the screw 154 is threadably received by the surface 158 and threadably anchored in the mounting stud 159, will the extraction arms 360,362 open to allow the screw head 152 to pass through the guide aperture 460 so that the screw 154 can be fully installed. Alternatively, screws 154 that are driven through the surface 158 but are not threadably anchored in the mounting stud 159 there behind are improperly installed, and as such, the extraction arms 360,362 will not open to allow the screw head 152 to pass through the guide aperture 460.

In the event that a screw 154 is improperly installed such that the screw 154 passes through the surface 158 but is not threadably anchored in the mounting stud 159, the user can pull on the driver tool 100 away from the surface 158 while the screw 154 is still within the guide aperture 460. As a result, the closed extraction arms 360,362 apply a force behind the head 152 of the screw 154, allowing it to be extracted from the surface 158.

Figure 8:
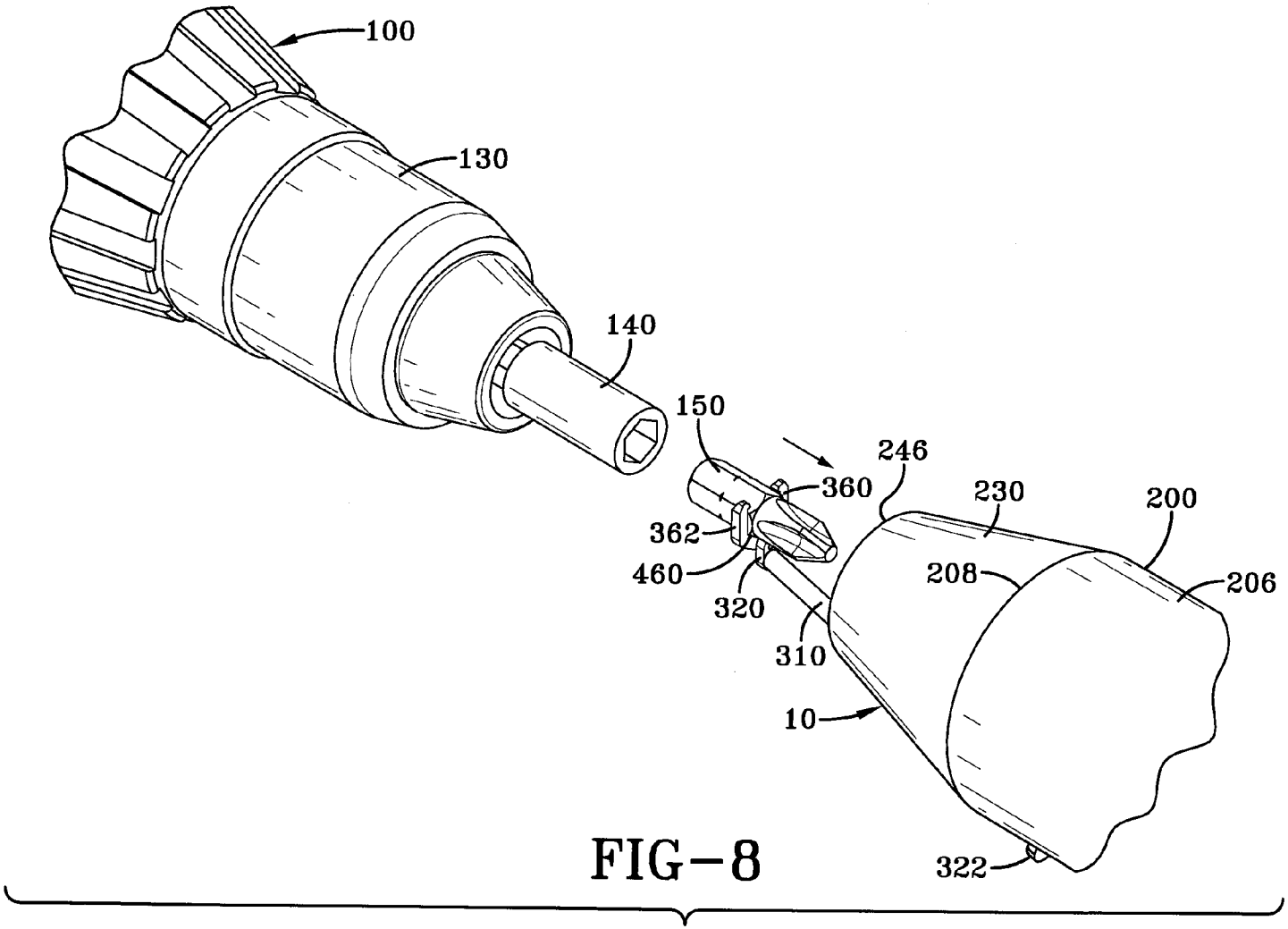
FIG. 8 is a perspective view of the fastener extraction device when removed from the power driver tool, whereby the lock arms are used to engage and remove a bit installed in the power driver in accordance with the concepts of the present invention.
Figure 9:
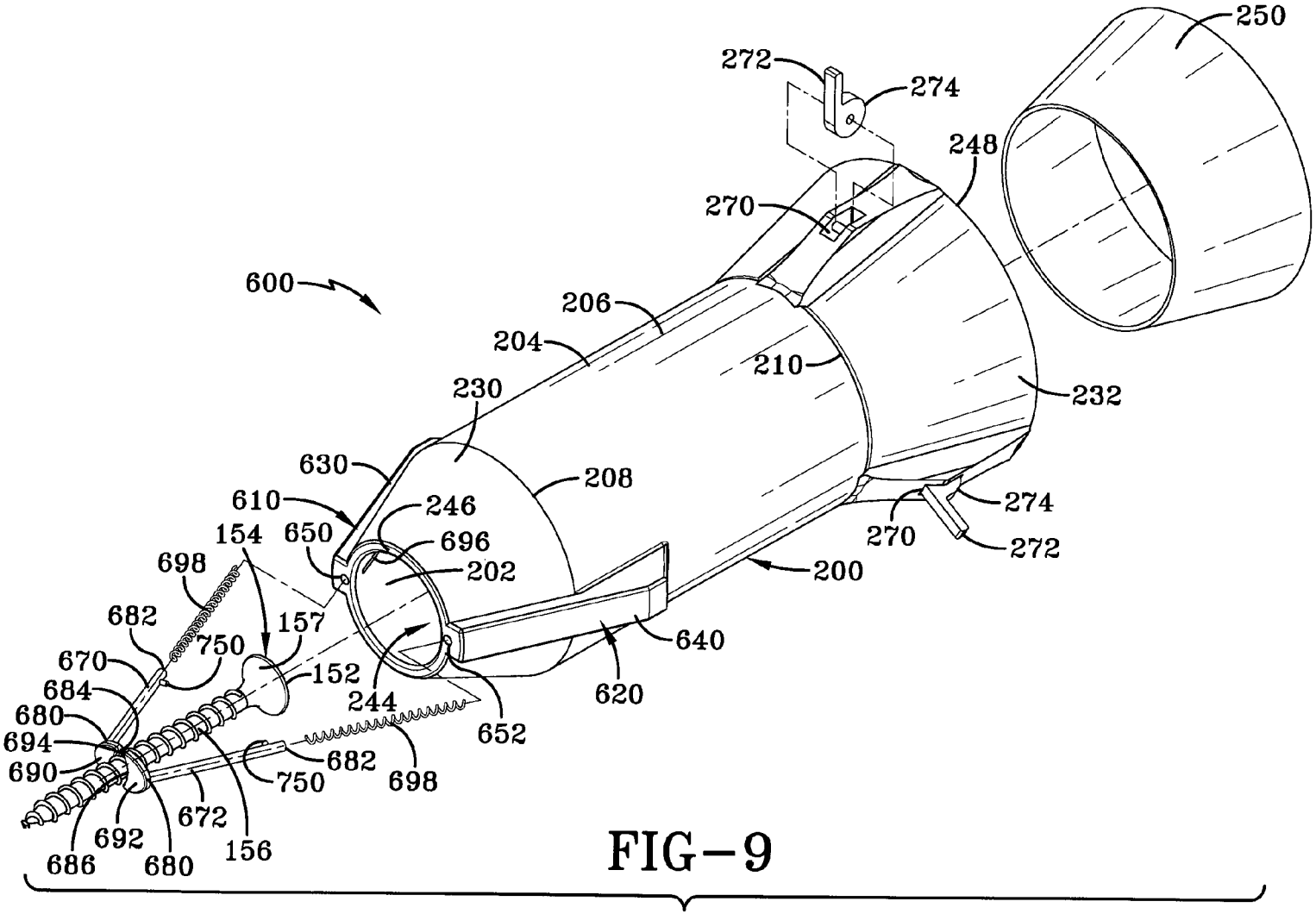
FIG. 9 is an exploded view of an alternative embodiment of the fastener extraction device utilizing spring-biased extraction heads in accordance with the concepts of the present invention.
Figure 10:
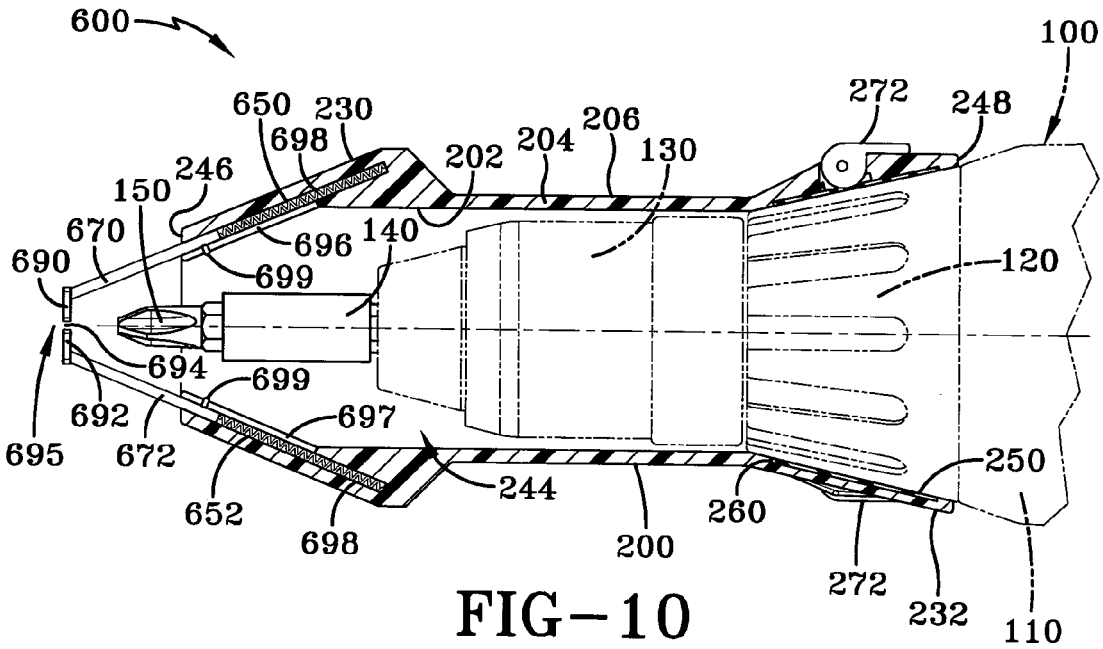
FIG. 10 is a cross-sectional view of the alternative fastener extraction device of FIG. 9 showing the extraction heads in an extended position in accordance with the concepts of the present invention.
Figure 11:
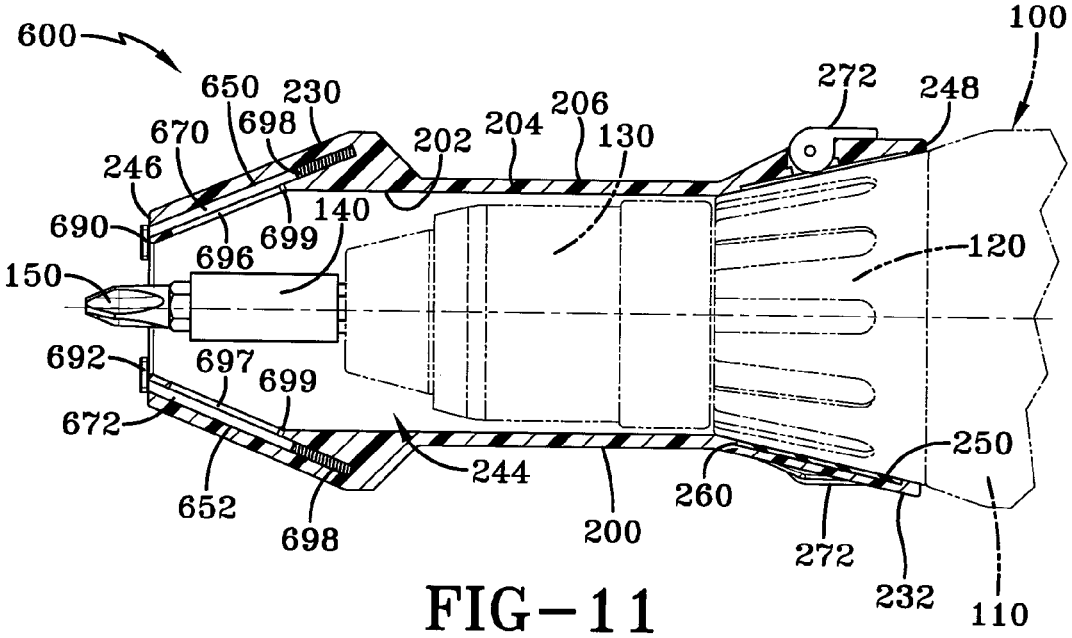
FIG. 11 is a cross-sectional view of the alternative fastener extraction device of FIG. 9 showing the extraction heads in a retracted position in accordance with the concepts of the present invention.
Figure 12:
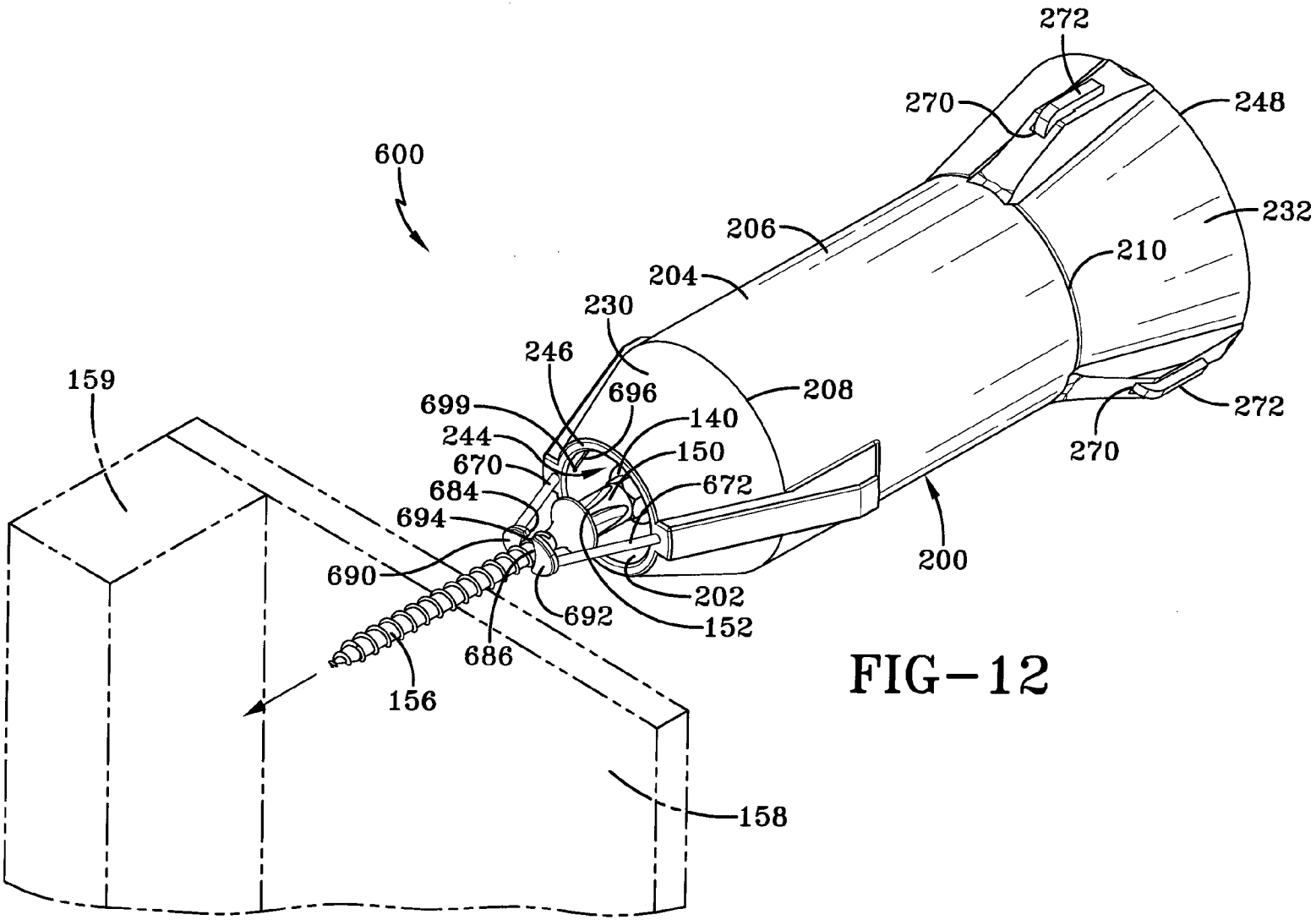
FIG. 12 is a perspective view of the alternative fastener extraction device of FIG. 9 showing the extraction heads in an extended position as a screw is being driven into the surface in accordance with the concepts of the present invention.
Figure 13:
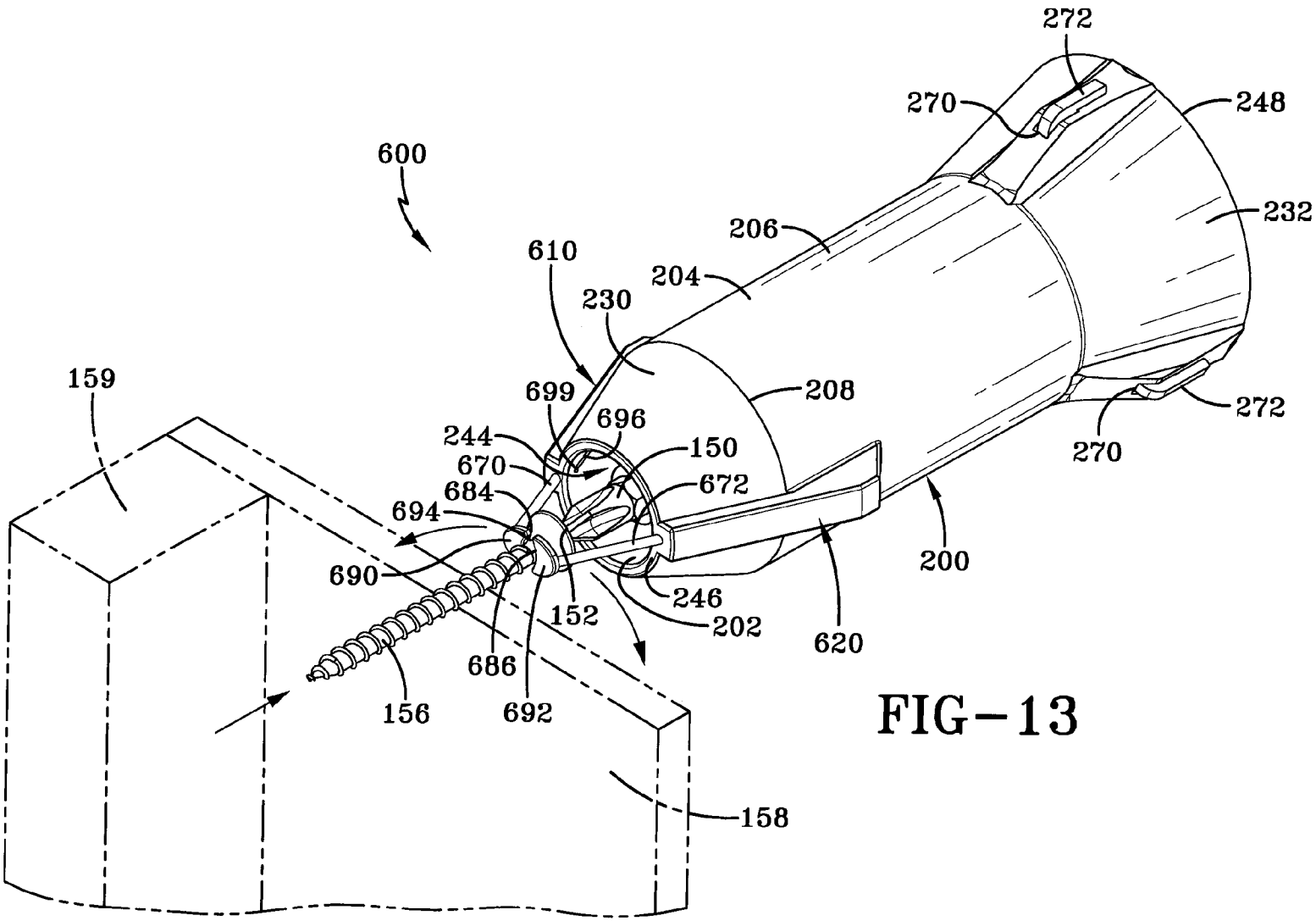
FIG. 13 is a perspective view of the alternative fastener extraction device of FIG. 9 showing the extraction heads expanding as the head of the screw is urged through a guide aperture when the screw is being fully installed into a surface in accordance with the concepts of the present invention.
Figure 14:
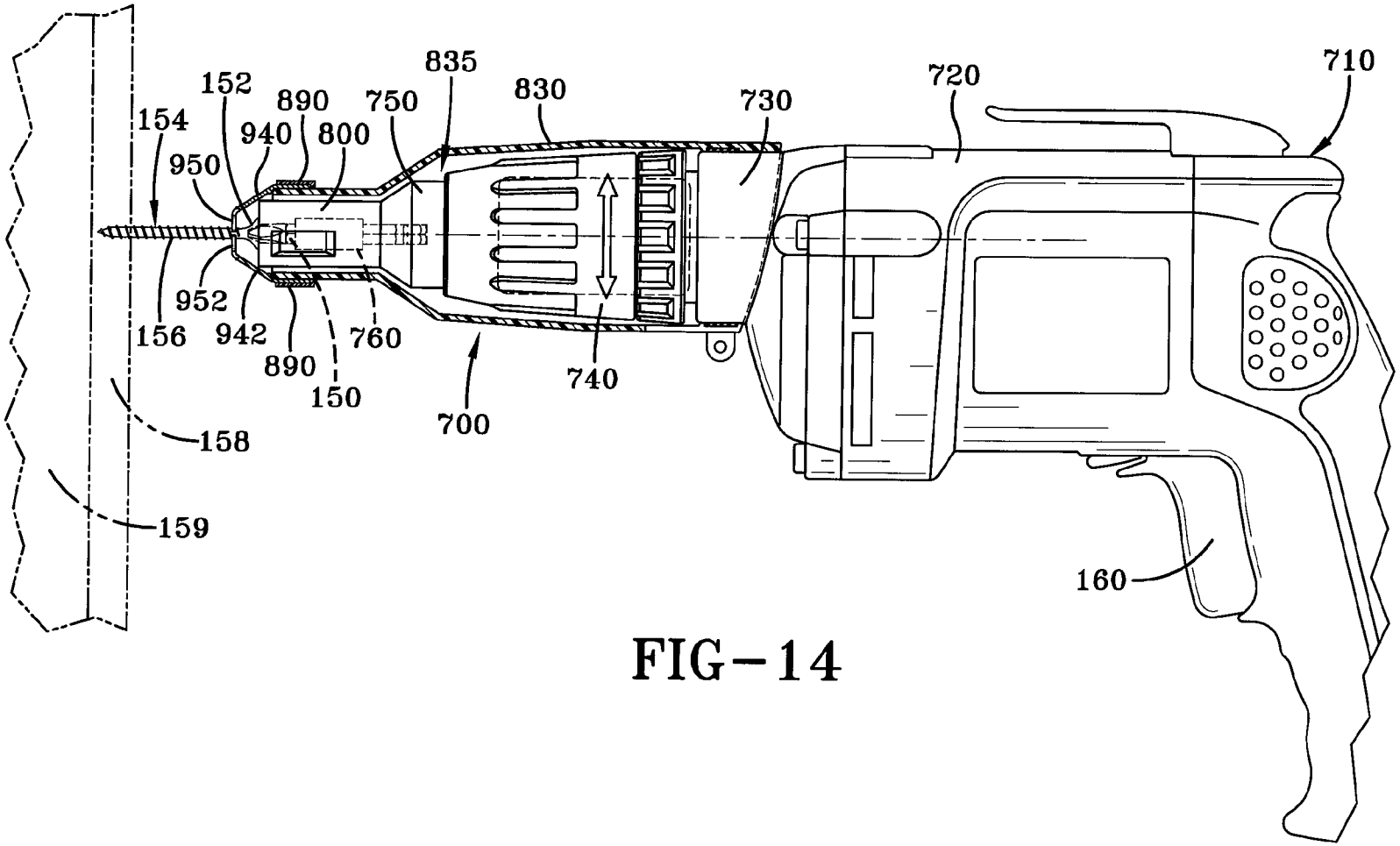
FIG. 14 is a cross-sectional view of another alternative fastener extraction device in accordance with the concepts of the present invention.
Figure 15:
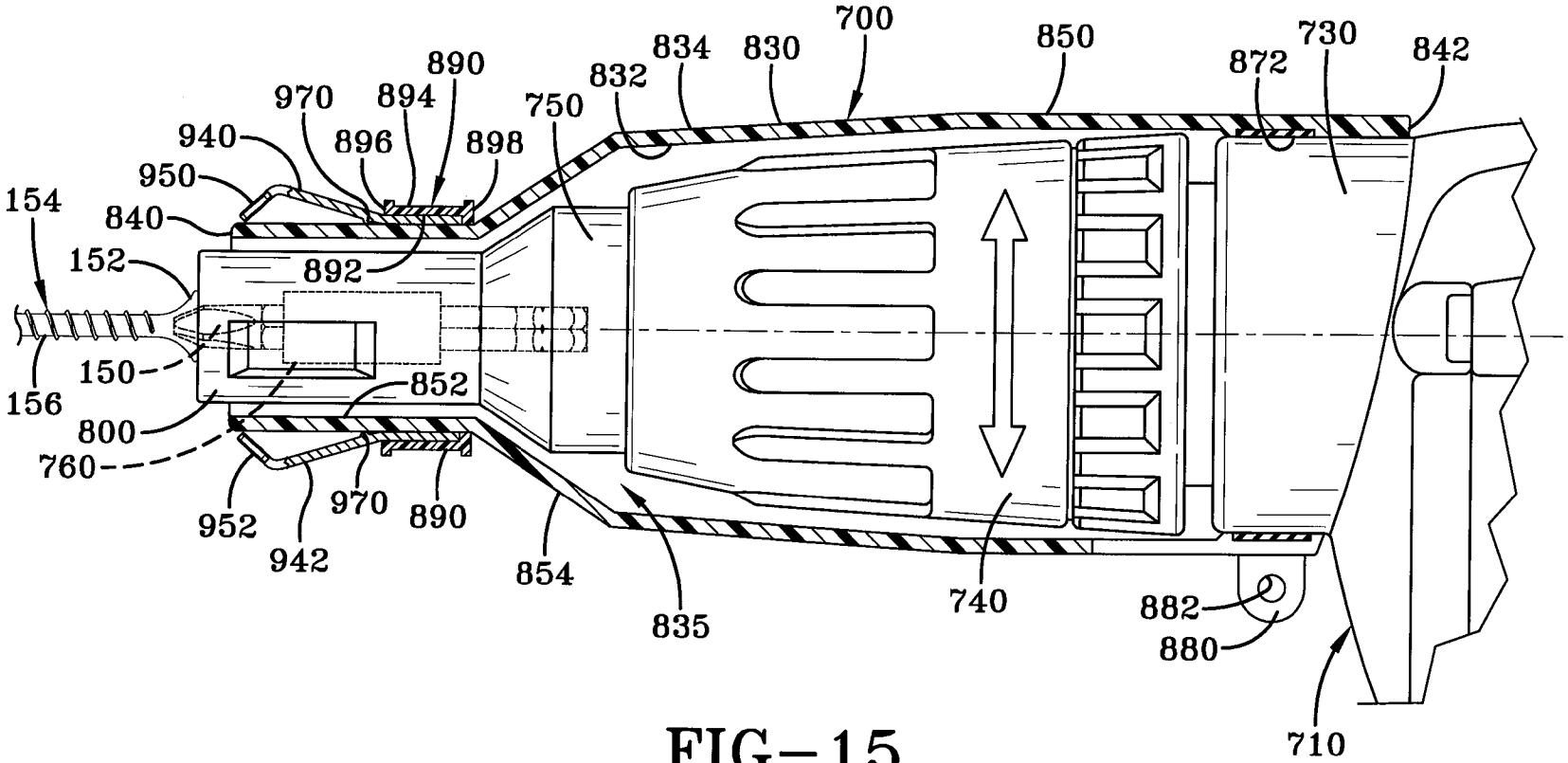
FIG. 15 is a cross-sectional view of the alternative fastener extraction device of FIG. 14 in accordance with the concepts of the present invention.
Figure 16:
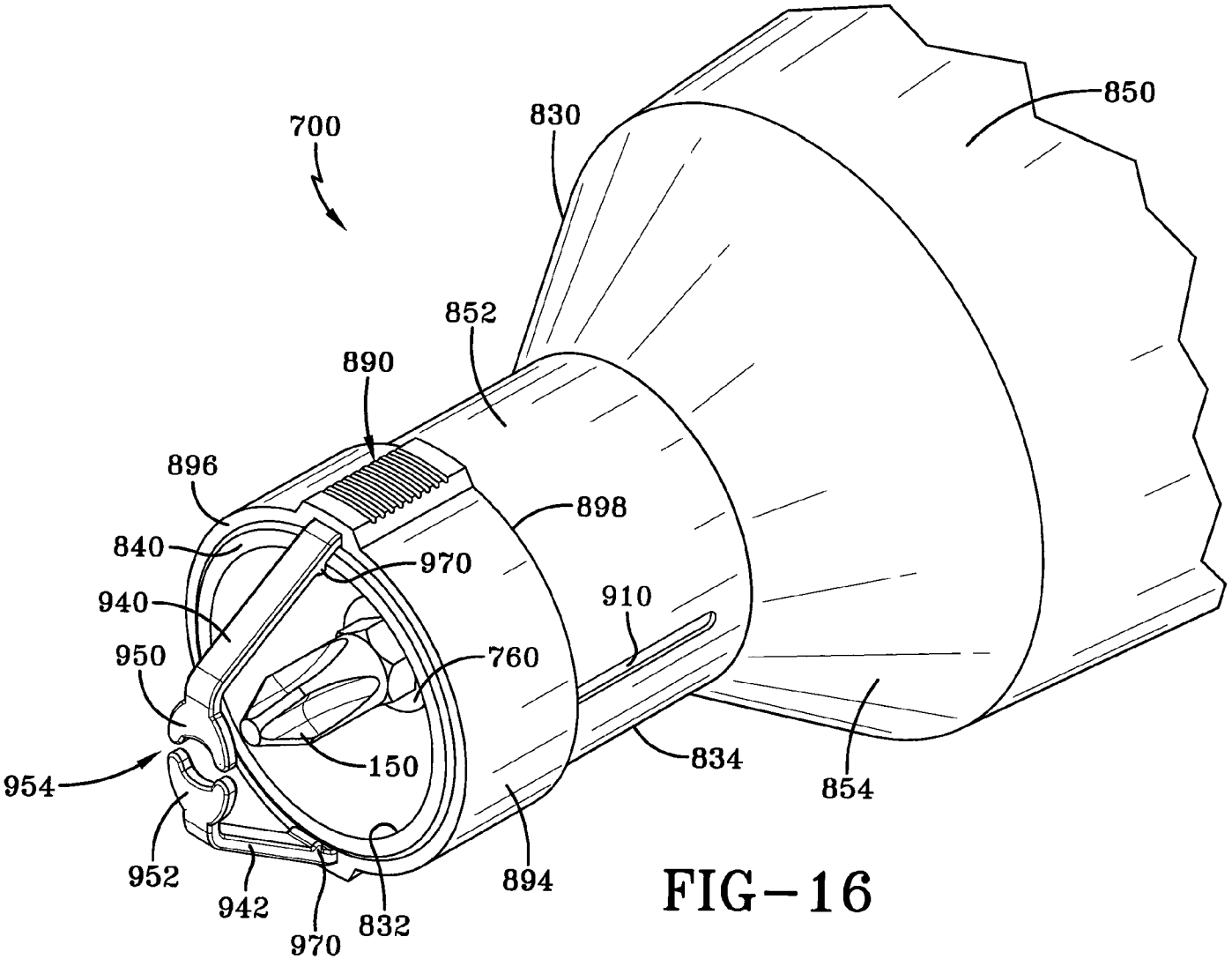
FIG. 16 is a perspective view of a pair of extraction guides utilized by the alternative fastener extraction device of FIG. 14 in accordance with the concepts of the present invention.
Figure 17:
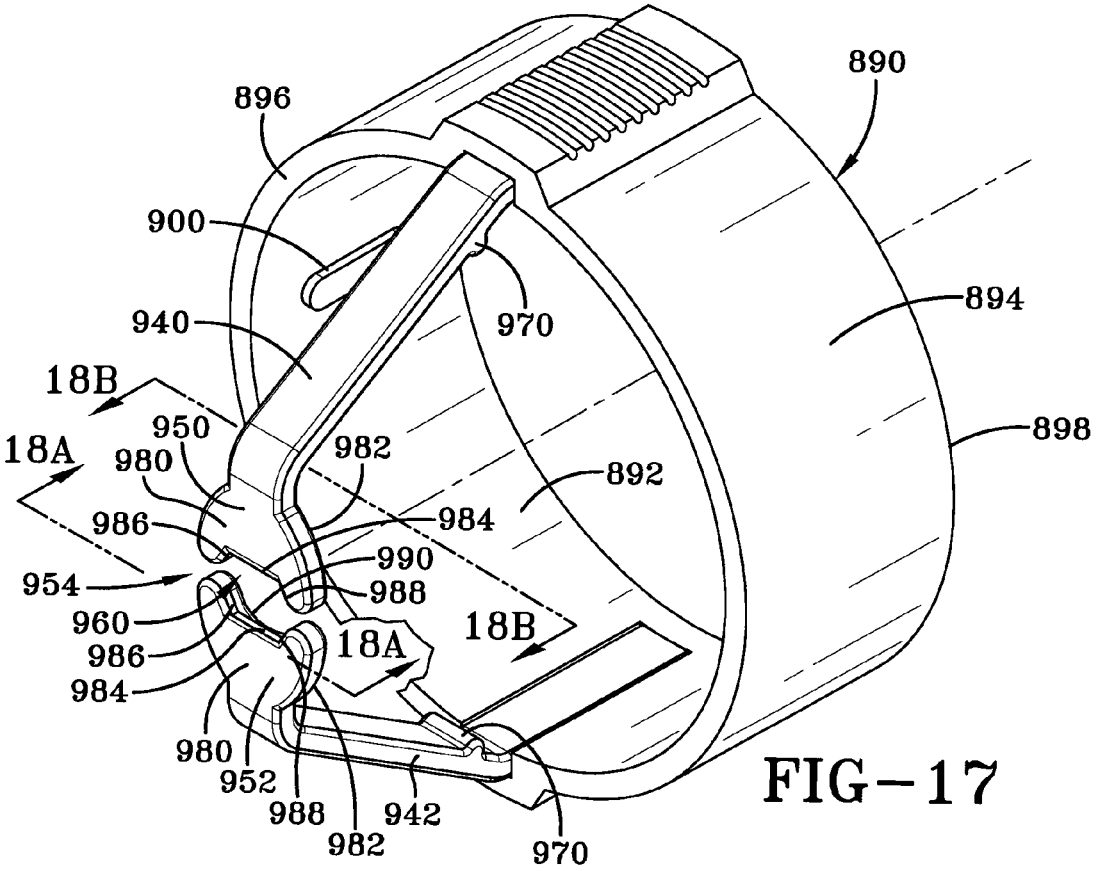
FIG. 17 is a perspective view of an engagement ring provided by the alternative fastener extraction device of FIG. 14 in accordance with the concepts of the present invention.

In addition, in some circumstances, the bit 150 may get stuck in the attachment shank 140 of the power driver 100. As a result, the extraction device 10 may be removed from the power driver 100, as shown in FIG. 8, while the shaft is in the extended position, such that the extraction arms 360,362 are distal to the body 200 of the device 10. Once extended, the bit 150 is inserted within the guide aperture 460 so that the extraction arms 360,362 expand, so as to grip the bit 150. Once the extraction arms 360,362 grip the bit 150, the user is able to pull on the body 200 of the device 10 to generate leverage on the bit 150 to loosen and pull it out of the attachment shank 140.

In an alternative embodiment of the fastener extraction device, generally referred to by the numeral 600, as shown in FIGS. 9-13 of the drawings, the extraction device 600 is structurally equivalent to the extraction device 10; however, in lieu of the guide assembly 290, the extraction device 600 utilizes a pair of opposed extension assemblies 610 and 620 that are disposed on either side of the front conical section 230.

The extension assemblies 610,620 include respective guide housings 630 and 640 that have sliding bores 650 and 652 disposed therein, which are dimensioned to receive respective extension arms 670 and 672, each of which have opposed ends 680 and 682. The extension arms 670 and 672 include respective extraction heads 690,692 that are disposed at end 680. Moreover, due to the position of the extension assemblies 610,620 on the front conical section 230, the arms 670,672 extend therefrom at an angle to an apex 695 when they are in their extended position, which is discussed in detail below. The extraction heads 690,692 respectively include curved edges 684,686, such that when the extraction heads 690,692 are aligned, the curved edges 684 and 686 oppose each other to form a guide aperture 694 that is dimensioned to receive the shank 156 of the screw 154, while preventing the head 152 of the screw 154 from passing therethrough. As such, the guide aperture 694 is configured so as to be in substantial axial alignment with the bit 150.

Continuing, opposed slots 696 and 697 are disposed on the inner surface 202 of the body 200, which are integral with the sliding bores 650 and 652. The extension arms 670 and 672 are biased to their extended position by springs 698 that are disposed within each of the sliding bores 650,652. The extension arms 670,672 also include a guide tab 699 that extends into the respective slots 696,697 to retain the extension arms within the sliding bores 650,652 during operation.

Thus, to place the device 600 into operation, the cam surface 274 of the attachment tabs 272 is placed in an unlocked position, and the chuck 130 and collar 120 of the power driver 100 are inserted within the cavity 244 of the extraction device 600, such that the compression sleeve 250 is disposed upon and about the collar 120 of the driver 100. Once in position, the cam surfaces 274 are rotated to their locked position by rotating the attachment tabs 272, thereby retaining the extraction device 600 to the power driver 100.

Once the extraction device 600 is attached to the power driver 100, the shank 156 of the screw 154 is inserted into the guide aperture 694, and the bit 150 is inserted into the head 152 of the screw 154. As the screw 154 is driven into the surface 158 and mounting stud 159, such as that provided by an installed drywall panel, the extension arms 670 and 672 are urged into the guide housings 630,640 due to their contact with the surface 158.

In the event that the screw 154 is improperly installed, such that the screw 154 passes through the surface 158 but is not threadably anchored in the mounting stud 159, the user can pull backward on the power driver 100 to cause the guide aperture 694 to constrict around the shank 156 of the screw 154. In addition to constricting around the shank 156 of the screw 154, the extraction heads 690,692 also engage the back of the screw head 152 so that the screw 154 can be pulled on via the device 600. That is, an extraction force is imparted to the screw 154 via the curved edges 670,672 of the respective extraction heads 690,692 that are engaged behind the head 152 of the screw 154, thereby allowing the screw 154 to be extracted from the surface 158, as the driver tool 100 is pulled away from the surface 158.

In yet another embodiment shown in FIGS. 14-19, an extraction device, generally referred to by the numeral 700, is configured for use with a driver tool 710. The driver tool 710 has a body 720 that includes a neck 730 from which extends an adjustment collar 740. Extending from the adjustment collar 740 is a rotating chuck 750 that holds the attachment shank 760 that retains the removable bit 150. The adjustment collar 740 is operatively coupled to a sliding guide cylinder 800 that circumscribes the attachment shank 760 and the bit 150. The adjustment collar 740 controls the depth at which the screw 154 is embedded into the surface 158 when it is installed by limiting the distance the guide cylinder 800 is permitted to slide or travel. As such, as the screw 154 is driven into the surface 158, the guide cylinder 800 contacts the surface 158 and slides a distance until the depth that is set at the adjustment collar 740 is reached, causing the rotation of the chuck 750 to stop, resulting in the screw 154 being driven a predetermined distance into the surface 158.

The extraction device 700 includes an elongated, substantially cylindrical body 830 having an opposed inner surface 832 and an outer surface 834 that forms a cavity 835, which is bounded by front and rear edges 840 and 842. The body 830 is divided into a primary section 850 proximate to the rear edge 842 and a secondary section 852 proximate to the front edge 840 that are joined together by a tapered or conical section 854. The primary section 850 includes a pair of access apertures 860 and a slot 870 that extends from the rear edge 842 of the body 830. Specifically, the access apertures 860 allow access to the adjustment collar 740 of the power driver 710 during operation.

Continuing, extending from the outer surface 834 of the body 830 and disposed on either side of the slot 870 and proximate to the rear edge 842 is a fastening tab 880 that includes an aperture 882 therethrough. The fastening tabs 880 allow a screw or other suitable fastener to be received through the apertures 882 so as to compressively retain the extraction device 700 to the neck 730 of the driver 710, once the chuck 750 is received in the cavity 835 of the body 830. It should be appreciated that a compression ring 872 formed of compressible material, such as foam or rubber for example, may be disposed on the inner surface 832 of the primary section 850 to enhance the ability of the fastening tabs 880 to retain the device 700 to the driver 710.

A substantially cylindrical engagement ring 890 having an inner surface 892 and an outer surface 894, which are bounded by front and rear lateral edges 896 and 898, is configured to be disposed about the outer surface 834 of the secondary section 852. The inner surface 892 of the engagement ring 890 includes a pair of opposed guide tabs 900, shown in FIG. 17. The tabs 900 are dimensioned to be slideably received within a pair of guide channels 910 disposed in the secondary section 852, shown in FIGS. 16 and 19.

Extending from the front edge 896 of the engagement ring 890 is a pair of opposed arms 940 and 942. The arms 940,942 are elongated and are each terminated by respective extraction guides 950 and 952 that form a guide aperture 960, to be discussed in detail below, through which the shank 156 of the screw 154 is received when the head 152 is attached to the bit 150. Specifically, the arms 940 extend from the front edge 896 of the engagement ring 890 at an angle, such that the extraction guides 950,952 are disposed at an apex 954 when the engagement ring 890 is proximate to the front edge 840 of the body 830. Because of this angle, the arms 940 generate a compressive force against the front edge 840 of the body 830 as the engagement ring 890 is slid toward the tapered section 854 and away from the front edge 840 of the body 830 during the installation of the screw 154 as the guides 950,952 come in contact with the surface 158. However, once the screw 154 is installed and the guides 950,952 are no longer in contact with the surface 158, the compressive force imparted by the angled arms 940,942 against the front edge 840 of the body 830 causes the engagement ring 890 to slide toward the front edge 840 of the body 830. In another aspect, the arms 940,942 may include a tab 970 that is configured to engage the front edge 840 of the body 830 of the device 700. The tab 970 serves to increase the amount of force that is required to be applied to the engagement ring 890 in order to allow it to be slid toward the tapered section 854 when the device 700 is initially placed into use.

Figure 18A:
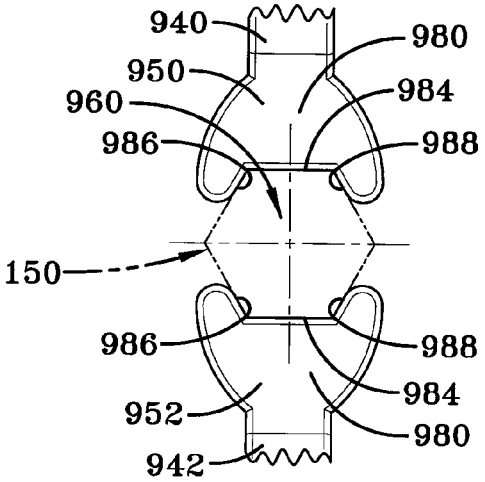
FIG. 18A is an elevational view of the extraction heads showing the extraction guides of the alternative fastener extraction device of FIG. 14 engaged with a bit in accordance with the concepts of the present invention.
Figure 18B:
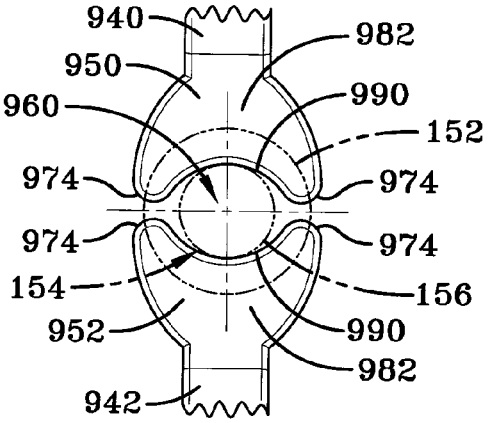
FIG. 18B is an elevational view of the extraction heads showing the extraction guides of the alternative fastener extraction device of FIG. 14 engaged with the screw in accordance with the concepts of the present invention.
Figure 19:
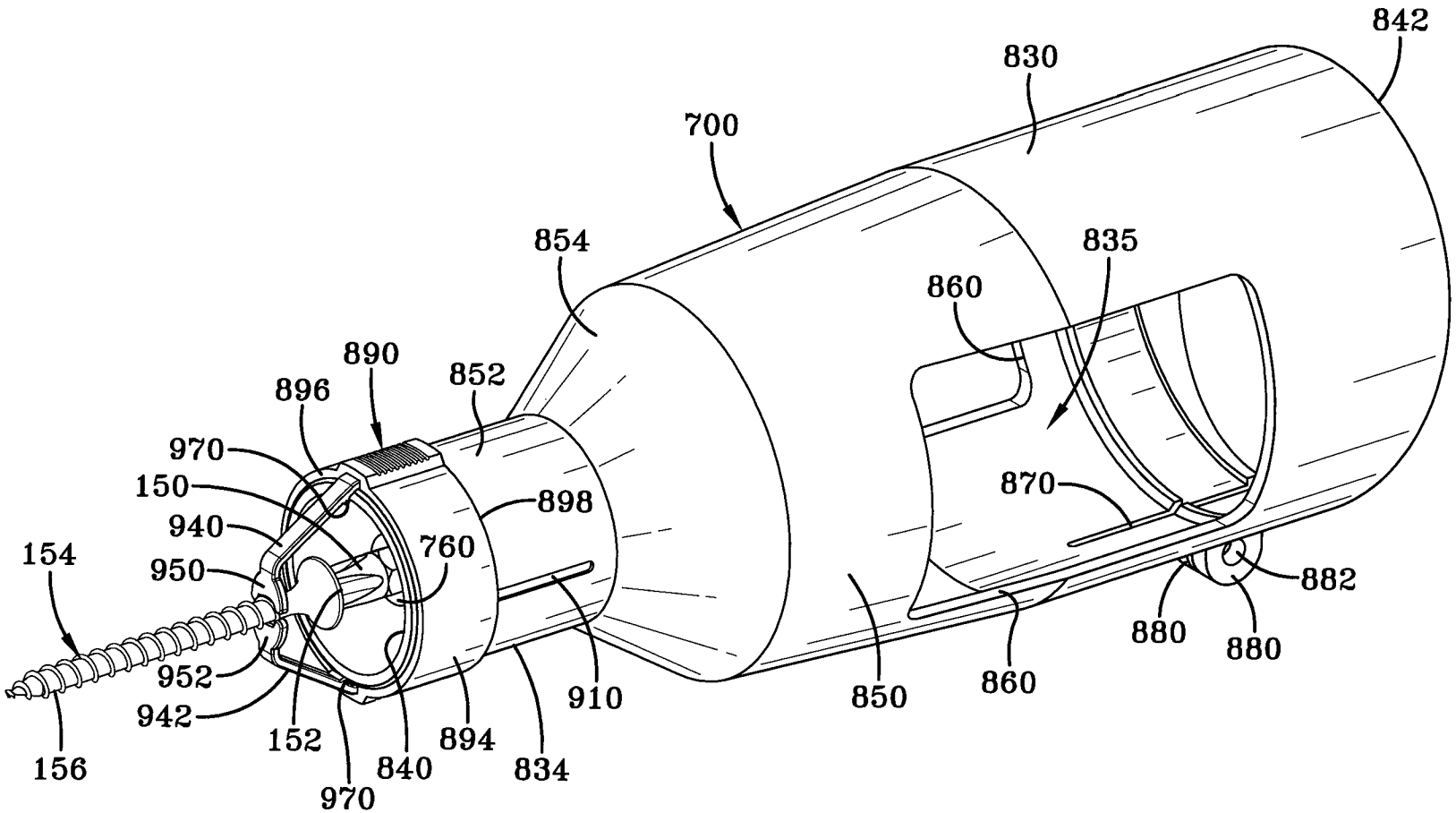
FIG. 19 is another perspective view of the alternative fastener extraction device of FIG. 14 in accordance with the concepts of the present invention.
Figure 20:
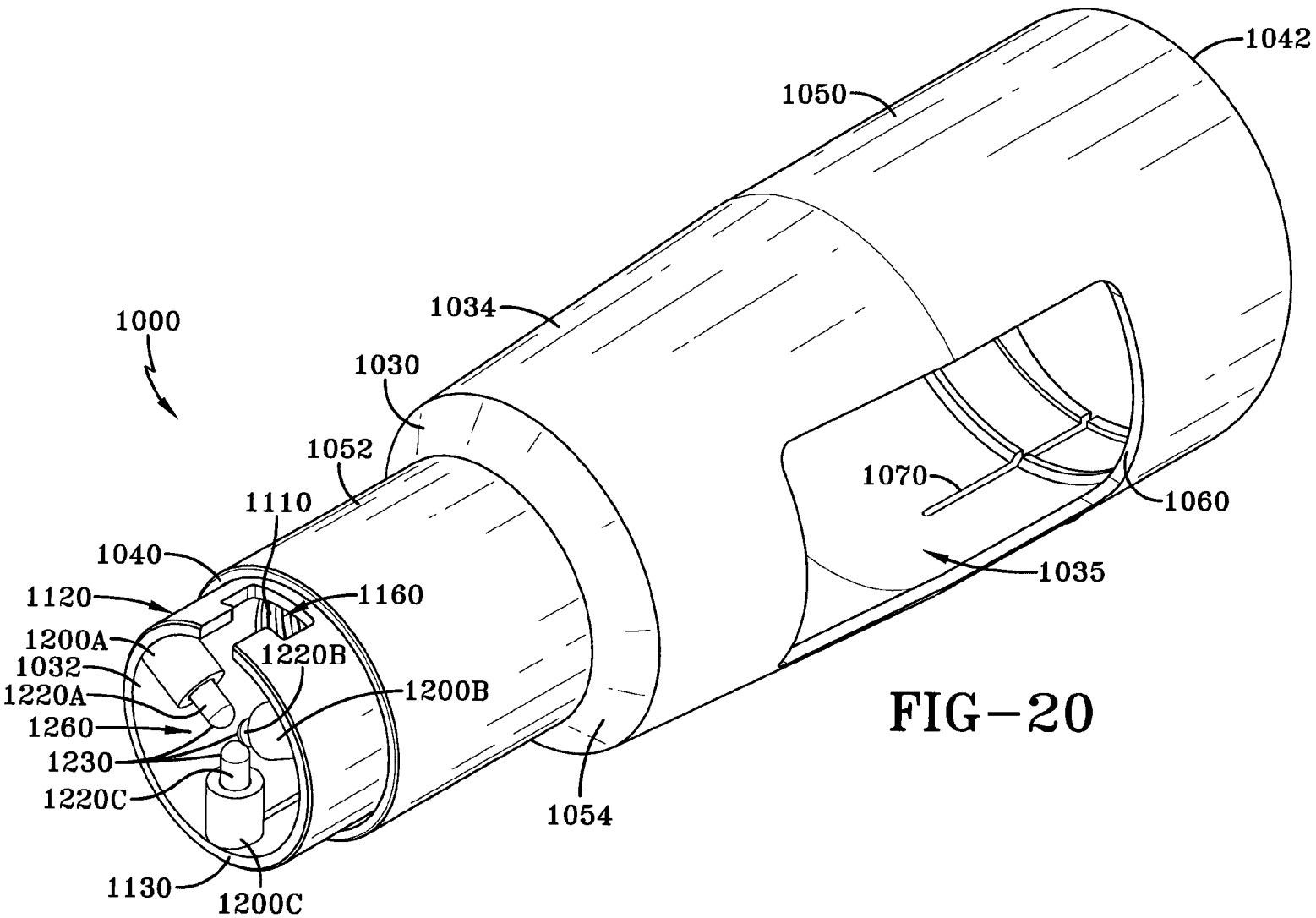
FIG. 20 is a perspective view of another embodiment of the fastener extraction device in accordance with the concepts of the present invention.
Figure 21:
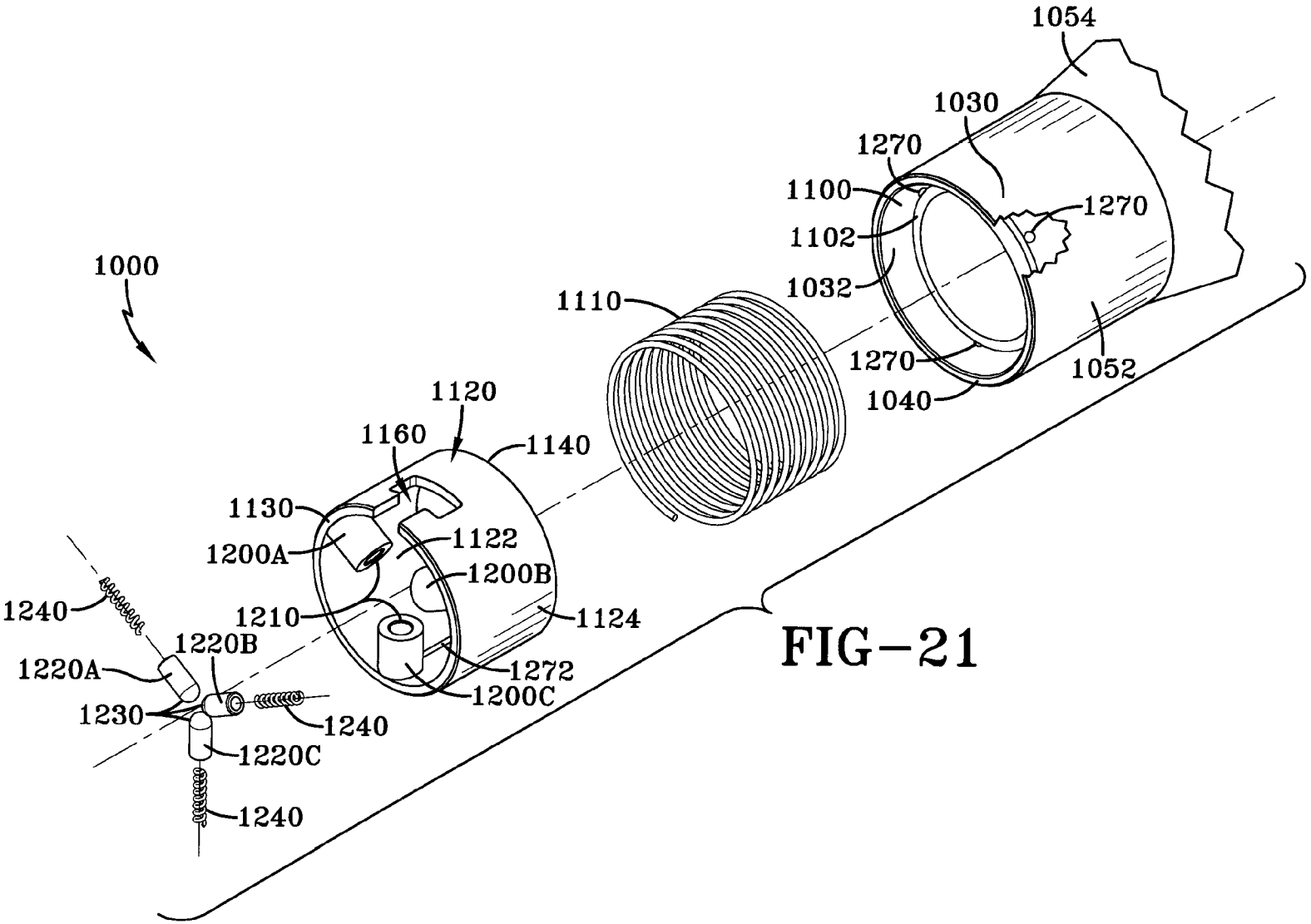
FIG. 21 is an exploded view of the fastener extraction device shown in FIG. 20 in accordance with the concepts of the present invention.

Continuing, as shown in FIGS. 18A-B, the extraction guides 950,952 have an outer surface 980 and opposed inner surface 982. The outer surface 980 of both extraction guides 950,952, as shown in FIG. 18A, includes a main surface 984, which is terminated at each end by angled surfaces 986 and 988 that extend therefrom. In particular, the main surface 984 and angled surfaces 986,988 of the extraction guides 950,952 define a substantially hexagonal-shaped guide aperture 960, which facilitates the extraction of the bit 150, as discussed herein, which also has a substantially hexagonal shape. However, it should be appreciated that the extraction guides 950, 952 may be configured to take on any desired shape to accommodate bits 150 with corresponding cross-sections. The inner surface 982 of both extraction guides 950,952, as shown in FIG. 18B, includes an opposed curved surface 990 that defines the guide aperture 960 and is configured to allow the curved neck 157 of the screw head 154 to slide there over, so as to facilitate the passage of the screw head 152 through guide aperture 960 during the screw 154 installation process. Thus, the guide aperture 960 formed by the extraction guides 950,952 is defined by two cross-sectional shapes, whereby a substantially hexagonal guide aperture 960 is formed on the outer surface 980 of the extraction guides 950,952, and a substantially curved shape is formed on the inner surface 982 of the extraction guides 950,952.

Thus, during operation of the device 700 to install a screw 154 into the surface 158 and mounting stud 159, the head 152 of the screw 154 is attached to the bit 150, while the shank 156 of the screw 154 is disposed through the guide aperture 960. The driver tool 710 is operated to drive the screw 154 into the surface 158 so that it is threadably anchored into the mounting stud 159, such that the extraction guides 950,952 engage the surface 158 as the engagement ring 890 slides away from the front edge 840 of the body 830. As a result, the arms 940,942 begin to slide over the front edge 840 of the body 830, thereby expanding the guide aperture 960 defined by the extraction guides 950,952. This allows the neck 157 of the screw 154 to engage the curved surface 990 of the extraction guides 950, 952, while allowing the head 152 of the screw 154 to pass through the guide aperture 960. As the screw head 152 passes through the guide aperture 960, the guide cylinder 800 engages the surface 158 and mounting stud 159 and allows the screw 154 to be driven into the surface 158 and the mounting stud 159 a distance that corresponds to the depth set at the adjustment collar 740.

To extract the screw 154 that has been improperly installed such that the screw 154 passes through the surface 158 but is not threadably anchored in the mounting stud 159, the user of the driver 710 can pull on the driver tool 710 while the screw 154 is still within the guide aperture 960, such that the engagement ring 890 is slid to be proximate to the front edge 840 of the extraction device 700. This allows the arms 940, 942 to close so that the guide aperture 960 is permitted to constrict around the shank 156 of the screw 154. Once the guide aperture 960 has constricted around the shank 156, the extraction guides 950,952 are engaged behind the head 152 of the screw 154, thus allowing the screw 154 to be extracted from the surface 158 by pulling on the driver 710 that is attached to the extraction device 700.

Alternatively, during extraction of the bit 150, the outer surface 980 of the extraction guides 950,952, which provides the main and angled surfaces 984-988, are configured so that they compressively engage a portion of the surfaces of the hex shape of the bit 150. This allows for sufficient gripping force to be applied to the bit 150 by the extraction guides 950,952 so that the bit 150 can be removed from the attachment shank 760 by pulling and/or rotating the engagement ring 890.

Another embodiment of the fastener extraction device is generally referred to by the numeral 1000 and is shown in FIGS. 20-26 of the drawings. The extraction device 1000, which is configured for use with the power driver 710 previously discussed, comprises an elongated, substantially cylindrical body 1030 having an opposed inner surface 1032 and an outer surface 1034 that forms a cavity 1035, which is bounded by front and rear edges 1040 and 1042. The body 1030 is divided into a primary section 1050 proximate to the rear edge 1042 and a secondary section 1052 proximate to the front edge 1040 that are joined together by a tapered or conical section 1054. The primary section 1050 includes a pair of access apertures 1060 and a slot 1070 that extends from the rear edge 1042 of the body 1030. Specifically, the access apertures 1060 allow access to the adjustment collar 740 of the power driver 710 when the device 710 is attached thereto and placed into operation.

Figure 23:
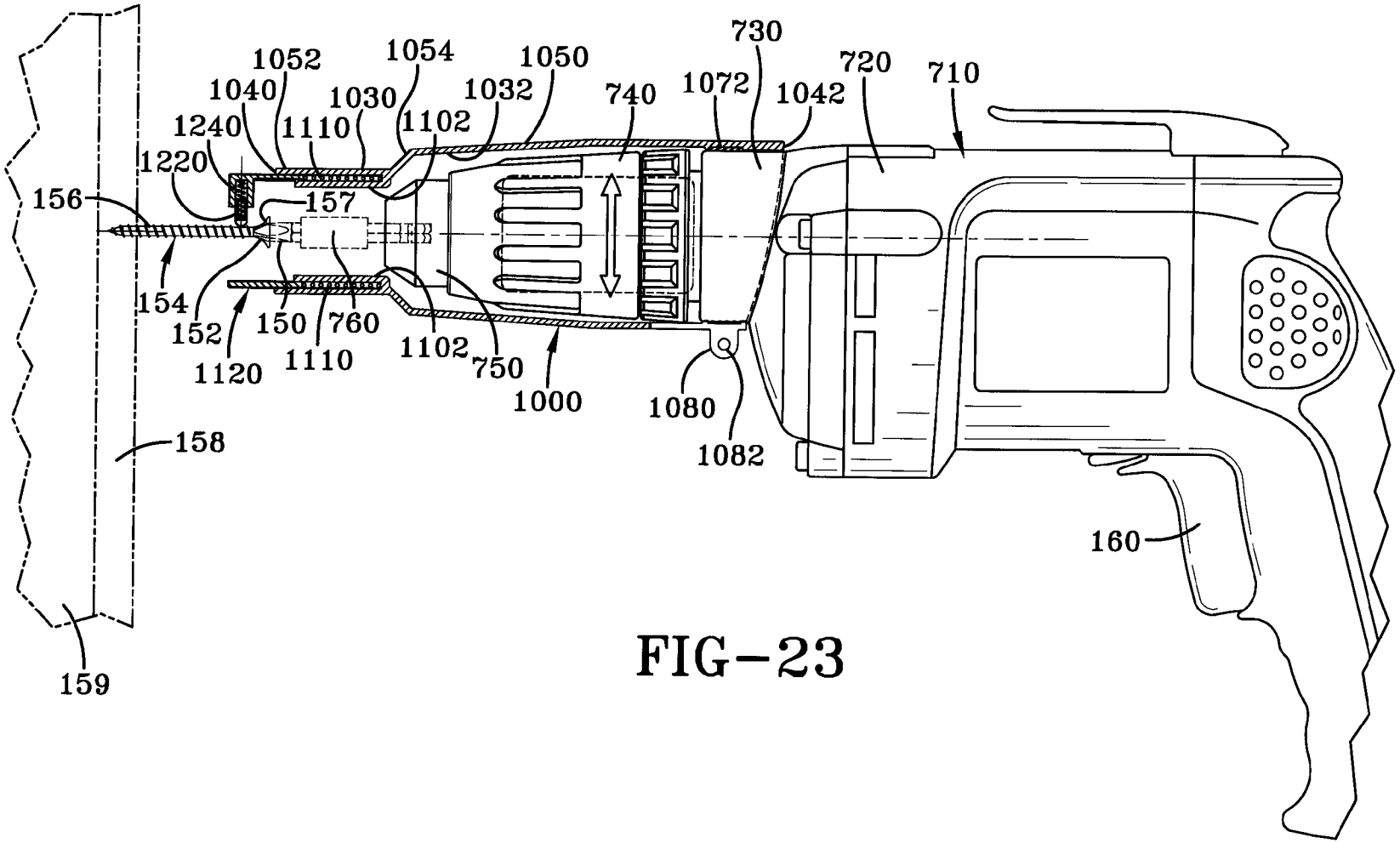
FIG. 23 is a cross-sectional view of the alternative fastener extraction device shown in FIG. 20 in accordance with the concepts of the present invention.

Extending from the outer surface 1034 of the body 1030 and disposed on either side of the slot 1070 and proximate to the rear edge 1042 is a fastening tab 1080 that includes an aperture 1082 therethrough, as shown in FIG. 23. The fastening tabs 1080 allow a screw or other suitable fastener to be received through the apertures 1082 so as to compressively retain the extraction device 1000 to the neck 730 of the driver 710 once the chuck 750 is received in the cavity 1035 of the body 1030 during the attachment of the device 1000 to the tool 710. It should be appreciated that a compression ring 1072 formed of compressible material, such as foam or rubber for example, may be disposed on the inner surface 1032 to retain the device 100 to the driver 710.

Figure 22:
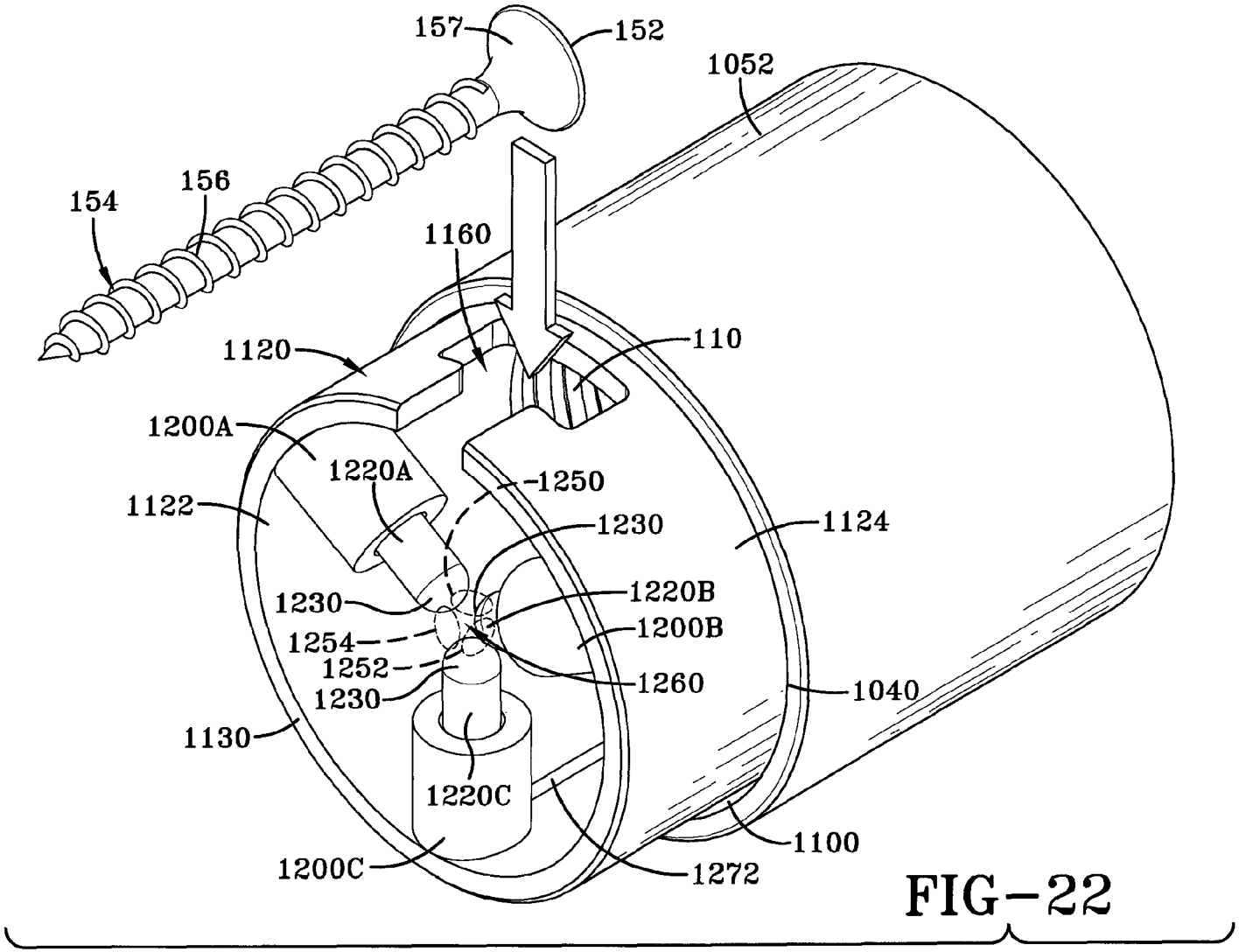
FIG. 22 is a perspective view of a support collar provided by the fastener extraction device of FIG. 20 in accordance with the concepts of the present invention.

Circumscribing the inner surface 1032 of the secondary section 1052 is an annular guide channel 1100 that is defined by the inner surface 1032 and a cylindrical inner wall 1102 that is substantially concentric with that of the secondary section 1052. Specifically, the guide channel 1100 is dimensioned to receive a coil spring 1110 and a support collar 1120. The support collar 1120 is substantially cylindrical and has opposed inner and outer surfaces 1122 and 1124 that are bounded by ends 1130 and 1140, such that end 1140 is proximate to the tapered section 1054, while end 1130 is proximate to the front edge 1040 of the body 1030. Disposed through the support collar 1120 is an alignment slot 1160 that is dimensioned to allow the head 152 and shank 156 portions of the screw 154 to be slid therethrough. Extending from the inner surface of the support collar 1120 are retention sleeves 1200A, 1200B, and 1200C that each include an aperture 1210 there within. Inserted within each aperture 1210 is respective guide protrusions 1220A-C having a curved head 1230. The guide protrusions 1220A-C are each biased by a spring 1240, such that the curved heads 1230 of each of the guide protrusions 1220A-C are urged against each other at interfaces 1250, 1252, and 1254 to form a guide aperture 1260, as shown in FIG. 22. In addition, the curved heads 1230 of the protrusions 1220A and 1220B are in contact at interface 1250, which is substantially aligned with the alignment slot 1160 to facilitate the loading of screw 154 for attachment to the bit 150 in a manner to be discussed below.

Extending from the inner wall 1102 of device 1000 and into the guide channel 1100 are a plurality of retention tabs 1270. The retention tabs 1270 are configured to slide within corresponding slots 1272 disposed on the inner surface 1122 of the support collar 1120. As such, the tabs 1270 serve to retain the spring 1110 in operative engagement with the collar 1120, while also allowing the support collar 1120 to slide relative to the secondary section 1052 during operation of the device 1000.

Figure 24:
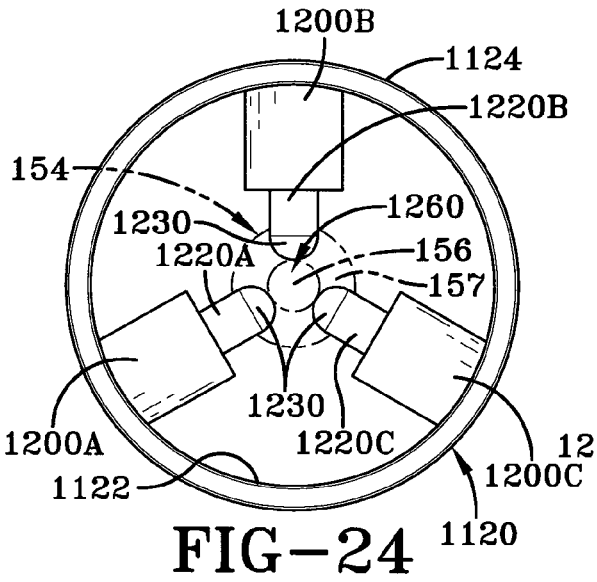
FIG. 24 is a plan view of the support collar provided by the fastener extraction device shown in FIG. 20, whereby a guide aperture is in contact with a screw in accordance with the concepts of the present invention.

During operation of the extraction device 1000, as shown in FIGS. 22-24, the screw 154 is placed so that the head 152 and shank 156 are disposed through the alignment slot 1160. Once the screw 154 is slid therethrough, it is then slid through the interface 1250 that is defined by the curved heads 1230 of the guide protrusions 1220A and 1220B, such that the shank 156 is retained within the guide aperture 1260. It should be appreciated that the curved heads 1230 of the guide protrusions 1220A-C may be configured to apply a suitable amount of force against the screw shank 156 to provide alignment support to the screw 154 as it is being inserted into the surface 158 and stud 159. Once the shank 156 is inserted into the guide aperture 1260, the bit 150 is inserted into the screw head 152 and is driven into the surface 158 and the stud 159. As the screw 154 is driven into the surface 158, the support collar 1120 contacts the surface 158, such that the collar 1120 retracts into the channel 1100, allowing the depth at which the screw 154 is driven to be adjusted by the adjustment collar 740 of the driver tool 710. As the screw 154 continues to be driven into the surface 158 and the stud 159, the curved neck 157 of the screw 154 engages each of the curved heads 1230 of the guide protrusions 1220A-C, thereby compressing the springs 1240, allowing the protrusions 1220A-C to retract into their associated retention sleeves 1200 so as to increase the size of the guide aperture 1260. The expansion of the guide aperture 1260 allows the head 152 of the screw 154 to then pass therethough, while the bit 150 imparted by the tool 710 continues to drive the screw 154 into the surface 158 and the stud 159.

In the event that the installer of the screw 154 improperly installs the screw 154, whereby the screw 154 engages only the surface 158 without contacting the stud 159, the installer may pull back on the driver tool 710 away from the surface 158, while the protrusions 1220A-C are in compressive engagement with the shank 156 of the screw 154. This causes the guide protrusions 1220A-C, which are disposed behind the head 152 of the screw 154, to apply an extraction force thereto, allowing the improperly installed screw 154 to be extracted from the surface 158.

Figure 25:
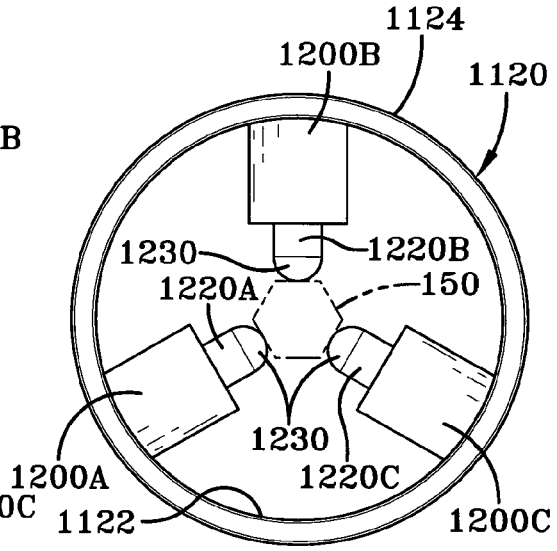
FIG. 25 is another plan view of the support collar provided by the fastener extraction device shown in FIG. 20, whereby the guide aperture is in contact with a bit in accordance with the concepts of the present invention.
Figure 26:
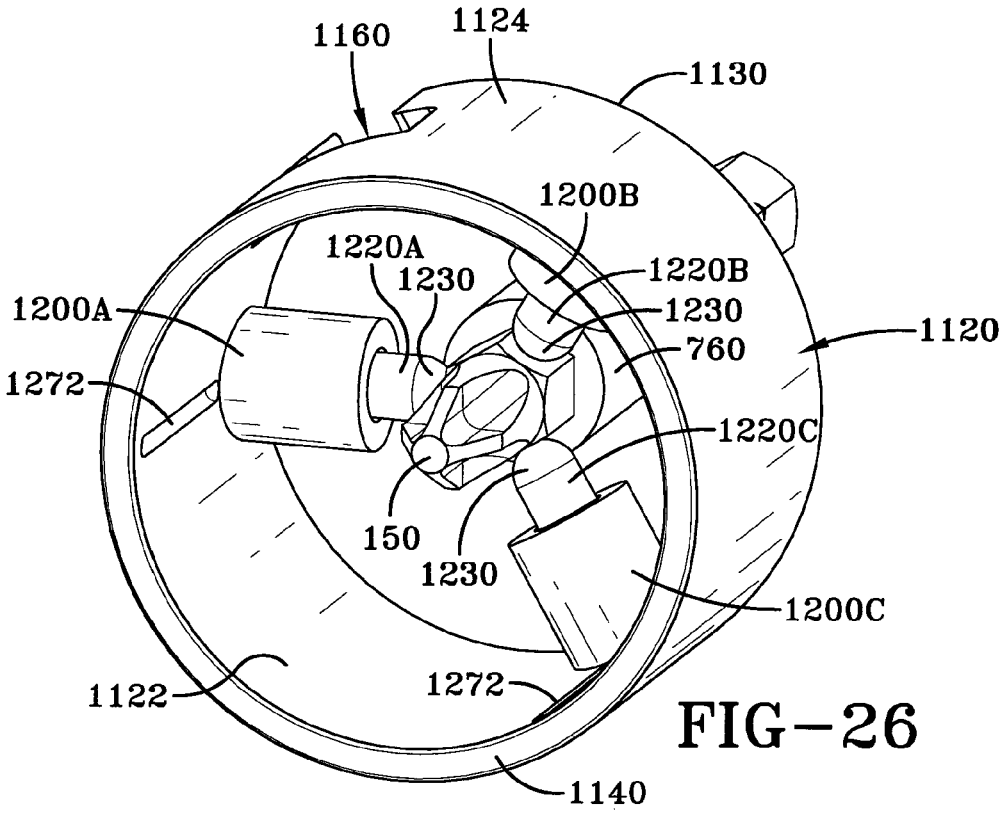
FIG. 26 is a perspective view of the support collar provided by the alternative fastener extraction device shown in FIG. 20, whereby the guide aperture is in receipt of the bit in accordance with the concepts of the present invention.

Alternatively, as shown in FIGS. 25 and 26, the support collar 1120 can be removed from the device 1000 and used to extract the bit 150 from the attachment shank 760. Specifically, the support collar 1120 is removed from the body 1030 and engaged with the bit 150, such that the curved heads 1230 of the guide protrusions 1220A-C compressively engage a portion of the surfaces of the hex shape of the bit 150. This allows for sufficient gripping force to be applied to the bit 150 by the guide protrusions 1220A-C so that the bit 150 can be removed from the attachment shank 760 by pulling and/or rotating the support collar 1120.

Figure 27:
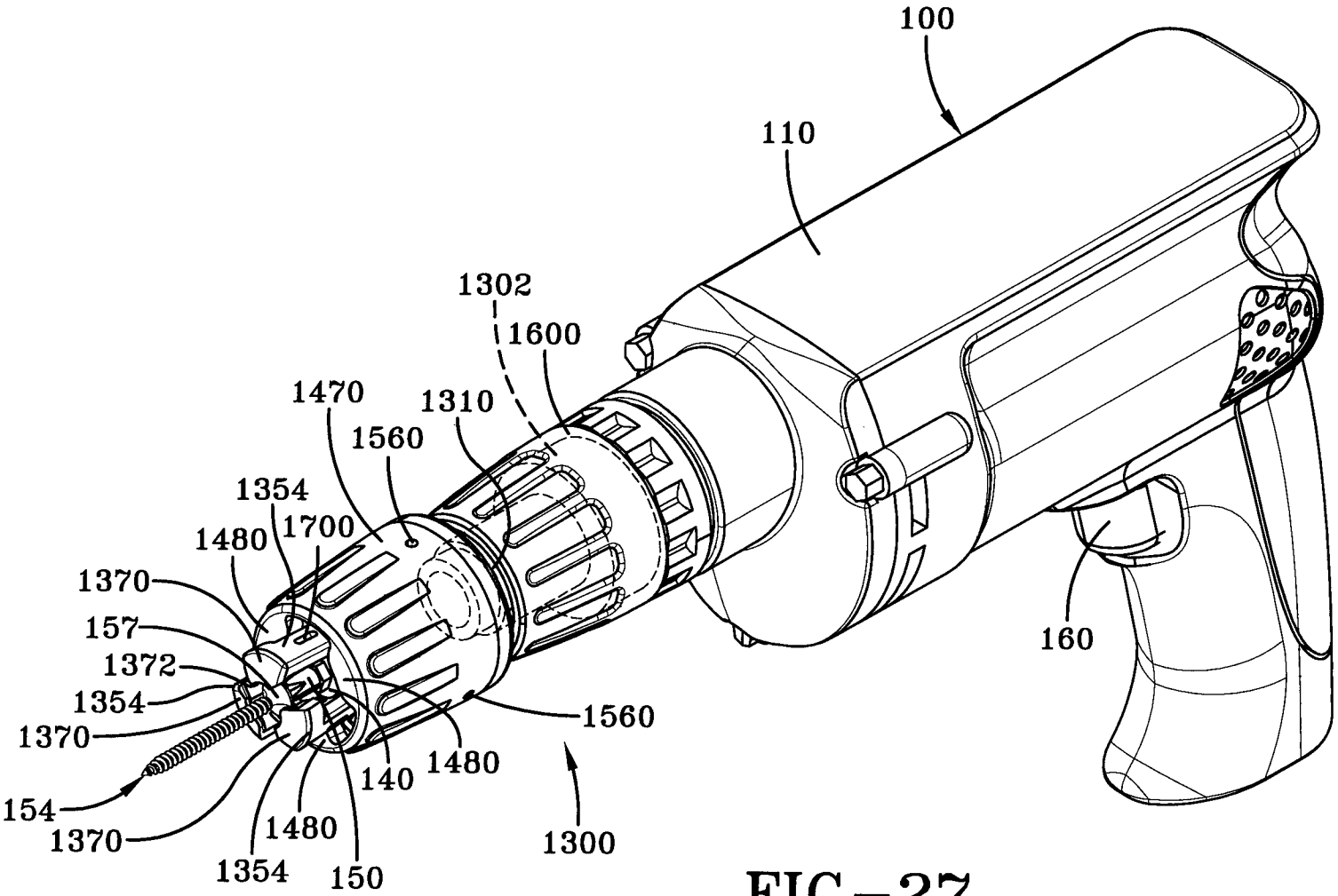
FIG. 27 is a perspective view of an alternative fastener extraction device attached to a driver tool in accordance with the concepts of the present invention.

In another aspect of the present invention, a fastener extraction device configured for use with the electrically-powered driver 100 is referred to by the numeral 1300, as shown in FIGS. 27-31 of the drawings. It should be appreciated that the driver 100, as shown in FIG. 27, includes a tapered or stepped neck section 1302, shown in FIGS. 27 and 29-31, which extends from the body 110 of the driver 100, while the neck section 1302 terminates at a drive aperture 1304 through which the rotating attachment shank 140 extends. It should be appreciated that the periphery of the drive aperture 1304 is circumscribed by an annular support surface 1306.

Figure 28:
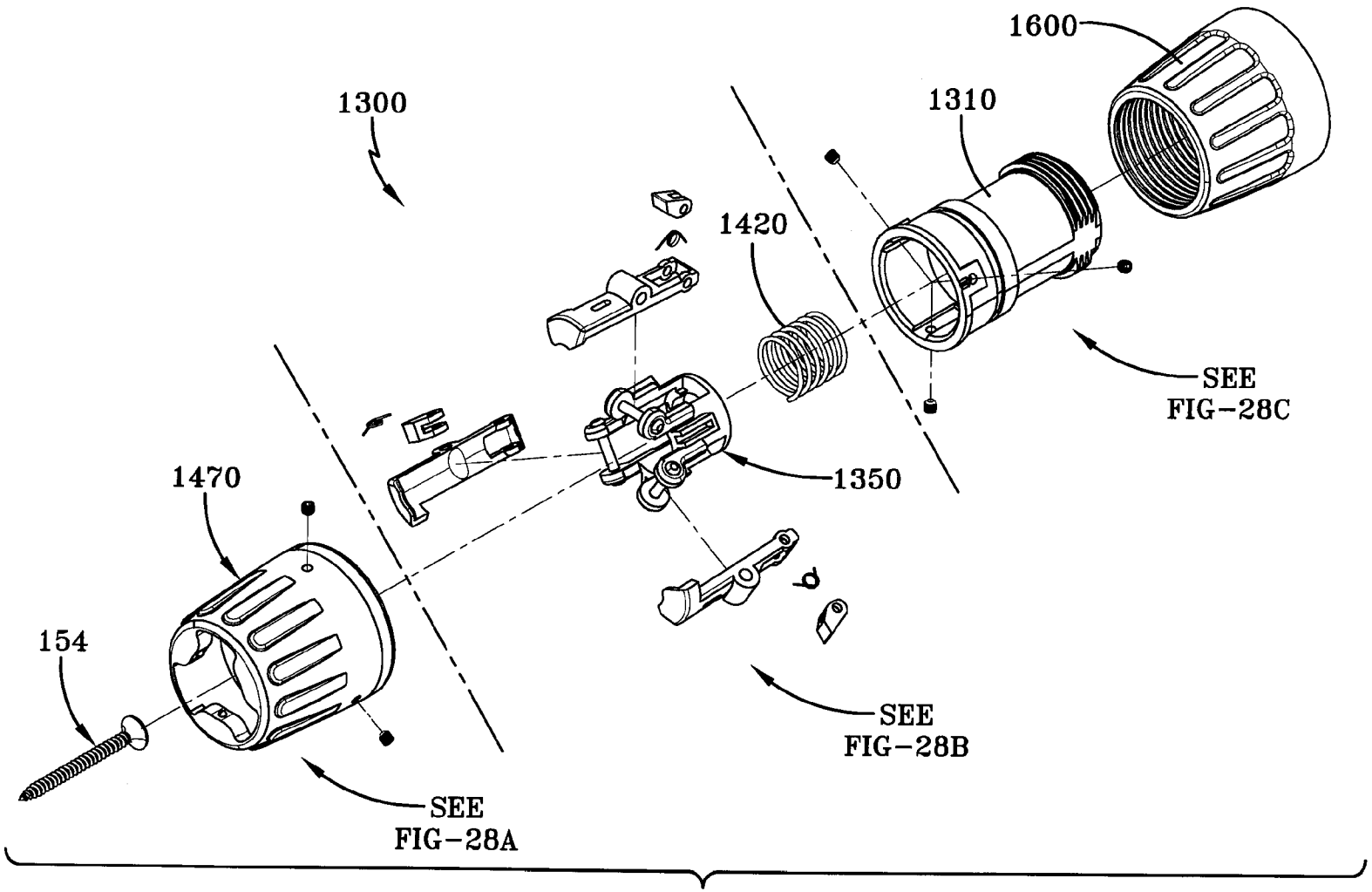
FIG. 28 is an exploded view of the alternative fastener extraction device shown in FIG. 27 in accordance with the concepts of the present invention.
Figure 28A:
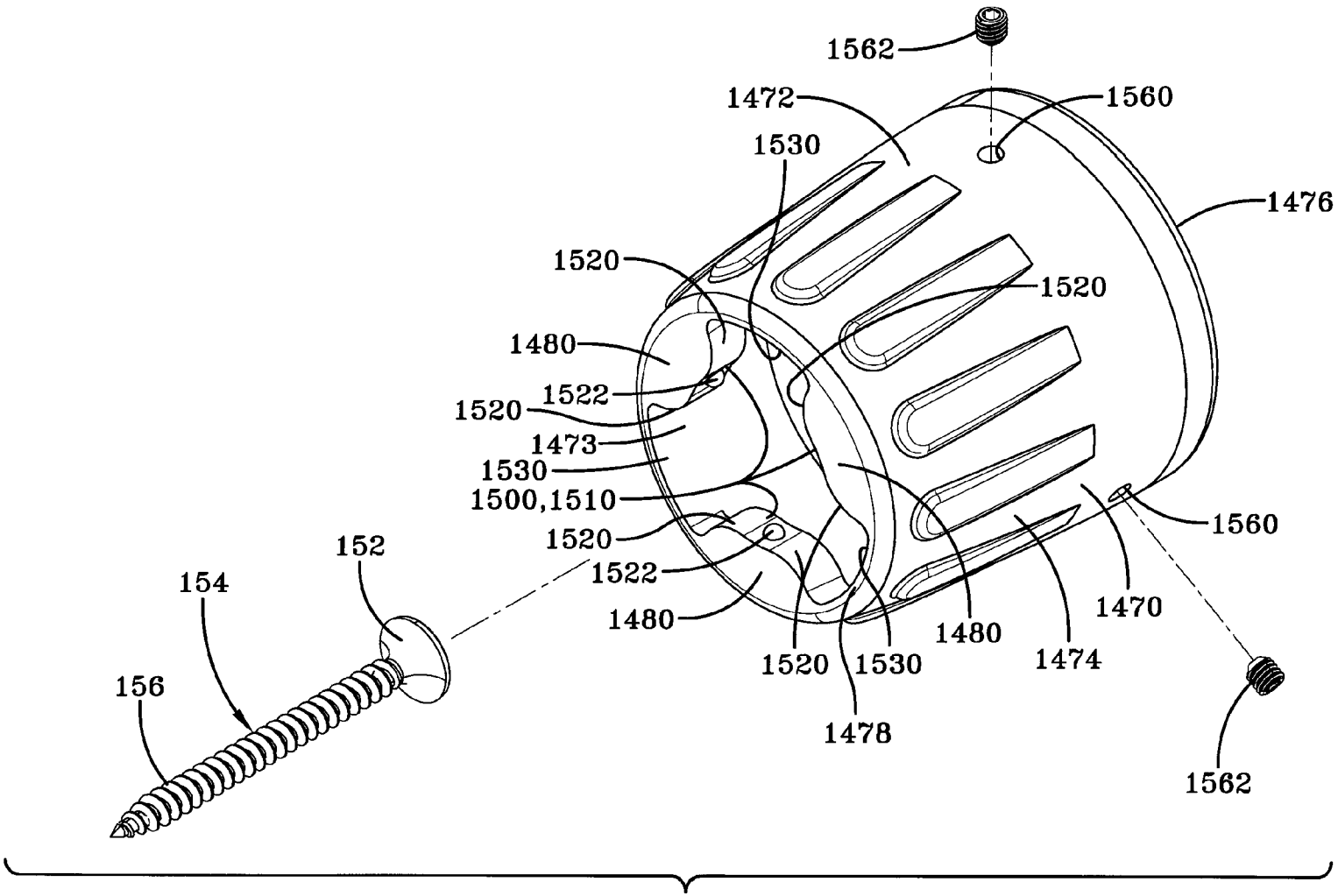
FIG. 28A is an exploded view of an actuation collar of the alternative fastener extraction device in accordance with the concepts of the present invention.
Figure 28B:
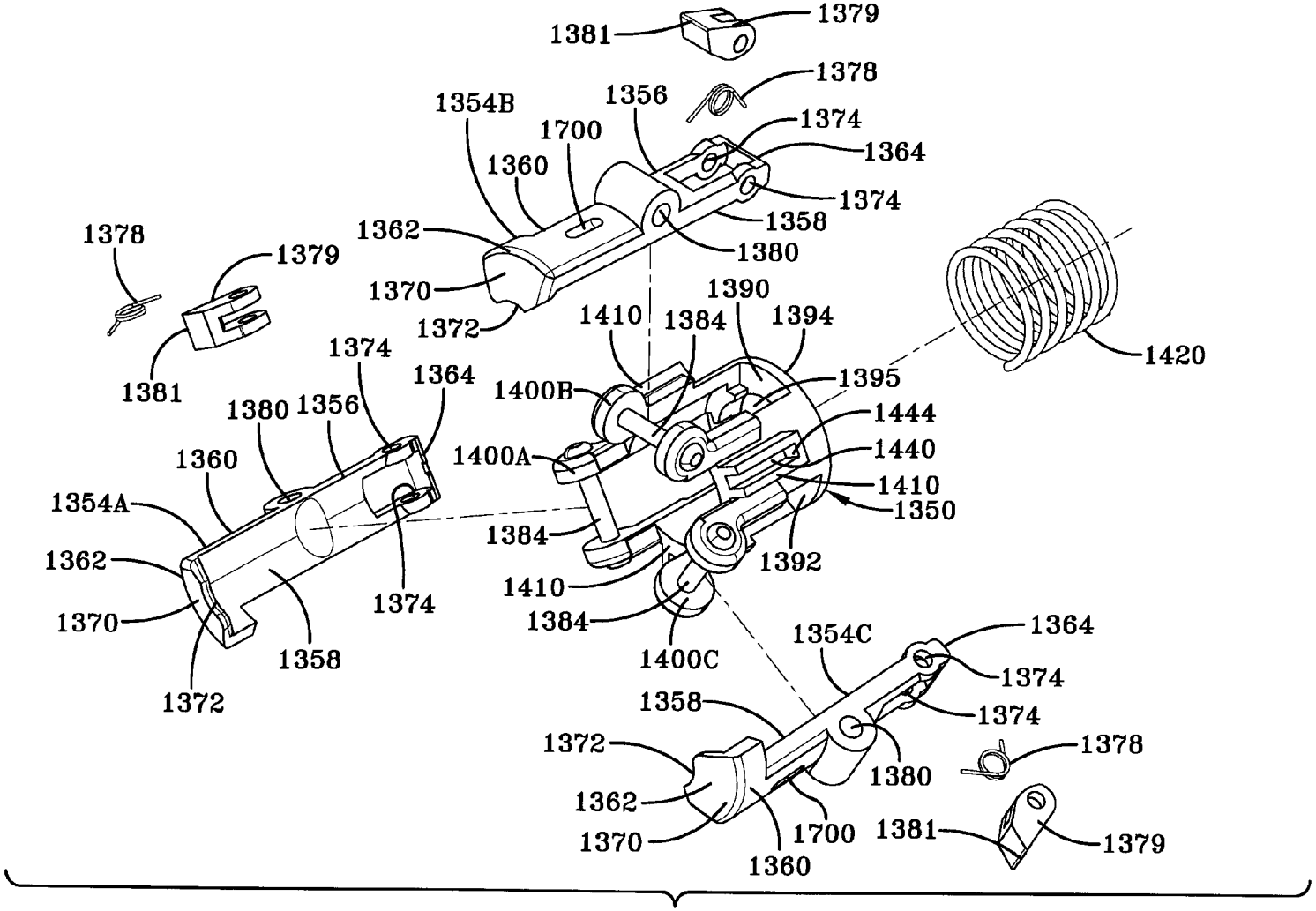
FIG. 28B is an exploded view of a carriage of the alternative fastener extraction device in accordance with the concepts of the present invention.
Figure 28C:
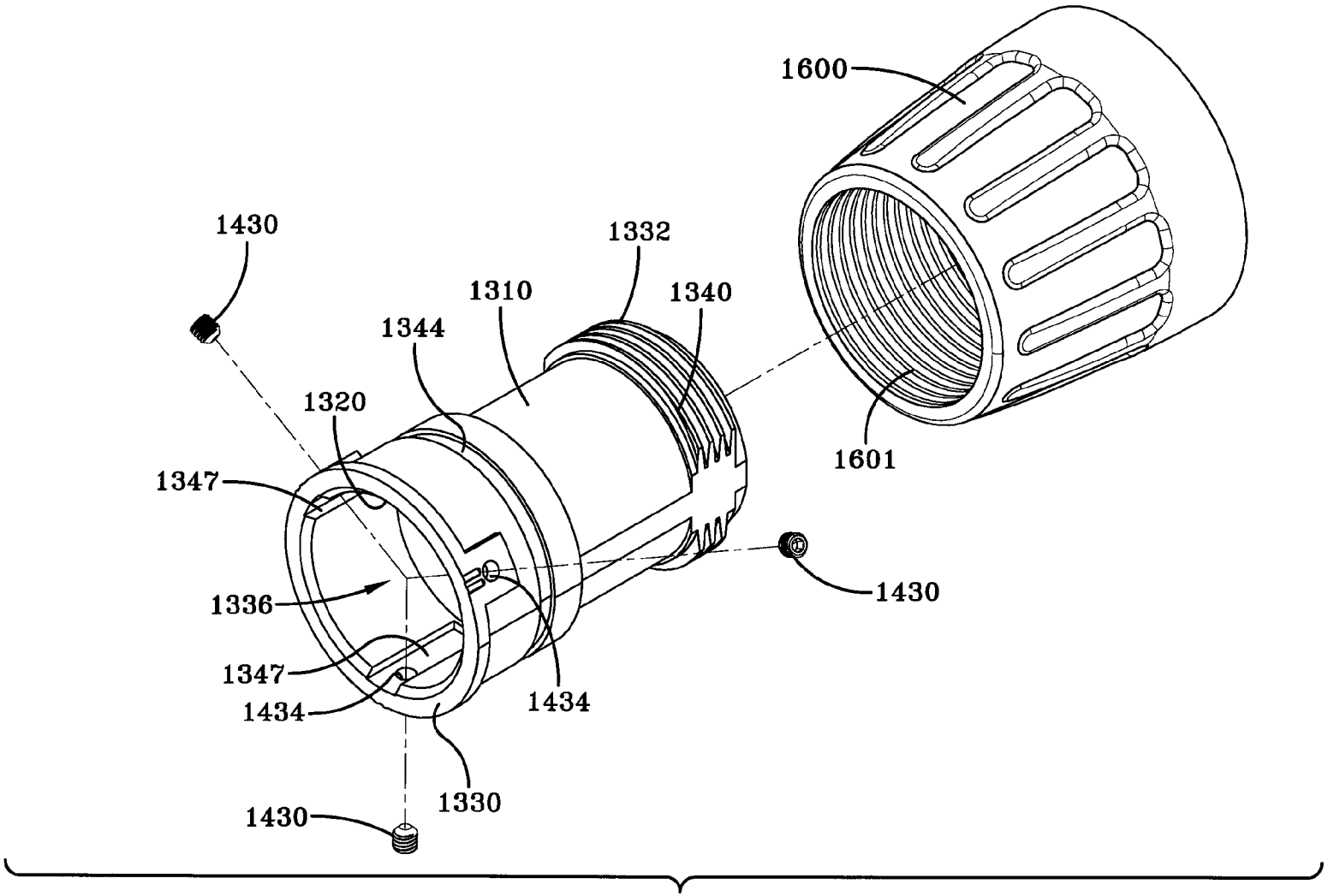
FIG. 28C is an exploded view of an attachment sleeve of the alternative fastener extraction device in accordance with the concepts of the present invention.

Continuing, the extraction device 1300 comprises a substantially cylindrical main body 1310, shown in FIGS. 28 and 28C, which has opposed inner and outer surfaces 1320 and 1322 that are bounded by opposed actuation and attachment ends 1330 and 1332, so as to form a receiving cavity 1336 therethrough. Disposed on the outer surface 1322 of the cylindrical body 1310 proximate to end 1332 are threads 1340, while an attachment channel 1344 is disposed on the outer surface 1322 of the cylindrical body 1310 proximate to end 1330. In addition, the inner surface 1320 of the main body 1310 includes a plurality of spaced guide channels 1347 that are used to slideably retain a carriage 1350 that will be discussed in detail below within the receiving cavity 1336.

The carriage 1350, shown in FIGS. 28 and 28B, pivotably carries a plurality of grasping arms 1354A-C. In particular, the grasping arms 1354A-C comprise a substantially elongated body 1356 having an opposed inner surface 1358 and outer surface 1360, and are bounded by opposed grasping and pivot ends 1362 and 1364. Extending at a right angle from the inner surface 1358 of the grasping arm 1354 at a point proximate to the grasping end 1362 is an extraction guide 1370. In one aspect, the extraction guide 1370 includes a notch 1372, which may comprise any suitable cross-section, such as a curvilinear cross-section, a rectilinear cross-section, or a combination of both. The grasping arms 1354A-C also include a bias aperture 1374 proximate to the pivot end 1364 that is configured to receive a shaft 1376 therethrough to pivotably retain an actuation spring 1378 and a bias tab 1379 thereon. Disposed on the outer surface 1360 of the body 1310 of the grasping arms 1354A-C is a pivot aperture 1380 that is pivotably attached to the carriage 1350 via a shaft 1384.

Specifically, the carriage 1350 includes a base 1390 having opposed inner and outer surfaces 1392 and 1394 through which a central aperture 1395 is disposed. In addition, a plurality of support arms 1400A-C extend from the inner surface 1392 of the base 1390 at a substantially right angle. In particular, each of the support arms 1400A-C pivotably carry respective grasping arms 1354A-C via the shaft 1384 that is disposed through the pivot aperture 1380 of the grasping arms 1354A-C. Disposed between the support arms 1400A-C and extending from the base 1390 at a substantially right angle are guides 1410 that are configured to be slideably received in respective guide channels 1347 disposed on the inner surface 1320 of the cylindrical body 1310.

A base spring 1420 is disposed adjacent to the outer surface 1394 of the base 1390 of the carriage 1350, such that the longitudinal axis of the spring 1420 is axially aligned with the base aperture 1395, while the other end of the spring 1420 is disposed against the annular support surface 1306 of the driver 100 when the extraction device 1300 is attached thereto. That is, when the carriage 1350 and base spring 1420 are placed within the receiving cavity 1336 of the cylindrical body 1310, the base spring 1420 allows the carriage 1350 to slide or otherwise move back and forth therein. In addition, the bias tab 1379 includes an engagement edge 1381 that is substantially opposite to the pivot axis of the bias tab 1379 and is normally biased by the actuation spring 1378 so that the engagement edge 1381 is urged to rotate away from the from the longitudinal axis of the cylindrical body 1310. Because the engagement edge 1381 is configured to continuously engage or is otherwise in continuous contact with the inner surface 1320 of the cylindrical body 1310, the bias force of the actuation spring 1378 causes the grasping end 1362 of the grasping arms 1354A-C to be normally rotated via the shaft 1384 away from the longitudinal axis of the cylindrical body 1310.

Furthermore, the carriage 1350 is slideably retained within the receiving cavity 1336 of the cylindrical body 1310 by set screws 1430 or other suitable fastener, that are threadably received within a plurality of fastening apertures 1434 that are disposed through the body 1310 at a point proximate to actuation end 1330. The screws 1430 are dimensioned to extend through the fastening apertures 1434 and into corresponding channels 1440 that are defined by the guides 1410 of the carriage 1350. As such, the carriage 1350 is permitted to slide within the receiving cavity 1336 while being retained to the cylindrical body 1310. In addition, the guides 1410 also include a stop 1444. As such, as the spring 1420 engages the base 1390 of the carriage 1350, the stop 1444 engages the set screws 1430, so as to prevent the carriage 1350 from sliding out of operative communication with the cylindrical body 1310 during operation of the device 1300. In addition, the point of engagement of the stop 1444 positions the carriage 1350 within the body 1310 so that the pivot apertures 1380 of the grasping arms 1354 are disposed outside of the receiving cavity 1336 during the operation of the extraction device 1300.

Attached to the actuation end 1330 of the cylindrical body 1310 is a cylindrical actuation collar 1470, as shown in FIGS. 28 and 28A, which has an elongated cylindrical body 1472 with opposed inner and outer surfaces 1473 and 1474 bounded by opposed inlet and outlet apertures 1476 and 1478. Extending from the inner surface 1473 of the actuation collar 1470 at a point proximate to the outlet aperture 1478 of the actuation collar 1470 are a plurality of spaced actuation protrusions 1480A-C. Specifically, the protrusions 1480A-C are positioned in a radial orientation with respect to the longitudinal axis of the collar 1470 and extend into the outlet aperture 1480. The actuation protrusions 1480A-C have an engagement surface 1500 that is defined by a central, substantially planar section 1510 that is disposed between a pair of curved sections 1520. Moreover, the central section 1510 may also include a protrusion, such as a raised protrusion 1522 or the like. In one aspect, the region of the planar section 1510 in which the raised protrusion 1522 is disposed may be recessed as well. It is also contemplated that the raised protrusion 1522 may comprise a biased protrusion, such as a ball bearing that is biased by a spring or other suitable means, allowing the raised protrusion 1522 to compress slightly when engaged by the grasping arms 1354 in a manner to be discussed. The gaps disposed between the spaced protrusions 1480A-C form release channels 1530A-C therebetween, and are dimensioned to receive the grasping arms 1354A-C therein, as the actuation collar 1470 is rotated. Moreover, the actuation collar 1470 includes a plurality of retention apertures 1560 disposed proximate to the inlet aperture 1476 in which set screws 1562 are threadably received therethrough, and which are configured to extend into the channel 1344 of the cylindrical body 1310 so as to rotatably attach the actuation collar 1470 to the body 1310. That is, the set screws 1562 serve to pivotably retain the actuation collar 1470 to the cylindrical body 1310, although any other suitable means of fixation may be used. In addition, when the actuation collar 1470 is attached to the cylindrical body 1310, the extraction guides 1370 of each of the grasping arms 1354A-C extends through the outlet aperture 1478 of the actuation collar 1470.

When attached, the actuation collar 1470 is permitted to rotate relative to the cylindrical body 1310 and the carriage 1350. As such, the rotation of the actuation collar 1470 causes the grasping arms/extraction guides 1354,1370 to transition from an open or release position when they are disposed in respective release channels 1530, to a closed or grasping position when the central section 1510 of the actuation protrusions 140A-C is disposed upon the outer surface 1360 of the grasping arms 1354A-C in a manner to be discussed.

The fastener extraction device 1300 also includes an attachment sleeve or collar 1600 having inner threads 1601 that are configured to be threadably attached to the threads 1340 of the cylindrical body 1310. In addition, the attachment collar 1600 is also configured to attach to the neck 1302 of the driver tool 100 via compression, snap-fit, or via any other suitable manner. That is, the attachment collar 1600 is configured to serve as the interface for attaching the extraction device 1300 to the driver tool 100. Moreover, it should be appreciated that in another embodiment, the extraction device 1300 may be made integral with the attachment collar 1600, or with the body of the driver tool 100.

Figure 29:
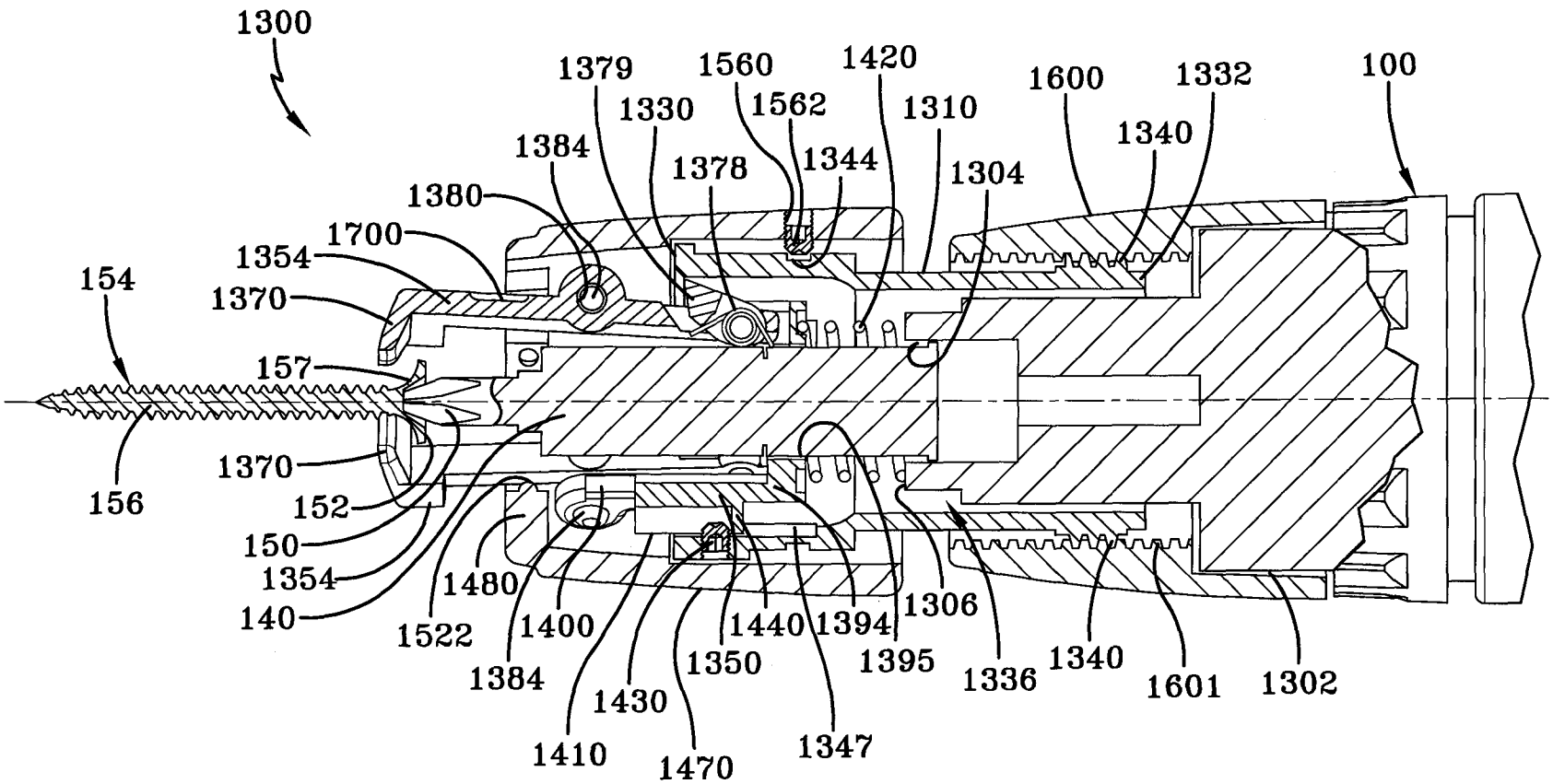
FIG. 29 is a sectional view of the alternative fastener extraction device in which the grasping arms are retracted away from the fastener to be extracted in accordance with the concepts of the present invention.
Figure 30:
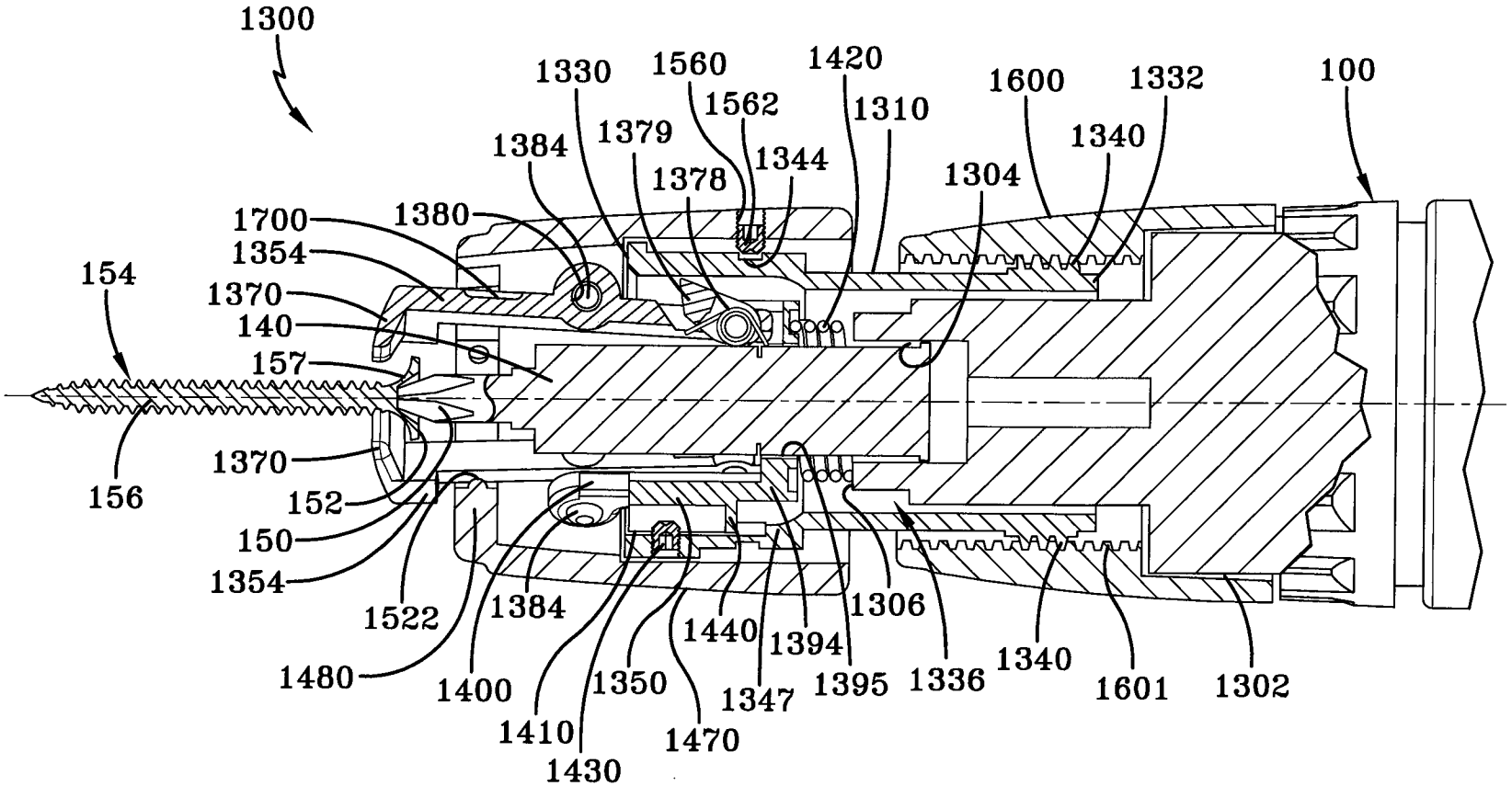
FIG. 30 is a sectional view of the alternative fastener extraction device in which the grasping arms/extraction guides are retracted away from the fastener to be extracted in accordance with the concepts of the present invention.

Thus, to place the fastener extraction device 1300 into operation, it is attached to the neck 1302 of the driver tool 100. As such, the rotating shank 140 and bit 150 attached to the driver tool 100 are disposed through the attachment sleeve 1600, the cavity 1336 of the main body 1310, the spring 1420, the base aperture 1395 of the carriage 1350, and through the outlet aperture 1478 of the actuation collar 1470. Once the extraction device 1300 is attached to the driver tool 100, the actuation collar 1470 is rotated to a first position (open/release position), as shown in FIG. 29, such that the grasping arms 1354A-C are retracted within respective release channels 1530A-C provided by the actuation collar 1470. This allows the extraction guides 1370 on the end of the grasping arms 1354A-C to pivot away from the longitudinal axis of the cylindrical body 1310 by operation of the spring-biased tab 1379. As such, the user of the extraction device 1300 then inserts the bit 150, such as a Phillips or slot head, which is carried by the shank 140 into the head 152 of the screw 154 to be removed from the surface, as shown in FIG. 30. It should be appreciated that the base spring 1420 serves to push or urge the carriage 1350 out of the cylindrical body 1310 and allows the grasping arms 1354A-C to move independently of the of the rotating shank 140, thus allowing the grasping arms 1354 to remain in contact with the head/neck of the fastener 154 to be extracted.

Figure 31:
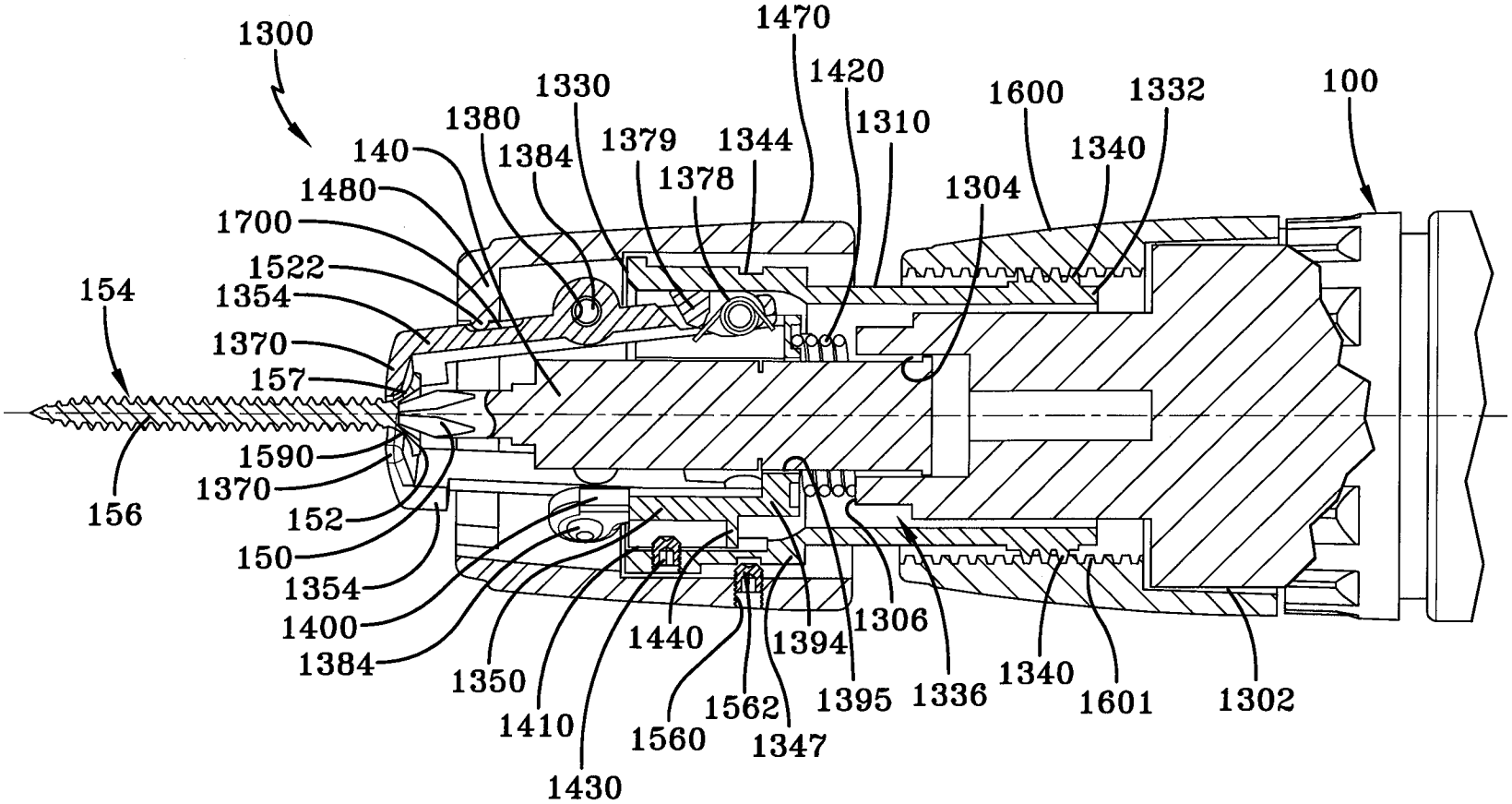
FIG. 31 is a sectional view of the alternative fastener extraction device in which the extraction guides form an extraction aperture about the neck of the fastener, below its head, to extract the fastener in accordance with the concepts of the present invention.

Once the bit 150 is seated in the head of the screw 154 or other fastener, the actuation collar 1470 is rotated to a second or closed position (grasping position), as shown in FIG. 31. Specifically, as the collar 1470 is rotated, the curved sections 1520 of the actuation collar 1470 cause the extraction guides 1470 and arms 1354A-C to rotate or pivot toward the longitudinal axis of the cylindrical body 1310 until the raised protrusions 1522 of the actuation protrusions 1480 are received in corresponding notches 1700 that are disposed in the outer surface 1360 of the grasping arms 1354A-C. This results in the extraction guides 1370 being moved to the grasping position, where they are moved or pivoted so as to be in close proximity to each other, such that their notches 1372 together substantially form an extraction aperture 1590, which substantially circumscribes the neck 157 of the screw 154 at a point behind the head 152 of the screw 154. That is, the extraction guides 1370 are moved by operation of the actuation collar 1470 so that they rest behind the head 152 of the screw 154, while the notches 1372 serve to retain the neck 157 of the screw 154 in operative engagement with the extraction device 1300.

Once the neck 157 of the fastener 154 is retained through the extraction aperture 1590 of the extraction guides 1370, the user is then able to extract the fastener 154 by pulling on the back of the screw head 154 using the leverage and weight of the driver tool 100 to which the extraction device 1300 is attached.

To release the extracted fastener 154, the user then rotates the actuation collar 1470 to the first position (release position), previously discussed, and as shown in FIG. 29, the grasping arms 1354A-C are retracted within respective release channels 1530A-C provided by the actuation collar 1470.

In yet another embodiment of the present invention, the fastener extraction device 1702 may be configured with an automated actuation collar 1470, as shown in FIGS. 32-38 of the drawings. Specifically, as shown in FIGS. 33A-B, the fastener extraction device 1702 includes a plurality of electromagnets 1710 that are disposed proximate to the end 1330 of the cylindrical main body 1310 in corresponding apertures 1712 disposed in the outer surface 1322 of the cylindrical main body 1310. In one aspect, the electromagnets 1710 are configured so that they are flush with the outer surface 1322 of the main body 1310. Each of the electromagnets 1710 comprise a ferrite core 1730 that is wrapped with a conductive wire coil 1740, each having ends 1750 and 1760. The ends 1750 and 1760 of the wire coil 1740 are respectively attached to electrically-isolated terminals 1790 and 1792 that are provided by a support sleeve or collar 1800, shown in FIGS. 33A-B, that is substantially cylindrical and configured to be disposed within the cavity 1336 and attached to the inner surface 1320 of the cylindrical main body 1310 within the cavity 1336. The terminals 1790 and 1792 of the support sleeve or collar 1800 are electrically coupled to a controller 1818, shown in FIGS. 35 and 37, which includes the necessary hardware and software to carry out the functions of the of the fastener extraction device 1702 to be discussed. Coupled to the controller 1818 is a push button or switch 1820 and a power source 1830, such as the power source used to supply power to the driver tool 710 or 100, such as an AC (alternating current) or DC (direct current) power source, or any other suitable wired or portable power source, such as a battery. As such, the controller 1818 is configured to supply pulses of electrical current in a first and in a second direction, as determined by the state of the push button 1820 to be discussed. That is, the controller 1818 may supply electrical pulses in any sequence, such that some of the pulses may have a positive magnitude, while other pulses may have a negative magnitude, thereby causing the electrical current to flow in different directions through the coils 1740 of the electromagnets 1710. As a result of the pulse train applied to the collar 1800 by the controller 1818, the direction of electrical current through the coils 1740 is periodically changed, which results in the magnetic orientation of the electromagnets 1710 being correspondingly being changed from a magnetic North orientation to a magnetic South orientation, or vice versa. Furthermore, the selective engagement of the push button 1820 determines the particular pulse train that is applied by the controller 1818 to the electromagnets 1710, so as to open and close the grasping arms 1354 in the manner to be discussed below.

Figure 32:
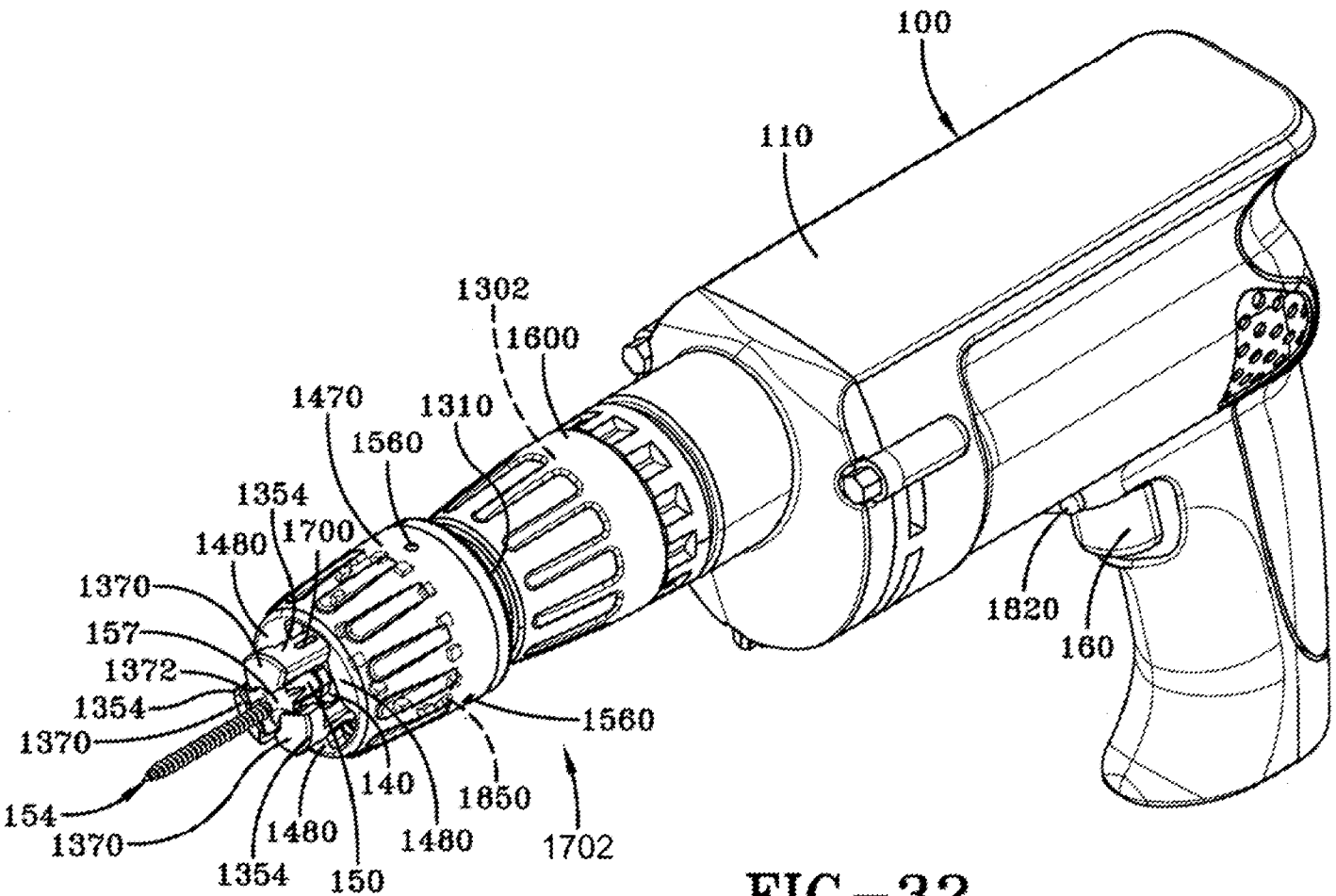
FIG. 32 is a perspective view of an alternative embodiment of the fastener extraction device that includes an automated actuation collar in accordance with the concepts of the present invention.
Figure 33A:
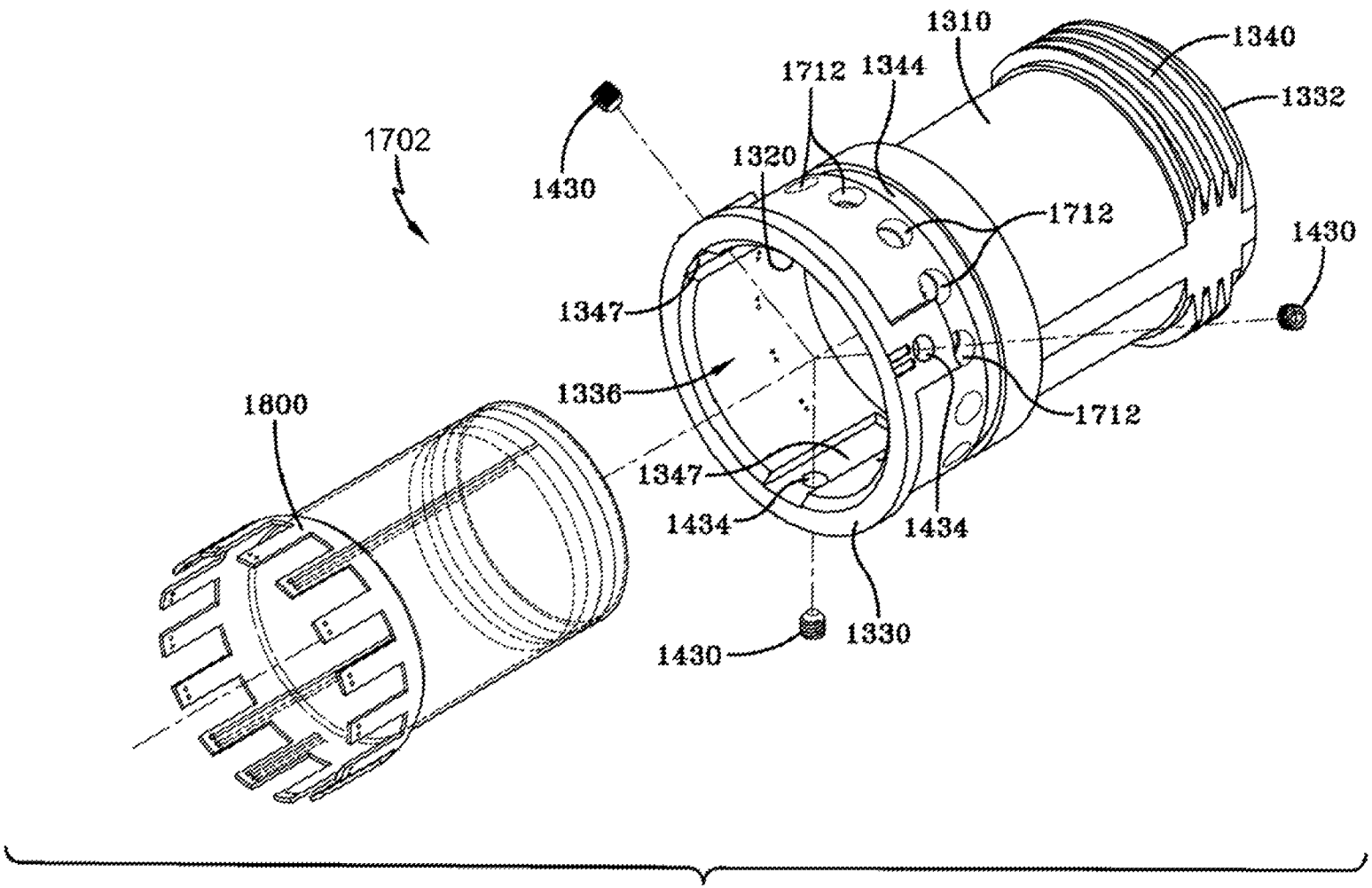
FIGS. 33A-B is a perspective view of a sleeve carried by the elongated body of the alternative fastener extraction device in accordance with the concepts of the present invention.
Figure 33B:
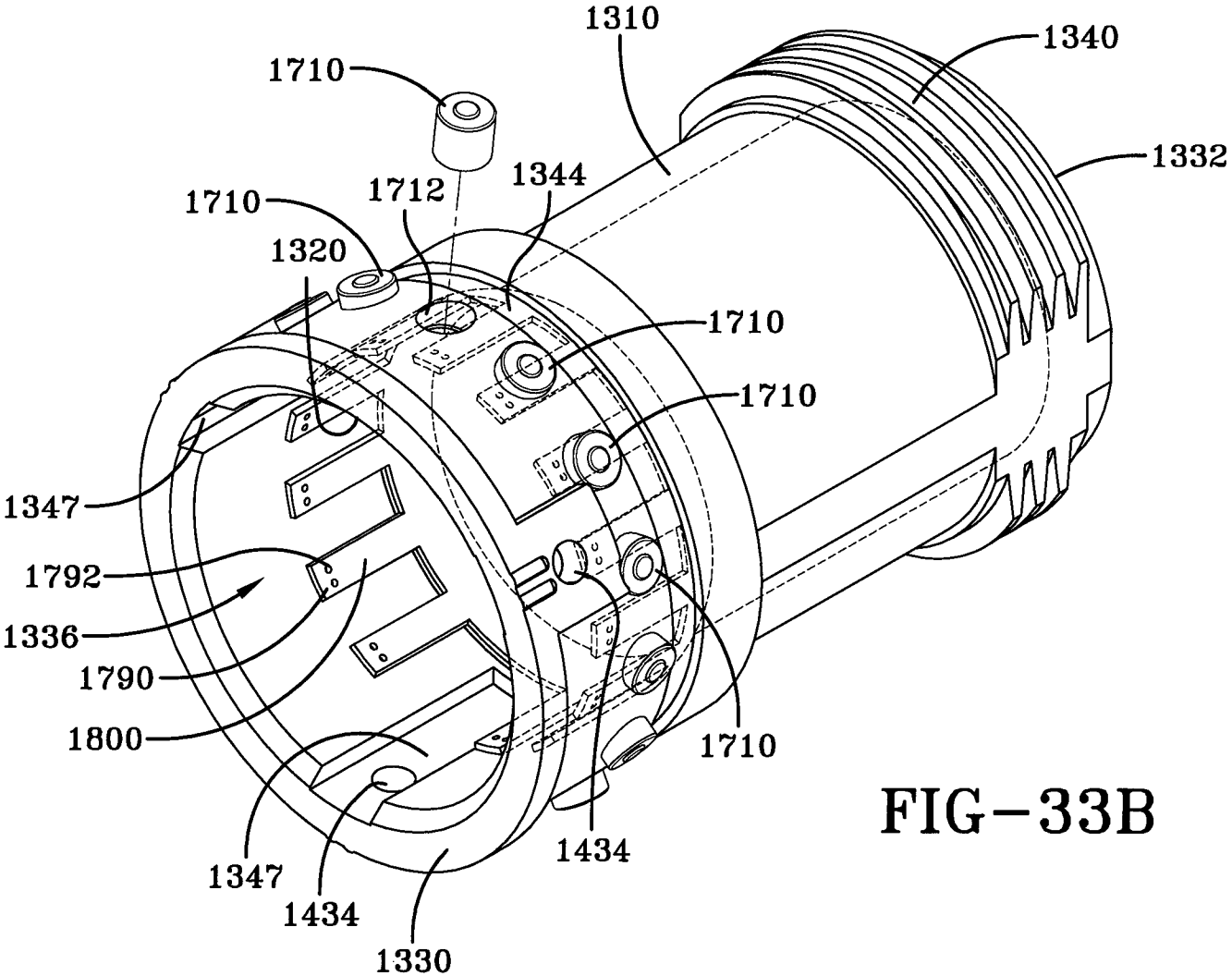
Figure 34:
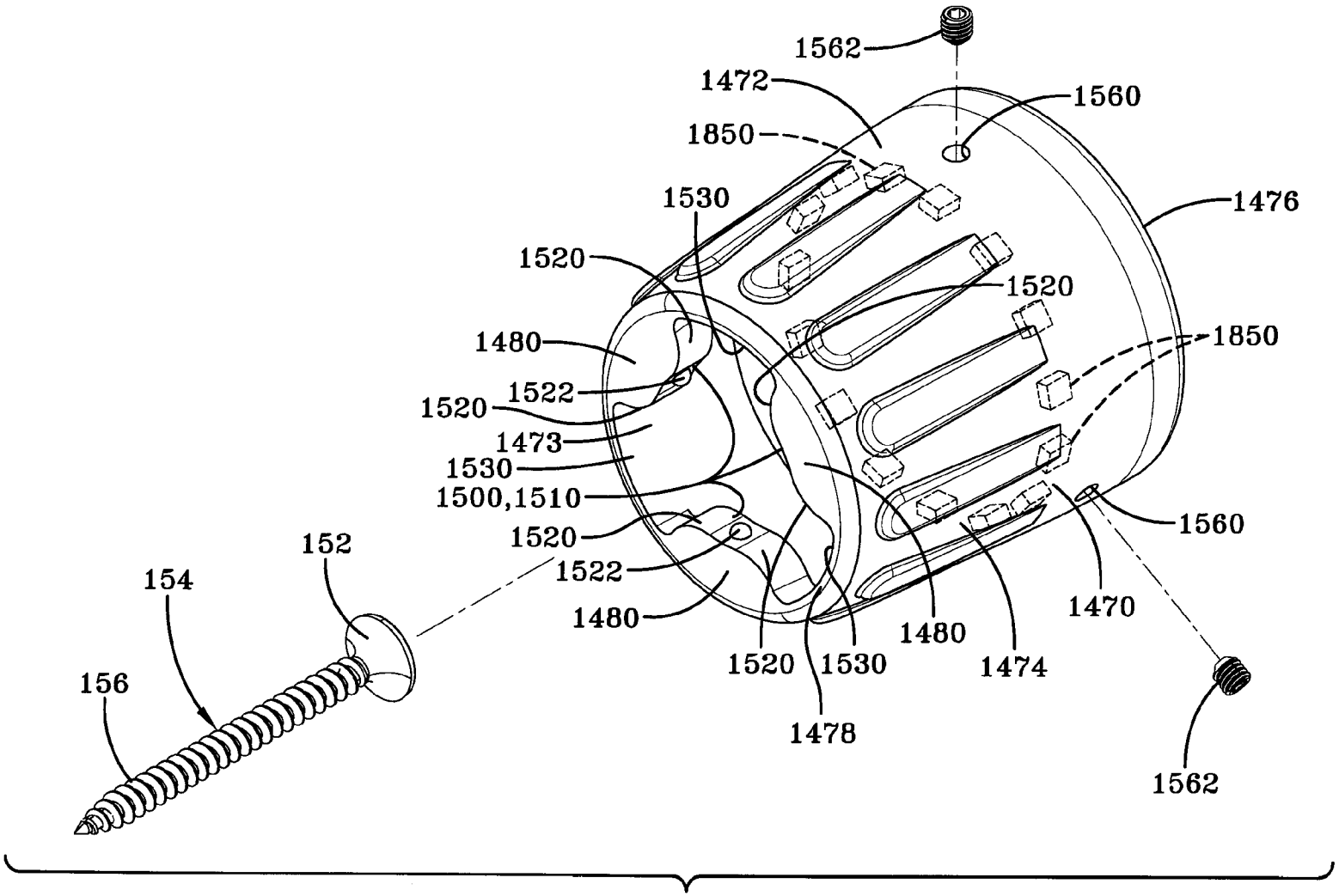
FIG. 34 is a perspective view of the automated actuation collar provided by the alternative faster extraction device in accordance with the concepts of the present invention.
Figure 35:
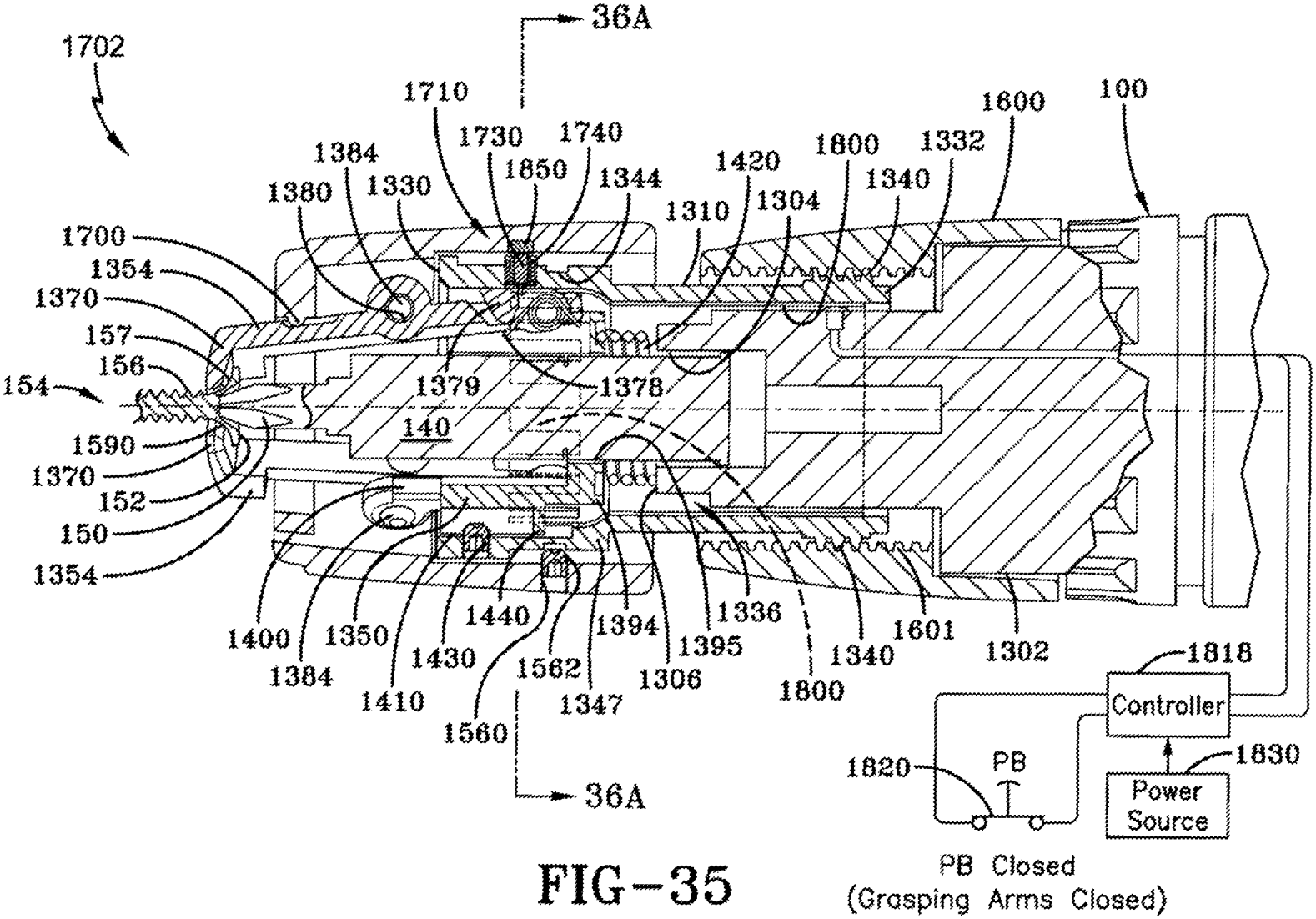
FIG. 35 is a cross-sectional view of the automated actuation collar provided by the alternative fastener extraction device showing the grasping arms in a closed position in accordance with the concepts of the present invention.

The actuation collar 1470, shown clearly in FIGS. 32 and 34, includes a plurality of collar magnets 1850 that are disposed on the inner surface 1473 of the actuation collar 1470. Thus, when the actuation collar 1470 is attached to the main body 1310, the collar magnets 1850 and the electromagnets 1710 are in operative proximity to each other such that their respective magnetic fields operatively interact. The magnetic orientation of the electromagnets 1710 is controlled in the manner to be discussed so that its magnetic poles or orientation are the same (N-N) or opposed (N-S or S-N) to the magnetic orientation of the collar magnets 1850. For example, the collar magnets 1850 may be selected to have either a magnetic North or a magnetic South orientation; however, for the purposes for the following discussion, the collar magnets 1850 will be considered to have a magnetic North orientation. Furthermore, the magnetic North or South orientation of the electromagnets 1730 is determined by the pulse train that is applied by the controller 1818, such that when the push button 1820 is in a first state, such as a closed or actuated state, where it is depressed, the controller 1818 supplies a first pulse train to the conductive support collar 1800 to maintain the grasping arms 1354 in a closed position, as shown in FIG. 35. Alternatively, and when the push button 1820 is in a second or opened state, such as a non-actuated state, the controller 1818 supplies a second pulse train to the electromagnets 1710 carried by the support collar 1800.

Specifically, the controller 1818 is configured to supply the appropriate pulse train for an appropriate amount of time to enable the clockwise and counterclockwise rotation of the actuation collar 1470. That is, the controller 1818 provides a pulse train of a predetermined sequence of electrical pulses to enable the actuation collar 1470 to rotate to a position in which the grasping arms 1354 are closed by the operation of the actuation protrusions 1480 in the case of the first state, and provides a pulse train of a predetermined sequence of electrical pulses to enable the action collar 1470 to rotate to a second state in which the grasping arms 1354 are opened, whereby the grasping arms 1354 are disposed in release channels 1530 of the actuation collar 1470.

Figure 36A:
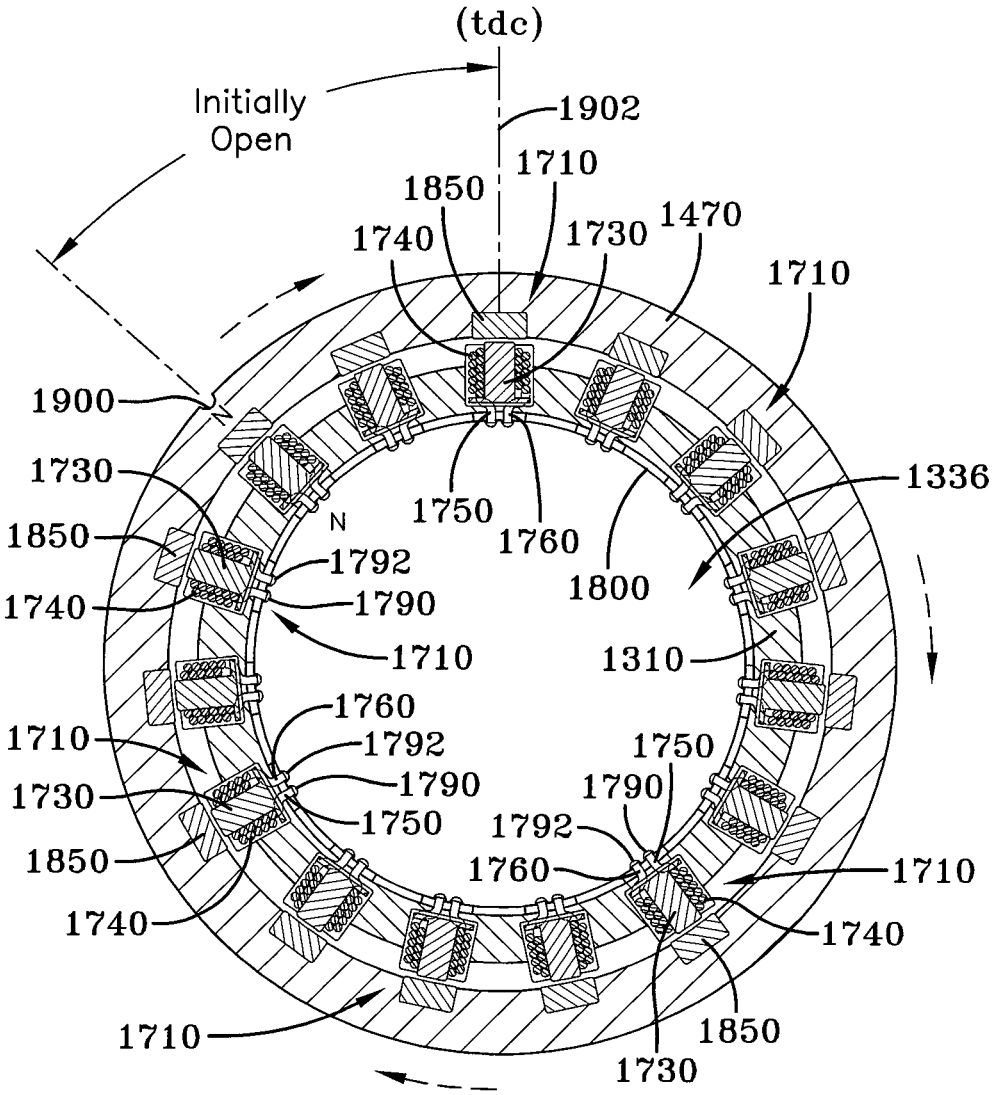
FIGS. 36A-D are cross-sectional views of the automated actuation collar of the alternative fastener extraction device in accordance with the concepts of the present invention.
Figure 36B:
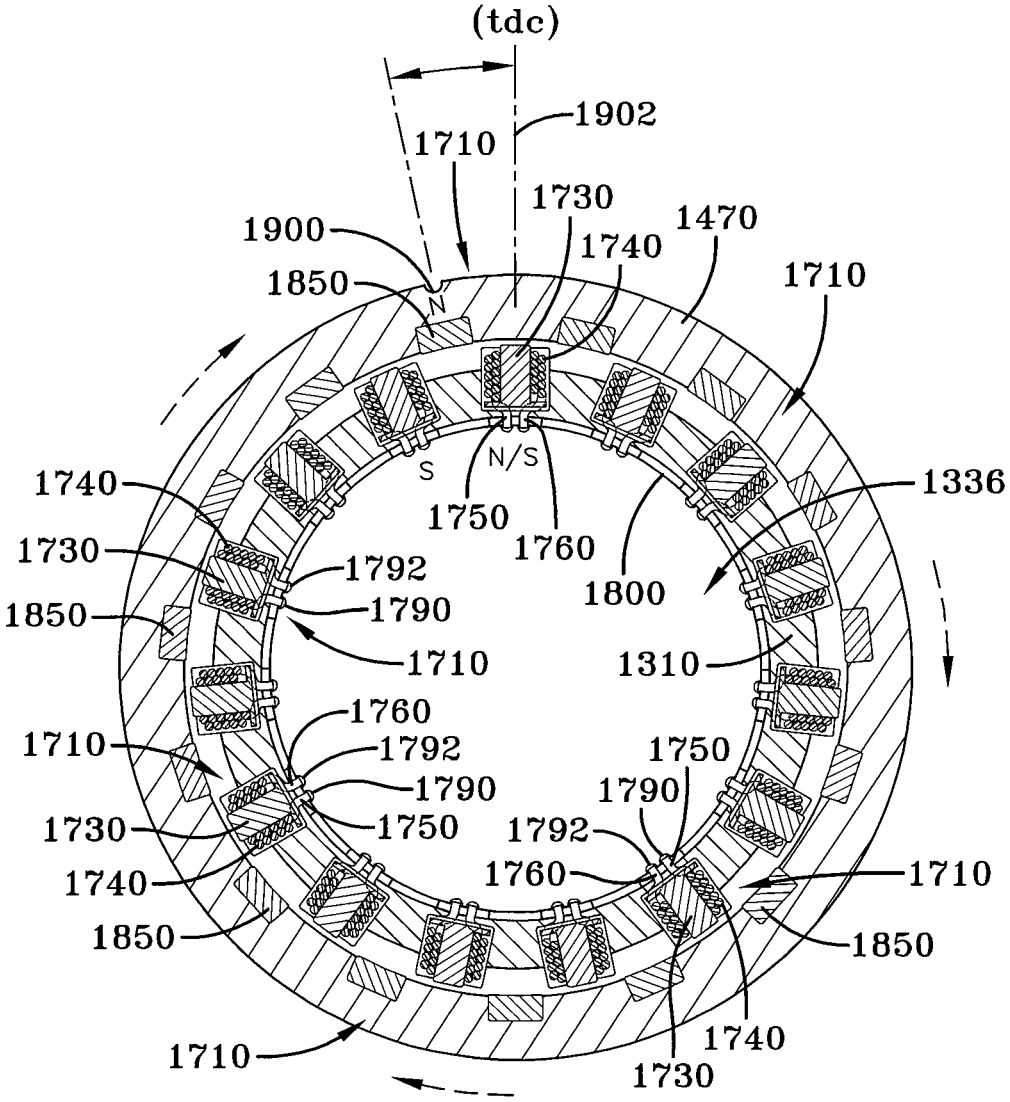
Figure 36C:
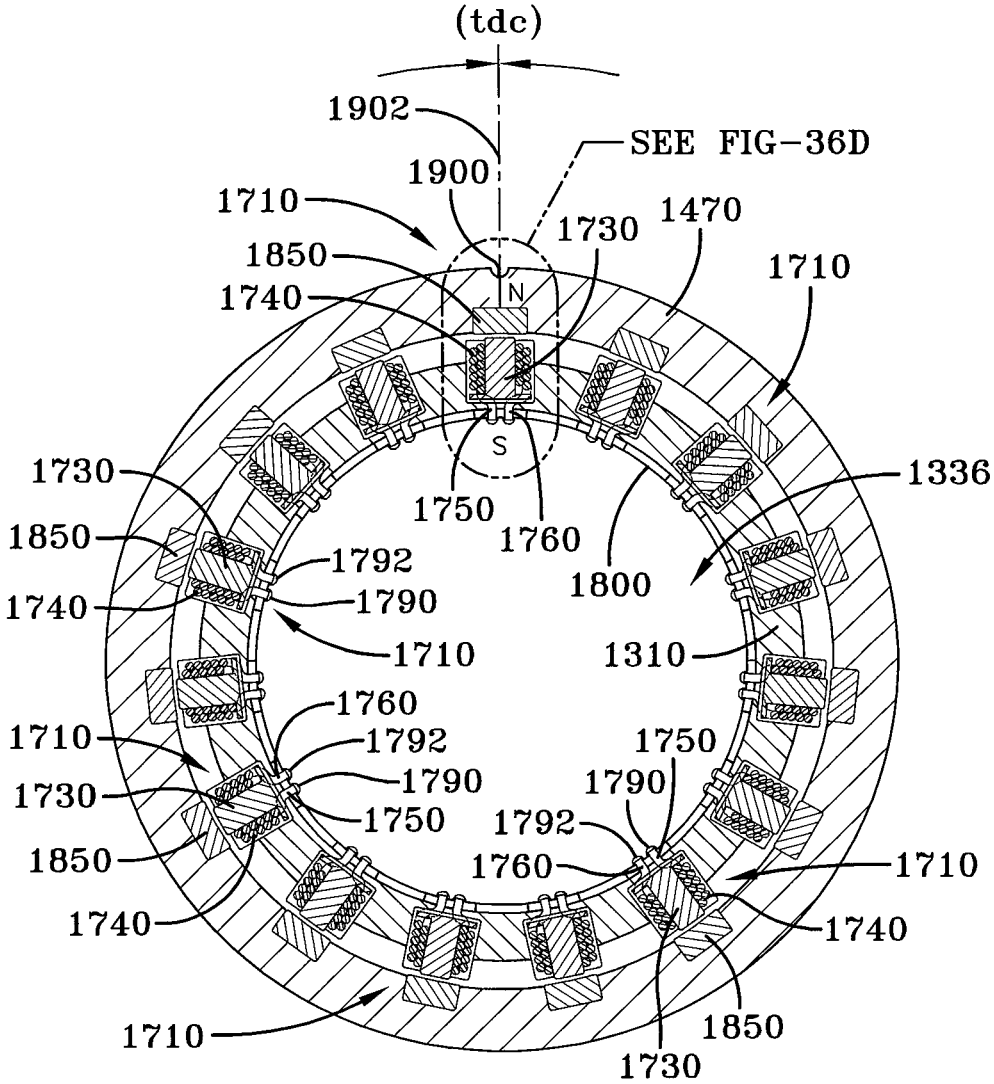
Figure 36D:
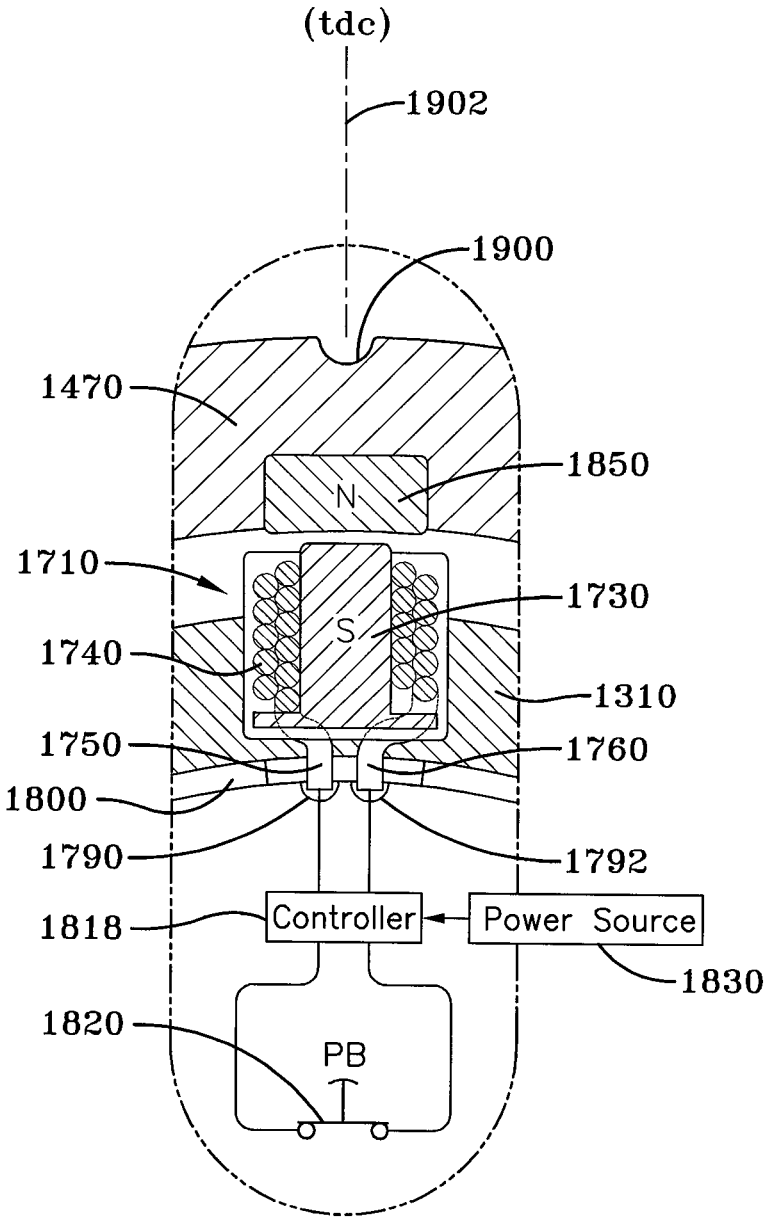

The following discussion presents the operational steps carried out by the fastener extraction device 1702 in which the collar magnets 1850 are configured with a magnetic North orientation. Specifically, to place the extraction device 1702 into operation, the push button 1820 is depressed or otherwise actuated, which causes the controller 1818 to generate a pulse train that transitions the grasping arms 1354 from an initially opened state to a closed, final state, as shown in FIG. 35. That is, a pulse train that is applied by the controller 1818, whereby the actuation collar 1470 is initially at a position that is approximately 60 degrees from top dead center (tdc), causes the electromagnets 1710 to initially take on a magnetic North orientation that repels the magnetic force of the collar magnets 1850 that also have a magnetic North orientation, as shown in FIG. 36A. This causes the actuation collar 1470 to start rotating in a clockwise direction from the initial position in which the identifier 1900 is approximately 60 degrees from top dead center (tdc), as shown in FIG. 36A. As the collar magnets 1850 are moved to be positioned between the electromagnets 1710, as shown in FIG. 36B, the pulse train supplied by the controller 1818 causes the electromagnets 1710 to take on a magnetic South orientation, which attracts the collar magnets 1850 thereto, thus resulting in the continued clockwise rotation of the actuation collar 1470. This sequence in which the electromagnets 1710 are controlled to take on either magnetic North or South orientations is continued until the actuation collar 1470 is rotated to a position in which an indicator 1900 is located at top dead center (tdc) 1902, as shown in FIGS. 36C-D, where the magnetic orientation of the electromagnets 1710 (magnetic South) is opposite to that of the collar magnets (magnetic North) to retain the actuation collar 1470 in a locked closed position.

Figure 37:
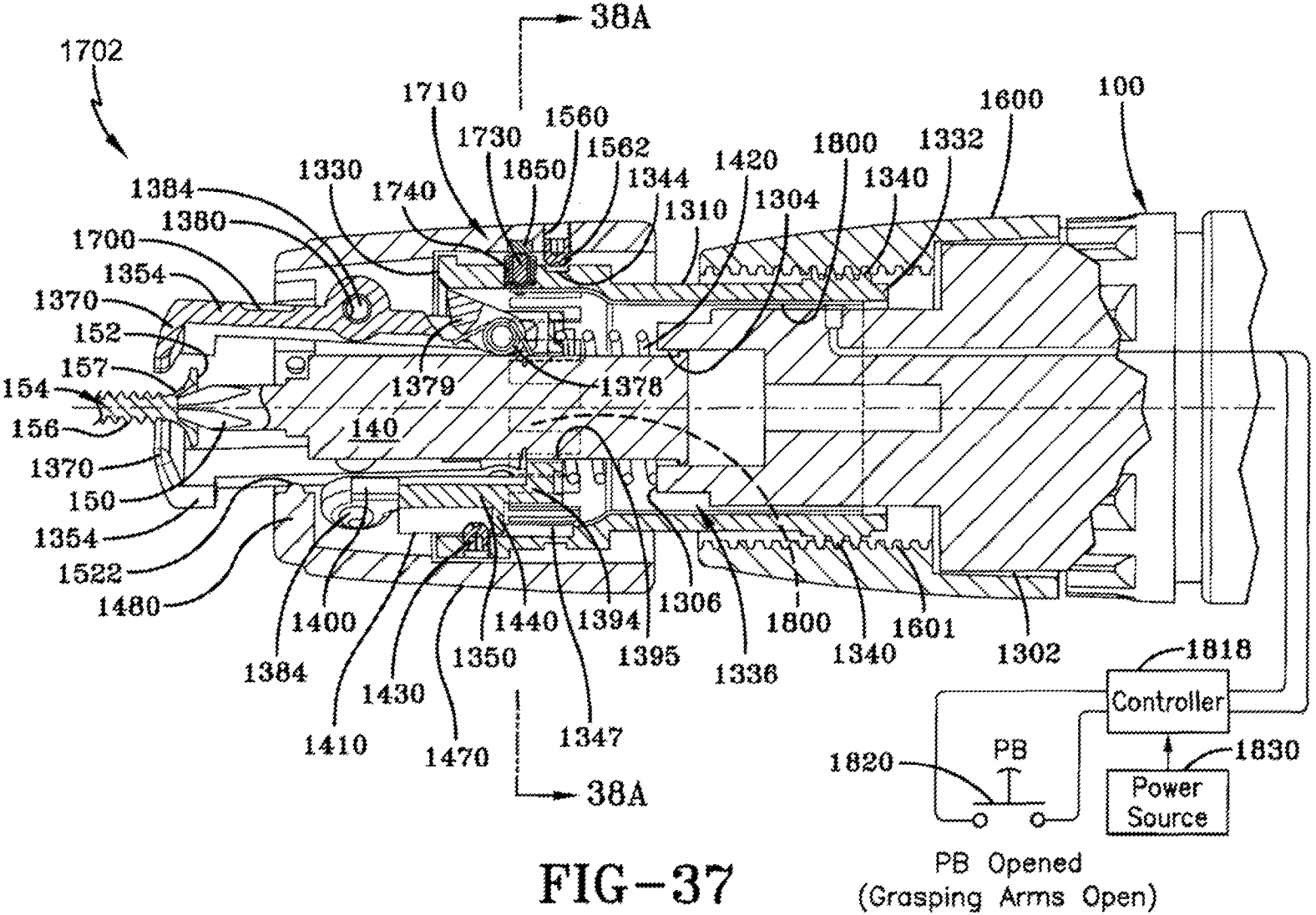
FIG. 37 is a cross-sectional view of the automated actuation collar provided by the alternative fastener extraction device showing the grasping arms in an opened position in accordance with the concepts of the present invention.
Figure 38A:
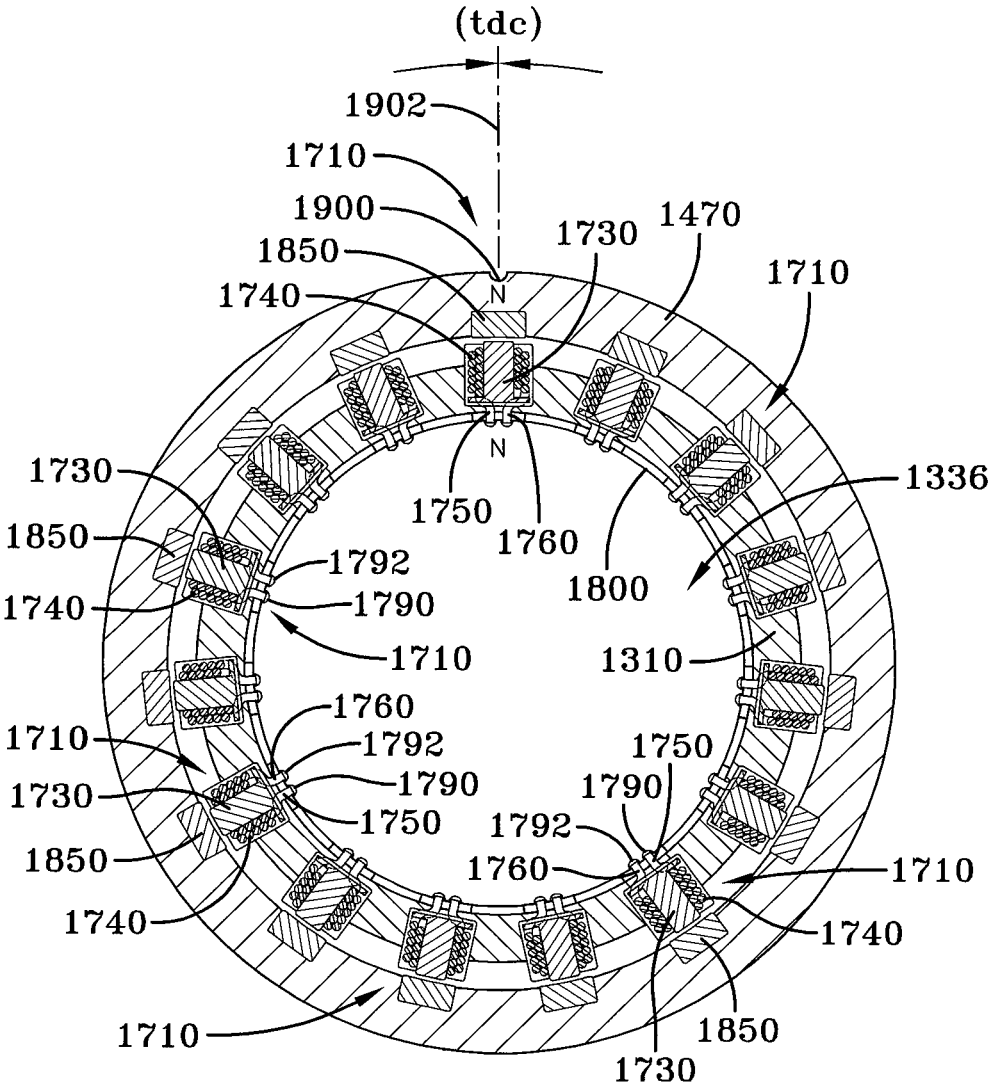
FIGS. 38A-D are cross-sectional views of the automated actuation collar of the alternative faster extraction device in accordance with the concepts of the present invention.
Figure 38B:
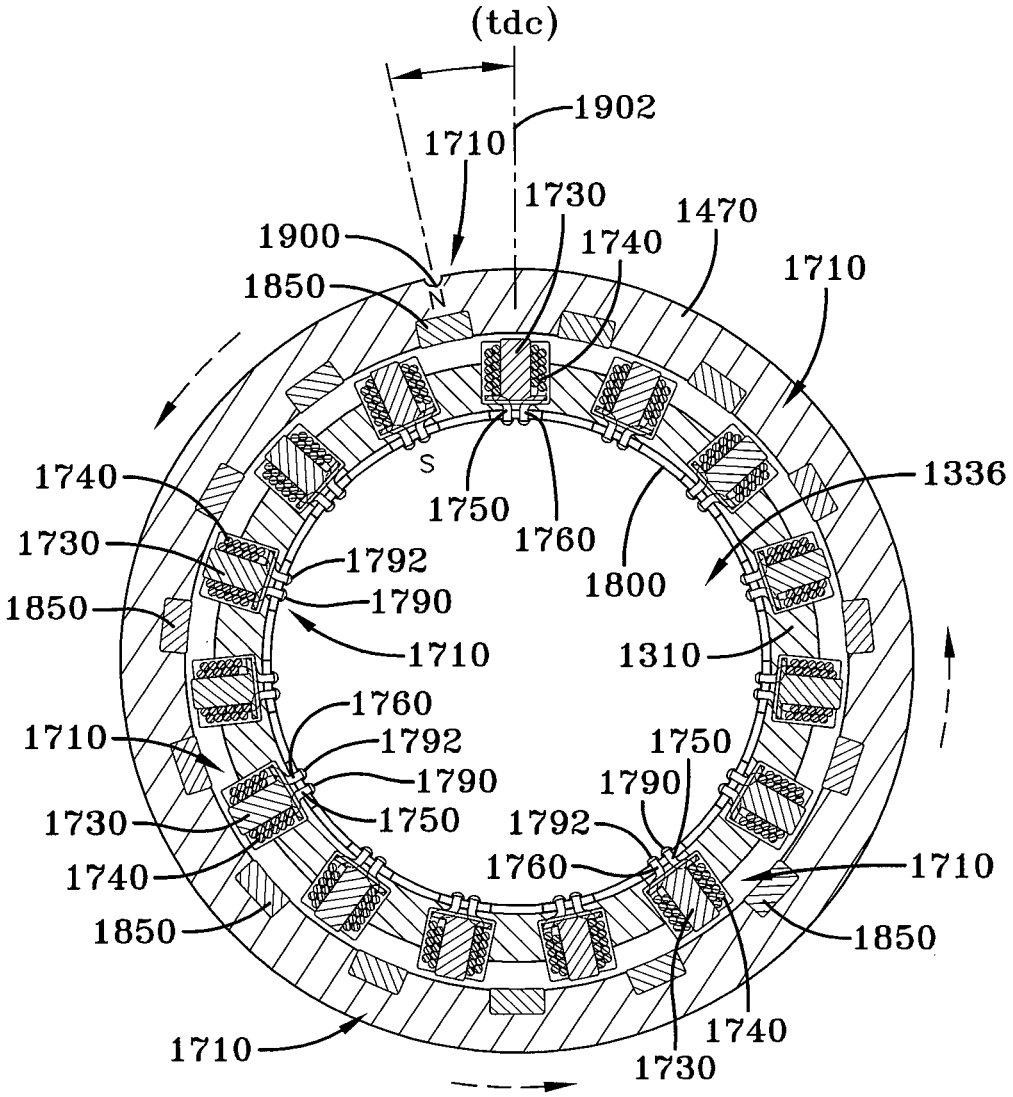
Figure 38C:
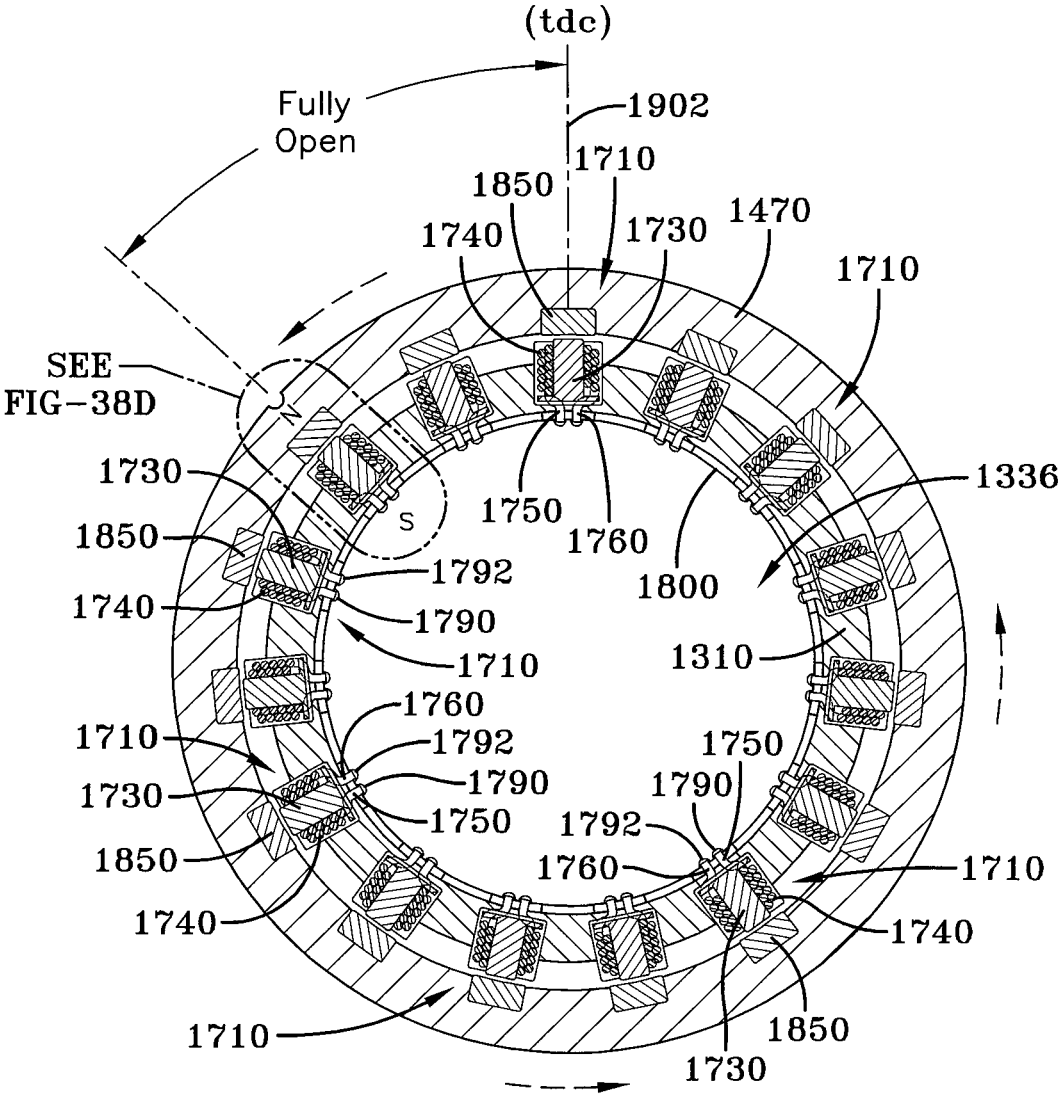
Figure 38D:
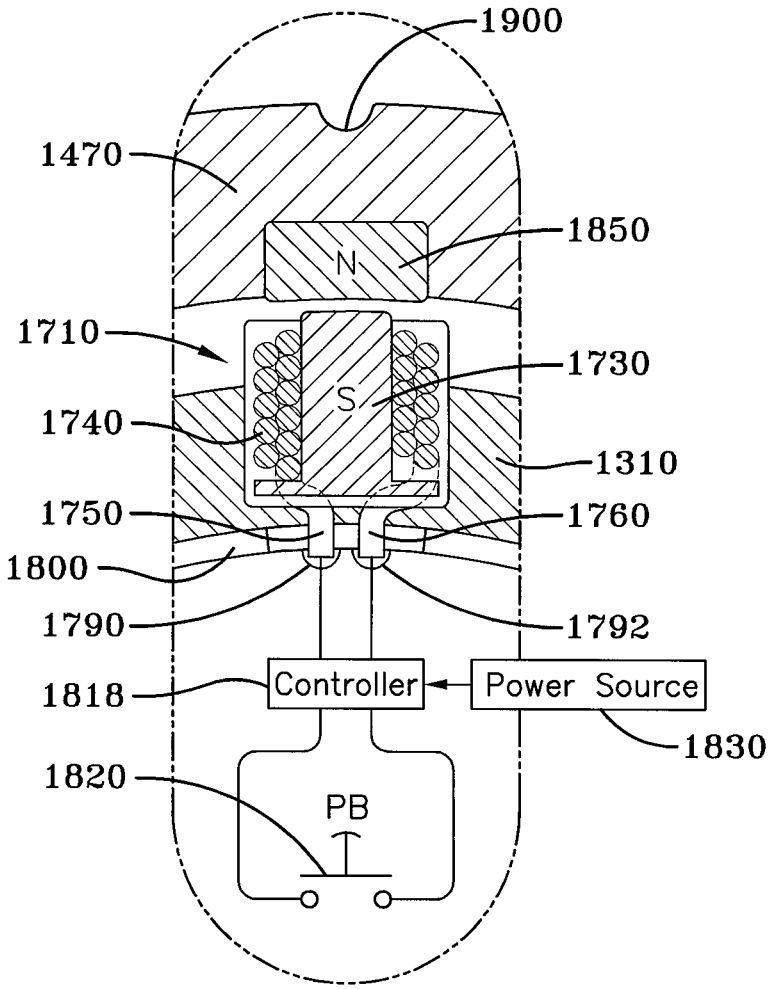

Alternatively, during operation of the extraction device 1702 in which the collar magnets 1850 are configured with a magnetic North orientation, the user may release the push button 1820, which causes the controller 1818 to generate a pulse train that transitions the grasping arms 1354 from an initially closed state to an opened final state, as shown in FIG. 37. That is, when the push button 1820 is opened, or otherwise not actuated, the pulse train that is applied by the controller 1818 to open the grasping arms 1354 from an initially closed position causes the electromagnets 1710 to initially take on a magnetic North orientation that repels the collar magnets 1850 that also have a magnetic North orientation, as shown in FIG. 38A. This causes the actuation collar 1470 to start rotating in a counterclockwise direction from initial position in which the indicator 1900 is at top dead center (tdc). As the collar magnets 1850 are moved to be positioned between the electromagnets 1710, as shown in FIG. 38B, the pulse train supplied by the controller 1818 applies a pulse that causes the electromagnets 1710 to take on a magnetic South orientation, which attracts the collar magnets 1850 thereto, thus resulting in the continued counterclockwise rotation of the actuation collar 1470. This sequence in which the electromagnets 1710 are controlled to take on either magnetic North or South orientations is continued until the indicator 1900 of the actuation collar 1470 is rotated in a counterclockwise position to a position that is 60 degrees from top dead center (tdc), as shown in FIGS. 38C-D, where the magnetic orientation of the electromagnets 1710 (magnetic South) is opposite of that of the collar magnets (magnetic North) to retain the actuation collar 1470 in a locked opened position.

Furthermore, while the discussion above contemplates that actuating/closing/depressing the switch or push button 1820 closes the grasping arms 1354, and releasing/opening the switch or push button 1820 opens the grasping arms 1354, any other suitable control scheme may be used to control the automated actuation of the grasping arms 1354 via the electromagnets 1710 and magnetic collar 1470.

It is also contemplated that the controller 1818 may be coupled to a position sensor, such as a Hall-effect sensor, to detect the movement of one or more magnets 1850 that are carried on the actuation collar 1470 to identify the position of the collar 1470 as it rotates. For example, one of the collar magnets 1850 may be configured to be detected by one or more stationary Hall-effect sensors (not shown) that are mounted on the elongated main body 1310. The Hall-effect sensors may supply their output to the controller 1818 to detect the position of the actuation collar 1470 as it rotates, thus allowing the controller 1818 to apply the appropriate electrical pulses to the electromagnets 1710 in order to achieve the movement of the actuation collar 1470, so as to open and close the grasping arms 1354.

It will, therefore, be appreciated that one advantage of one or more embodiments of the present invention is that a fastener extraction device utilizes an automated actuation collar to move pivoting grasping arms between opened and closed positions, allowing the extraction device to easily grasp, extract, and release a screw or other fastener. Still another advantage of the present invention is that a fastener extraction device utilizes an automated actuation collar to control the opening and closing of a plurality of grasping arms in order to extract a fastener without requiring the operator to release his or her hands from an operative position on the driver tool, thus avoiding interruptions in the operator's work flow, which is normally caused when a fastener is extracted.

Thus, it can be seen that one or more aspects of the invention have been satisfied by the structure and methods provided above. In accordance with the Patent Statutes, only the best mode and certain alternative embodiments have been presented in the application and described in any detail. It should be understood that the spirit and scope of the appended claims should not be limited to the description of the embodiments contained herein, the true scope and breadth of the invention being defined by the claims as follows.

What is claimed is:

1. A fastener extraction device for attachment to a driver tool having a rotating shank to drive a fastener into a surface, the fastener extraction device comprising:

an elongated main body adapted to be attached to the driver, said main body including a plurality of electromagnets;

a carriage carried within said body;

a plurality of grasping arms each having an extraction guide extending therefrom, said plurality of grasping arms pivotably attached to said carriage with each said grasping arm biased by a bias spring;

an actuation collar rotatably attached to said elongated main body and in operative contact with said grasping arms, said actuation collar including a plurality of collar magnets in operative communication with said electromagnets;

a switch; and a controller coupled to said switch and said electromagnets, said controller supplying a train of electrical pulses to said electromagnets to control the magnetic orientation of said electromagnets relative to the magnetic orientation of said collar magnets to rotate said actuation collar;

wherein said elongated main body, said carriage, and said actuation collar are configured to receive the rotating shank therethrough, such that when said switch is placed in a first state, said controller generates a first pulse train to rotate said actuation collar to a first position, whereby said grasping arms are pivoted to form an extraction aperture about the fastener, and when said switch is placed in a second state said controller generates a second pulse train to rotate said actuation collar to a second position, whereby said grasping arms are pivoted away from the fastener.

2. The fastener extraction device of claim 1, wherein said carriage is biased against the driver tool by a base spring disposed between said carriage and the driver tool.

3. The fastener extraction device of claim 1, wherein said grasping arms each include an extraction guide that include a notch, such that when said actuation collar is moved to said first position, said notches substantially form said extraction aperture.

4. The fastener extraction device of claim 1, further comprising a bias tab pivotably attached to each said grasping arm, said bias tab biased by said bias spring to engage said elongated main body.

5. The fastener extraction device of claim 1, wherein said actuation collar includes a plurality of engagement protrusions each separated by a plurality of release channels, such that when said actuation collar is rotated to said first position, each said engagement protrusion is disposed upon each said respective grasping arm, and when said actuation collar is rotated to said second position, each said grasping arm is moved into said respective release channels.

* * * * *